US009697769B2

(12) United States Patent
Kishi et al.

(10) Patent No.: US 9,697,769 B2
(45) Date of Patent: Jul. 4, 2017

(54) DISPLAY DEVICE AND DRIVE METHOD FOR SAME

(71) Applicant: Sharp Kabushiki Kaisha, Osaka-shi, Osaka (JP)

(72) Inventors: Noritaka Kishi, Osaka (JP); Noboru Noguchi, Osaka (JP); Shigetsugu Yamanaka, Osaka (JP); Masanori Ohara, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 47 days.

(21) Appl. No.: 14/892,620

(22) PCT Filed: Jul. 29, 2014

(86) PCT No.: PCT/JP2014/069876

§ 371 (c)(1),
(2) Date: Nov. 20, 2015

(87) PCT Pub. No.: WO2015/016196

PCT Pub. Date: Feb. 5, 2015

(65) Prior Publication Data

US 2016/0104422 A1 Apr. 14, 2016

(30) Foreign Application Priority Data

Jul. 30, 2013 (JP) ..... 2013-157502

(51) Int. Cl.

| | |
|---|---|
| ***G09G 3/30*** | (2006.01) |
| ***G09G 3/3233*** | (2016.01) |
| ***G09G 3/00*** | (2006.01) |

(52) U.S. Cl.

CPC ..... *G09G 3/3233* (2013.01); *G09G 3/006* (2013.01); *G09G 2300/0404* (2013.01);

(Continued)

(58) Field of Classification Search

CPC ..... G09G 3/3233; G09G 3/3208; G09G 3/32; G09G 3/006; G09G 2310/021;

(Continued)

(56) References Cited

U.S. PATENT DOCUMENTS

| | | | | |
|---|---|---|---|---|
| 9,123,295 | B2 * | 9/2015 | Jeong | G09G 3/3233 |
| 9,280,933 | B2 * | 3/2016 | Chaji | G09G 3/3233 |

(Continued)

FOREIGN PATENT DOCUMENTS

| | | | |
|---|---|---|---|
| JP | 2007233326 | A | 9/2007 |
| JP | 2008523448 | A | 7/2008 |
| JP | 2012134475 | A | 7/2012 |

OTHER PUBLICATIONS

International Search Report PCT/ISA/210 for International Application No. PCT/JP2014/069876 dated Oct. 23, 2014.

Written Opinion of the International Searching Authority PCT/ISA/237 for International Application No. PCT/JP2014/069876 dated Oct. 23, 2014.

*Primary Examiner* — Vijay Shankar

(74) *Attorney, Agent, or Firm* — Harness, Dickey & Pierce, P.L.C.

(57) ABSTRACT

In a display device having a pixel circuit including an electro-optical element in which brightness is controlled by a current, and including a drive transistor for controlling a current to be supplied to the electro-optical element, a drive method therefor includes: a noise measurement step of measuring noise; characteristic detection steps of detecting characteristics of the drive transistor and the electro-optical element; a correction data update step of updating correction data, which serves for correcting a video signal, based on detection results in the characteristic detection step; and a video signal correction step of correcting the video signal based on the correction data. When noise with a standard (Continued)

value or more is detected in the noise measurement step, processing of the correction data update step is not performed.

20 Claims, 45 Drawing Sheets

(52) U.S. Cl.
CPC ..... *G09G 2300/0842* (2013.01); *G09G 2310/021* (2013.01); *G09G 2310/0218* (2013.01); *G09G 2310/08* (2013.01); *G09G 2320/0295* (2013.01); *G09G 2320/043* (2013.01); *G09G 2320/045* (2013.01)

(58) Field of Classification Search
CPC ..... G09G 2310/08; G09G 2310/0218; G09G 2320/043; G09G 2320/045
USPC ..... 345/76–80, 89–96, 204–215
See application file for complete search history.

(56) References Cited

U.S. PATENT DOCUMENTS

| | | | | |
|---|---|---|---|---|
| 9,530,349 | B2 * | 12/2016 | Chaji ..... | G09G 3/3233 |
| 2006/0158402 | A1 | 7/2006 | Nathan et al. | |
| 2007/0200804 | A1 | 8/2007 | Kwon | |
| 2012/0138922 | A1 | 6/2012 | Yamazaki et al. | |

* cited by examiner

| | CHARACTERISTIC DETECTION OPERATION | USUAL OPERATION |
|---|---|---|
| (K+1)-TH FRAME | FIRST ROW | SECOND TO n-TH ROW |
| (K+2)-TH FRAME | SECOND ROW | FIRST ROW, THIRD TO n-TH ROW |
| (K+3)-TH FRAME | THIRD ROW | FIRST ROW, SECOND ROW, FORTH TO n-TH ROW |
| ⋮ | ⋮ | ⋮ |
| (K+n)-TH FRAME | n-TH ROW | FIRST TO (n-1)-TH ROW |

Fig.24

| | CONTROL A1 | CONTROL A2 | CONTROL B | CONTROL C | CONTROL D |
|---|---|---|---|---|---|
| PERIOD IN WHICH G1(i) IS SET TO HIGH LEVEL | USUAL 1H PERIOD | USUAL 1H PERIOD + TFT CHARACTERISTIC DETECTION PERIOD | USUAL 1H PERIOD + TFT CHARACTERISTIC DETECTION PERIOD | USUAL 1H PERIOD + TFT CHARACTERISTIC DETECTION PERIOD | USUAL 1H PERIOD + TFT CHARACTERISTIC DETECTION PERIOD |
| STATE OF G2(i) | PREVIOUS STATE IS MAINTAINED | PREVIOUS STATE IS MAINTAINED | ONLY MONITOR ROW IS AT HIGH LEVEL | ONLY MONITOR ROW IS AT HIGH LEVEL | ONLY MONITOR ROW IS AT HIGH LEVEL |
| CONTENTS OF S(j) | GRADATION DATA | GRADATION DATA | GRADATION DATA × K | BLACK DATA | BLACK DATA |
| STATE OF MONITOR LINE SWITCH | PREVIOUS STATE IS MAINTAINED | PREVIOUS STATE IS MAINTAINED | OFF (Hi-Z) | ONLY MONITOR COLUMN IS ON | ONLY MONITOR COLUMN IS ON |
| STATE OF M(j) | | | | SUPPLY OF ELVSS, CURRENT MEASUREMENT => SUPPLY OF GRADATION SIGNAL, VOLTAGE MEASUREMENT | SUPPLY OF ELVSS, CURRENT MEASUREMENT |
| UPDATE OF CORRECTION DATA | NONE | NONE | NONE | PRESENT (TFT, OLED) | PRESENT (ONLY TFT) |

Fig.49

| | CONTROL A1 | CONTROL B | CONTROL C | CONTROL D | CONTROL E |
|---|---|---|---|---|---|
| PERIOD IN WHICH G1(i) IS SET TO HIGH LEVEL | USUAL 1H PERIOD | USUAL 1H PERIOD + TFT CHARACTERISTIC DETECTION PERIOD | USUAL 1H PERIOD + TFT CHARACTERISTIC DETECTION PERIOD | USUAL 1H PERIOD + TFT CHARACTERISTIC DETECTION PERIOD | USUAL 1H PERIOD |
| STATE OF G2(i) | PREVIOUS STATE IS MAINTAINED | ONLY MONITOR ROW IS AT HIGH LEVEL | ONLY MONITOR ROW IS AT HIGH LEVEL | ONLY MONITOR ROW IS AT HIGH LEVEL | ALL ROWS ARE AT LOW LEVEL (ROW WHICH IS AT HIGH LEVEL IMMEDIATELY BEFORE IS STORED) |
| CONTENTS OF S(j) | GRADATION DATA | GRADATION DATA × K | BLACK DATA | BLACK DATA | GRADATION DATA |
| STATE OF MONITOR LINE SWITCH | PREVIOUS STATE IS MAINTAINED | OFF (Hi-Z) | ONLY MONITOR COLUMN IS ON | ONLY MONITOR COLUMN IS ON | OFF |
| STATE OF M(j) | | | SUPPLY OF ELVSS, CURRENT MEASUREMENT => SUPPLY OF GRADATION SIGNAL, VOLTAGE MEASUREMENT | SUPPLY OF ELVSS, CURRENT MEASUREMENT | |
| UPDATE OF CORRECTION DATA | NONE | NONE | PRESENT (TFT, OLED) | PRESENT (ONLY TFT) | NONE |

DISPLAY DEVICE AND DRIVE METHOD FOR SAME

TECHNICAL FIELD

The present invention relates to a display device and a drive method for the same, and more specifically, relates to a display device including a pixel circuit having an electro-optical element such as an organic EL (Electro Luminescence) element, and to a drive method for the same.

BACKGROUND ART

Heretofore, as a display element which the display device includes, there are: an electro-optical element in which brightness is controlled by a voltage applied thereto; and an electro-optical element in which brightness is controlled by a current flowing therethrough. As a representative example of the electro-optical element in which the brightness is controlled by the voltage applied thereto, a liquid crystal display element is mentioned. Meanwhile, as a representative example of the electro-optical element in which the brightness is controlled by the current flowing therethrough, an organic EL element is mentioned. The organic EL element is also referred to as an OLED (Organic Light-Emitting Diode). In comparison with the liquid crystal display device that requires a backlight, color filters and the like, an organic EL display device using the organic EL element that is a light emission-type electro-optical element can easily achieve thinning, reduction of electric power consumption, enhancement of the brightness, and the like. Hence, in recent years, development of the organic EL display device has been progressed positively.

As a drive method for the organic EL display device, a passive matrix method (also referred to as a simple matrix method) and an active matrix method are known. An organic EL display device that adopts the passive matrix method has a simple structure; however, a size increase and definition enhancement thereof are difficult. In contrast, an organic EL display device that adopts the active matrix method (hereinafter, referred to as an "active matrix-type organic EL display device") can easily realize the size increase and the definition enhancement in comparison with the organic EL display device that adopts the passive matrix method.

In the active matrix-type organic EL display device, a plurality of pixel circuits is formed in a matrix fashion. Typically, each of the pixel circuits of the active matrix-type organic EL display device includes: an input transistor that selects a pixel; and a drive transistor that controls supply of a current to the organic EL element. Note that, in the following, the current flowing from the drive transistor to the organic EL element is sometimes referred to as a "drive current".

FIG. 51 is a circuit diagram showing a configuration of a conventional general pixel circuit 91. This pixel circuit 91 is provided so as to correspond to each of crossing points of a plurality of data lines S and a plurality of scanning lines G, which are arranged on a display unit. As shown in FIG. 51, this pixel circuit 91 includes: two transistors T1 and T2; one capacitor Cst; and one organic EL element OLED. The transistor T1 is an input transistor, and the transistor T2 is a drive transistor.

The transistor T1 is provided between the data line S and a gate terminal of the transistor T2. With regard to the transistor T1, a gate terminal thereof is connected to the scanning line G, and a source terminal thereof is connected to the data line S. The transistor T2 is provided in series to the organic EL element OLED. With regard to the transistor T2, a drain terminal thereof is connected to a power supply line that supplies a high-level power supply voltage ELVDD, and a source terminal thereof is connected to an anode terminal of the organic EL element OLED. Note that the power supply line that supplies the high-level power supply voltage ELVDD is hereinafter referred to as a "high-level power supply line", and the high-level power supply line is denoted by the same reference symbol ELVDD as that of the high-level power supply voltage. With regard to the capacitor Cst, one end thereof is connected to the gate terminal of the transistor T2, and other end thereof is connected to the source terminal of the transistor T2. A cathode terminal of the organic EL element OLED is connected to a power supply line that supplies a low-level power supply voltage ELVSS. Note that the power supply line that supplies the low-level power supply voltage ELVSS is hereinafter referred to as a "low-level power supply line", and the low-level power supply line is denoted by the same reference symbol ELVSS as that of the low-level power supply voltage. Moreover, here, a connecting point of the gate terminal of the transistor T2, the one end of the capacitor Cst and the drain terminal of the transistor T1 is referred to as a "gate node VG" for the sake of convenience. Note that, in general, either one of the drain and the source, which has a higher potential, is referred to as the drain. However, in the explanation of this description, one thereof is defined as the drain, and the other thereof is defined as the source. Accordingly, in some case, a source potential becomes higher than a drain potential.

FIG. 52 is a timing chart for explaining operations of the pixel circuit 91 shown in FIG. 51. Before a time t1, the scanning line G is in a non-selection state. Hence, before the time t1, the transistor T1 is in an OFF state, and a potential of the gate node VG maintains an initial level (for example, a level corresponding to writing in an immediately previous frame). When the time t1 comes, the scanning line G turns to a selection state, and the transistor T1 turns ON. Thus, a data voltage Vdata corresponding to brightness of a pixel (sub-pixel), which is formed by this pixel circuit 91, is supplied to the gate node VG via the data line S and the transistor T1. Thereafter, during a period until a time t2, the potential of the gate node VG changes in response to the data voltage Vdata. At this time, the capacitor Cst is charged with a gate-source voltage Vgs that is a difference between the potential of the gate node Vg and the source potential of the transistor T2. When the time t2 comes, the scanning line G turns to the non-selection state. Thus, the transistor T1 turns OFF, and the gate-source voltage Vgs held by the capacitor Cst is determined. The transistor T2 supplies a drive current to the organic EL element OLED in response to the gate-source voltage Vgs held by the capacitor Cst. As a result, the organic EL element OLED emits light with brightness corresponding to the drive current.

Incidentally, in the organic EL display device, typically, a thin film transistor (TFT) is adopted as the drive transistor. However, the thin film transistor is prone to cause variations in characteristics thereof. Specifically, the variations are prone to occur in the threshold voltage. When the variations of the threshold voltage occur in the drive transistor provided in the display unit, variations of the brightness occur, and accordingly, display quality is decreased. Moreover, with regard to the organic EL element, current efficiency thereof is decreased with the elapse of time. Hence, even when a constant current is supplied to the organic EL element, the brightness is gradually decreased with the elapse of time. As a result, the burn-in occurs.

If no compensation is made for such a deterioration of the drive transistor and such a deterioration of the organic EL element, then as shown in FIG. 53, a current decrease resulting from the deterioration of the drive transistor occurs, and in addition, a brightness decrease resulting from the deterioration of the organic EL element occurs. Moreover, even if the compensation is made for the deterioration of the drive transistor, unless the compensation is made for the deterioration of the organic EL element, then the brightness decrease resulting from the deterioration of the organic EL element occurs as the time elapses as shown in FIG. 54. Accordingly, heretofore, with regard to the organic EL display device, a technology for compensating for the deterioration of such a circuit element has been proposed.

As a technology related to such compensation processing, there are known: an internal compensation technology for performing the compensation processing, for example, by holding a threshold voltage of the drive transistor in a capacitor provided between the gate and source of the drive transistor in an inside of the pixel circuit; and an external compensation technology for performing the compensation processing, for example, by measuring a magnitude of a current, which flows through the drive transistor under a predetermined condition, by a circuit provided outside of the pixel circuit, and correcting a video signal based on a measurement result thereof.

Note that, in relation to the present invention, the following literatures of the prior art are known. Japanese Unexamined Patent Application Publication No. 2008-523448 discloses an external compensation technology for correcting data based on characteristics of the drive transistor and characteristics of the organic EL element. Japanese Patent Application Laid-Open No. 2007-233326 discloses an external compensation technology for enabling display of an image with uniform brightness irrespective of the threshold voltage and electron mobility of the drive transistor.

PRIOR ART DOCUMENTS

Patent Documents

[Patent Document 1] Japanese Unexamined Patent Application Publication No. 2008-523448

[Patent Document 2] Japanese Patent Application Laid-Open No. 2007-233326

SUMMARY OF THE INVENTION

Problems to be Solved by the Invention

However, in a case where the external compensation technology is adopted in the organic EL display device, the compensation processing is performed by detecting a current that is as slight as approximately several ten nanoamperes. Therefore, when noise is mixed into such a detection current, for example, owing to an approach of a charged substance, then an error to an unignorable extent occurs between a proper current value and a measurement value. Moreover, commercial sales of an organic EL display device that mounts a touch panel thereon have been started. With regard to this, the touch panel is relatively prone to generate noise. Hence, it is conceivable that the error occurs between the proper current value and the measurement value owing to an influence of the noise emitted from the touch panel. As described above, in the case where the external compensation technology is adopted in the organic EL display device, then it is apprehended that the noise may be mixed into the detection current owing to the approach of the charged substance and the presence of the touch panel, and that an S/N ratio of the detection current may be thereby degraded (refer to FIG. 55). When the S/N ratio of the detection current is deteriorated, accuracy of the compensation is decreased.

Japanese Unexamined Patent Application Publication No. 2008-523448 and Japanese Patent Application Laid-Open No. 2007-233326 do not disclose anything related to the noise. Hence, in a case where the noise is mixed, the S/N ratio of the detection current is degraded, and the accuracy of the compensation is decreased.

Accordingly, it is an object of the present invention to prevent the decrease in the compensation accuracy, which results from the noise, in a display device in which the external compensation technology is adopted in order to compensate for the deterioration of the circuit element.

Means for Solving the Problems

A first aspect of the present invention is directed to a drive method for a display device having a pixel matrix of n rows and m columns (n and m are integers of 2 or more), which is composed of n×m pieces of pixel circuits each including an electro-optical element in which brightness is controlled by a current and including a drive transistor for controlling a current to be supplied to the electro-optical element, the drive method comprising:

a noise measurement step of measuring noise;

a characteristic detection step of detecting at least either one of characteristics of the drive transistor and characteristics of the electro-optical element;

a correction data update step of updating correction data, which is stored in a correction data storage unit provided in the display device, based on a detection result in the characteristic detection step; and a video signal correction step of correcting a video signal, which is to be supplied to the n×m pieces of pixel circuits, based on the correction data stored in the correction data storage unit, wherein, when noise with a standard value or more is detected in the noise measurement step, processing of the characteristic detection step immediately after a point of time when the noise is detected is not performed, or processing of the correction data update step, that is based on a detection result in the characteristic detection step performed at a point of time close to the point of time when the noise is detected, is not performed.

According to a second aspect of the present invention, in the first aspect of the present invention, when the noise with the standard value or more is detected in the noise measurement step, at least either one of processing of the correction data update step, that is based on a detection result in the characteristic detection step performed immediately before the point of time when the noise is detected, and processing of the correction data update step, that is based on a detection result in the characteristic detection step performed immediately after the point of time when the noise is detected, is not performed.

According to a third aspect of the present invention, in the first aspect of the present invention, at least either one of the characteristics of the drive transistor and the characteristics of the electro-optical element is detected for only one row of the pixel matrix in the characteristic detection step in a frame period;

when a frame period in which the processing of the characteristic detection step is performed for a Z-th row (Z is an integer of 1 or more to n or less) is defined as an object frame period, in a case where the noise with the standard value or more is detected in the noise measurement step in the object frame period, the processing of the correction data update step, that is based on the detection result in the characteristic detection step performed in the object frame period, is not performed, and the processing of the characteristic detection step for the Z-th row is performed also in a frame period next to the object frame period; and in a case where the noise with the standard value or more is not detected in the noise measurement step in the object frame period, and where the noise with the standard value or more is detected in the noise measurement step in the frame period next to the object frame period, then the processing of the correction data update step, that is based on the detection result in the characteristic detection step performed in the object frame period, and the processing of the correction data update step, that is based on the detection result in the characteristic detection step performed in the frame period next to the object frame period, are not performed, and the processing of the characteristic detection step for the Z-th row is performed also in a frame period two frames after the object frame period.

According to a fourth aspect of the present invention, in the first aspect of the present invention, at least either one of the characteristics of the drive transistor and the characteristics of the electro-optical element is detected only for one row of the pixel matrix in the characteristic detection step in a frame period, and the processing of the correction data update step, that is based on a detection result in the characteristic detection step for a Z-th row (Z is an integer of 1 or more to n or less), is performed only when the noise with the standard value or more is not detected in both of the noise measurement step performed immediately before the characteristic detection step for the Z-th row and the noise measurement step performed immediately after the characteristic detection step for the Z-th row.

According to a fifth aspect of the present invention, in the fourth aspect of the present invention, the processing of the noise measurement step is performed before and after the characteristic detection step in a frame period.

According to a sixth aspect of the present invention, in the first aspect of the present invention, the processing of the noise measurement step is performed every a plurality of frame periods.

According to a seventh aspect of the present invention, in the first aspect of the present invention, the characteristic detection step includes:

a first characteristic detection step of detecting the characteristics of the drive transistor; and a second characteristic detection step of detecting the characteristics of the electro-optical element, one frame period includes a noise measurement period in which the processing of the noise measurement step is performed, a selection period in which a preparation to allow the electro-optical element to emit light is performed, and a light emission period in which light emission of the electro-optical element is performed, processing of the first characteristic detection step is performed in the selection period, and processing of the second characteristic detection step is performed in the light emission period.

According to an eighth aspect of the present invention, in the seventh aspect of the present invention, in the second characteristic detection step, the characteristics of the electro-optical element are detected by measuring a voltage of an anode of the electro-optical element in a state where a constant current is given to the electro-optical element.

According to a ninth aspect of the present invention, in the seventh aspect of the present invention, in the second characteristic detection step, the characteristics of the electro-optical element are detected by measuring a current, which flows through the electro-optical element, in a state where a constant voltage is given to the electro-optical element.

According to a tenth aspect of the present invention, in the seventh aspect of the present invention, in the first characteristic detection step, the characteristics of the drive transistor are detected by measuring a current, which flows between a drain and a source of the drive transistor in a state where a voltage between a gate and a source of the drive transistor is set at a predetermined magnitude.

According to an eleventh aspect of the present invention, in the first aspect of the present invention, the display device further includes a touch panel, and the processing of the characteristic detection step is not performed throughout a period in which a clock operation by the touch panel is performed.

According to a twelfth aspect of the present invention, in the eleventh aspect of the present invention, the touch panel performs the clock operation in a vertical retrace line period, and the processing of the characteristic detection step is not performed throughout the vertical retrace line period.

A thirteenth aspect of the present invention is directed to a display device having a pixel matrix of n rows and m columns (n and m are integers of 2 or more), which is composed of n×m pieces of pixel circuits each including an electro-optical element in which brightness is controlled by a current and including a drive transistor for controlling a current to be supplied to the electro-optical element, the display device comprising:

a pixel circuit drive unit configured to drive the n×m pieces of pixel circuits while performing characteristic detection processing for detecting at least either one of characteristics of the drive transistor and characteristics of the electro-optical element;

a correction data storage unit configured to store correction data for correcting a video signal;

a control unit configured to control operations of the pixel circuit drive unit while performing correction data update processing for updating the correction data, which is stored in the correction data storage unit, based on a detection result in the characteristic detection processing, and video signal correction processing for correcting the video signal, which is to be supplied to the n×m pieces of pixel circuits, based on the correction data stored in the correction data storage unit; and a noise measurement unit configured to measure noise, wherein, when noise with a standard value or more is detected by the noise measurement unit, the control unit controls operations of the pixel circuit drive unit so that the characteristic detection processing immediately after a point of time when the noise is detected is not performed, or the control unit does not perform the correction data update processing that is based on a detection result in the characteristic detection processing performed at a point of time close to the point of time when the noise is detected.

According to a fourteenth aspect of the present invention, in the thirteenth aspect of the present invention, when the noise with the standard value or more is detected by the noise measurement unit, the control unit does not perform at least either one of the correction data update processing that is based on a detection result in the characteristic detection processing performed immediately before the point of time when the noise is detected and the correction data update processing that is based on a detection result in the characteristic detection processing performed immediately after the point of time when the noise is detected.

According to a fifteenth aspect of the present invention, in the thirteenth aspect of the present invention, the display device further comprises monitor lines provided to correspond to respective columns of the pixel matrix, wherein the pixel circuit drive unit includes a characteristic detection unit configured to perform the characteristic detection processing by measuring a current flowing through each of the monitor lines or a voltage at a predetermined position on each of the monitor lines.

According to a sixteenth aspect of the present invention, in the fifteenth aspect of the present invention, the noise measurement unit shares a same circuit with the characteristic detection unit, and when the measurement of the noise by the noise measurement unit is performed, each of the monitor lines is set to a state of being electrically separated from the electro-optical element and the drive transistor.

According to a seventeenth aspect of the present invention, in the fifteenth aspect of the present invention, the noise measurement unit is provided on an outside of an organic EL panel separately from the characteristic detection unit, the organic EL panel including the pixel matrix.

According to an eighteenth aspect of the present invention, in the fifteenth aspect of the present invention, the characteristic detection unit is provided only one for K pieces of the monitor lines (K is an integer of 2 or more to m or less), and in a frame period, one of the K pieces of monitor lines is electrically connected to the characteristic detection unit, and a monitor line that is not electrically connected to the characteristic detection unit is set to a high-impedance state.

According to a nineteenth aspect of the present invention, in the thirteenth aspect of the present invention, the display device further comprises a touch panel, wherein the control unit controls operations of the pixel circuit drive unit so that the characteristic detection processing is stopped throughout a period in which a clock operation by the touch panel is performed.

According to a twentieth aspect of the present invention, in the nineteenth aspect of the present invention, the touch panel performs the clock operation in a vertical retrace line period, and the control unit controls the operations of the pixel circuit drive unit so that the characteristic detection processing is stopped throughout the vertical retrace line period.

Effects of the Invention

According to the first aspect of the present invention, the drive method for a display device having a pixel circuit including an electro-optical element (for example, an organic EL element) in which brightness is controlled by a current, and including a drive transistor for controlling a current to be supplied to the electro-optical element includes the noise measurement step of measuring noise. When the magnitude of the noise detected in the noise measurement step is less than the standard value, the video signal is corrected by using the correction data obtained in consideration of the detection result of the characteristics of the drive transistor and the electro-optical element. The video signal thus corrected is supplied to the pixel circuit, and accordingly, a drive current with such a magnitude that compensates for the deterioration of the drive transistor and the electro-optical element is supplied to the electro-optical element. Here, when the magnitude of the noise detected in the noise measurement step is the standard value or more, the correction data is not updated. That is to say, the correction data is not updated at such a time when an error to an unignorable extent occurs between the original current value and the measurement value with regard to the detection current for the external compensation for the deterioration of the circuit element. Hence, the decrease in the compensation accuracy, which is caused by a fact that the value of the correction data becomes an inappropriate value, is prevented. Thus, in the display device in which the external compensation technology for compensating for the deterioration of the circuit element is adopted, it becomes possible to prevent the decrease in the compensation accuracy, which results from the noise.

According to the second aspect of the present invention, a similar effect to that of the first aspect of the present invention is obtained.

According to the third aspect of the present invention, the row that serves as an object of the characteristic detection is maintained during a period while the noise is occurring. Therefore, the number of times of the characteristic detection is prevented from differing among the rows. In such a way, it becomes possible to perform the compensation, which is made for the deterioration of the drive transistor and the electro-optical element, uniformly on the entire screen, and the occurrence of the brightness variations is prevented effectively.

According to the fourth aspect of the present invention, the correction data is updated only in the case where the magnitude of the noise is less than the standard value in both of the noise measurement step immediately before the characteristic detection step and the noise measurement step immediately after the characteristic detection step. As described above, the correction data is updated in consideration of the states of the noise in the periods before and after the period while the characteristic detection is performed, and accordingly, the decrease in the compensation accuracy, which is caused by a fact that the value of the correction data becomes an inappropriate value, is prevented effectively.

According to the fifth aspect of the present invention, a similar effect to that of the fourth aspect of the present invention is obtained.

According to the sixth aspect of the present invention, a similar effect to that of the first aspect of the present invention is obtained while decreasing a frequency to measure the noise.

According to the seventh aspect of the present invention, the characteristics of the drive transistor are detected in the selection period, and the characteristics of the electro-optical element are detected in the light emission period of the electro-optical element. Accordingly, the length of the light emission period is suppressed from being shortened than heretofore since the characteristics of the drive transistor and the electro-optical element are detected.

According to the eighth aspect of the present invention, a constant current is supplied to the electro-optical element from which the characteristics are detected. Therefore, the time to supply a constant current to the electro-optical element is adjusted, whereby it becomes possible to allow the electro-optical element to emit light at desired brightness.

According to the ninth aspect of the present invention, it becomes possible to shorten the measurement time for detecting the characteristics of the electro-optical element.

According to the tenth aspect of the present invention, it becomes possible to detect the characteristics of the drive transistor relatively easily.

According to the eleventh aspect of the present invention, in the display device in which the external compensation technology is adopted in order to compensate for the deterioration of the circuit element, it becomes possible to prevent the decrease in the compensation accuracy, which results from the noise, even when the touch panel is mounted.

According to the twelfth aspect of the present invention, a similar effect to that of the eleventh aspect of the present invention is obtained.

According to the thirteenth aspect of the present invention, a similar effect to that of the first aspect of the present invention can be exerted in the invention of the display device.

According to the fourteenth aspect of the present invention, a similar effect to that of the second aspect of the present invention can be exerted in the invention of the display device.

According to the fifteenth aspect of the present invention, in the display device having the configuration in which the characteristics of the drive transistor and the electro-optical element are detected by measuring the current flowing through the monitor line provided to correspond to each of the columns of the pixel matrix or by measuring the voltage at the predetermined position on the monitor line, it becomes possible to prevent the decrease in the compensation accuracy, which results from the noise.

According to the sixteenth aspect of the present invention, it is not necessary to provide a noise measurement circuit separately from the characteristic detection unit. Therefore, it becomes possible to prevent the decrease in the compensation accuracy, which results from the noise, while suppressing the increase in the circuit area.

According to the seventeenth aspect of the present invention, it becomes possible to measure the noise at any timing in the frame period.

According to the eighteenth aspect of the present invention, one characteristic detection unit is shared by the plurality of monitor lines. Therefore, it becomes possible to prevent the decrease in the compensation accuracy, which results from the noise, while suppressing the increase in the circuit area.

According to the nineteenth aspect of the present invention, a similar effect to that of the eleventh aspect of the present invention can be exerted in the invention of the display device.

According to the twentieth aspect of the present invention, a similar effect to that of the twelfth aspect of the present invention can be exerted in the invention of the display device.

BRIEF DESCRIPTION OF THE DRAWINGS

FIG. 24 is a table for explaining respective controls in the first embodiment.

FIG. 49 is a table for explaining respective controls in the third embodiment.

MODES FOR CARRYING OUT THE INVENTION

A description is made below of embodiments of the present invention while referring to the accompanying drawings. Note that, in the following, it is assumed that m and n are integers of 2 or more, that i is an integer of 1 or more to n or less, and that j is an integer of 1 or more to m or less. Moreover, in the following, characteristics of a drive transistor provided in a pixel circuit are referred to as "TFT characteristics", and characteristics of an organic EL element provided in the pixel circuit are referred to as "OLED characteristics".

<1. First Embodiment>

<1.1 Overall Configuration>

Figure 2:
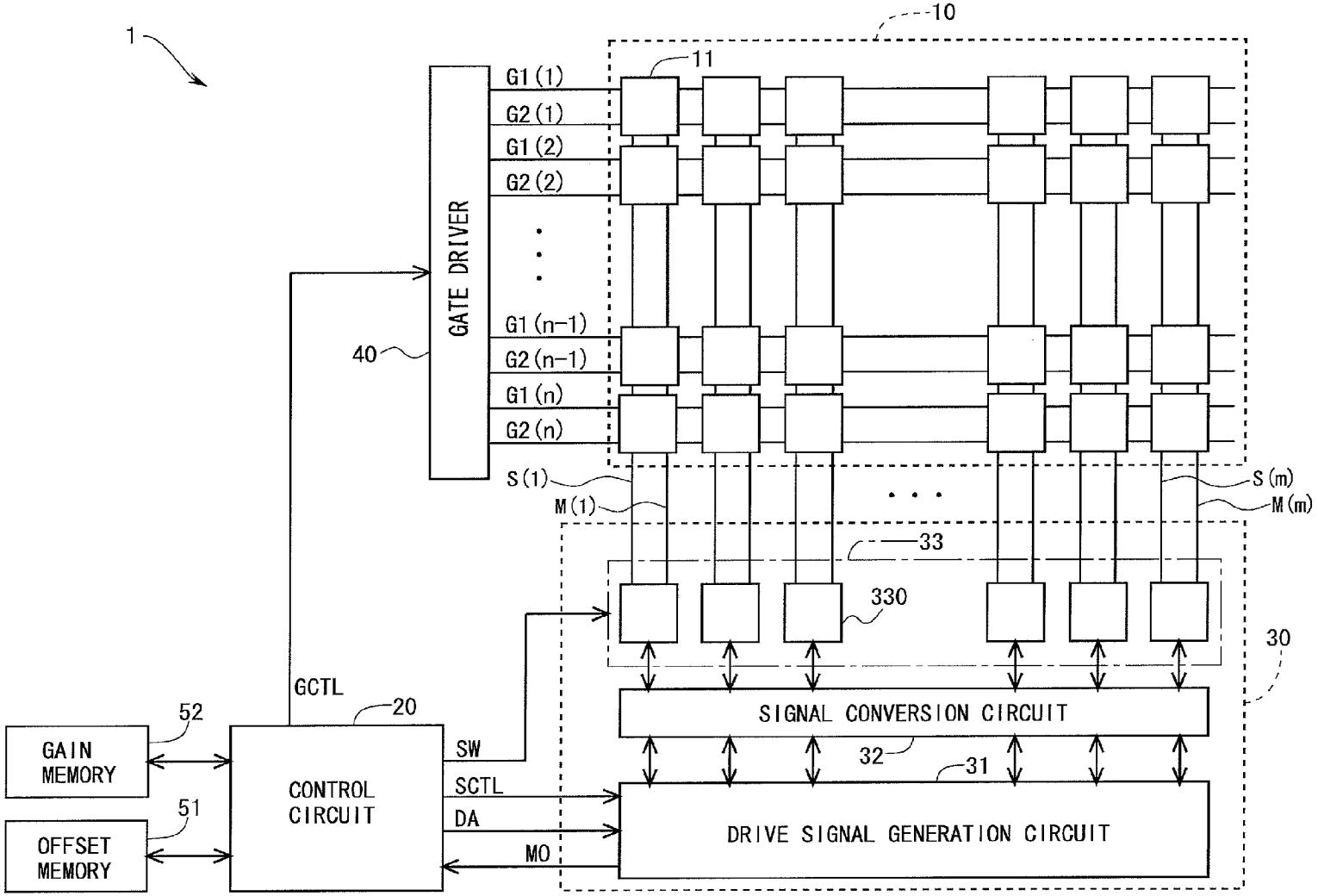
FIG. 2 is a block diagram showing an overall configuration of an active matrix-type organic EL display device according to the first embodiment.

FIG. 2 is a block diagram showing an overall configuration of an active matrix-type organic EL display device 1 according to a first embodiment of the present invention. This organic EL display device 1 includes: a display unit (organic EL panel) 10; a control circuit 20; a source driver (data line drive circuit) 30; a gate driver (scanning line drive circuit) 40; an offset memory 51; and a gain memory 52. Note that a configuration in which either one or both of the source driver 30 and the gate driver 40 are formed integrally with the display unit 10 may be adopted. Moreover, the offset memory 51 and the gain memory 52 may be physically composed of one memory.

Note that, in this embodiment, a control unit is realized by the control circuit 20, a pixel circuit drive unit is realized by the source driver 30 and the gate driver 40, and a correction data storage unit is realized by the offset memory 51 and the gain memory 52.

In the display unit 10, m pieces of data lines S(1) to S(m) and n pieces of scanning lines G1(1) to G1(n) perpendicular thereto are arranged. In the following, an extending direction of the data lines is defined as a Y-direction, and an extending direction of the scanning lines is defined as an X-direction.

Constituents which go along the Y-direction are sometimes referred to as "columns", and constituents which go along the X-direction are sometimes referred to as "rows". Moreover, in the display unit 10, m pieces of monitor lines M(1) to M(m) are arranged so as to correspond to the m pieces of data lines S(1) to S(m) in a one-to-one relationship. The data lines S(1) to S(m) and the monitor lines M(1) to M(m) are parallel to each other. Moreover, in the display unit 10, n pieces of monitor control lines G2(1) to G2(n) are arranged so as to correspond to the n pieces of scanning lines G1(1) to G1(n) in a one-to-one relationship. The scanning lines G1(1) to G1(n) and the monitor control lines G2(1) to G2(n) are parallel to each other. Moreover, in the display unit 10, n×m pieces of pixel circuits 11 are provided so as to correspond to crossing points of the n pieces of scanning lines G1(1) to G1(n) and the m pieces of data lines S(1) to S(m). The n×m pieces of pixel circuits 11 are provided as described above, whereby a pixel matrix with n rows and m columns is formed in the display unit 10. Moreover, in the display unit 10, there are arranged: high-level power supply lines which supply a high-level power supply voltage; and low-level power supply lines which supply a low-level power supply voltage.

Note that, in the following, in a case where it is not necessary to distinguish the m pieces of data lines S(1) to S(m) from one another, the data lines are simply denoted by reference symbol S. In a similar way, in a case where it is not necessary to distinguish the m pieces of monitor lines M(1) to M(m) from one another, the monitor lines are simply denoted by reference symbol M, in a case where it is not necessary to distinguish the n pieces of scanning lines G1(1) to G1(n) from one another, the scanning lines are simply denoted by reference symbol G1, and in a case where it is not necessary to distinguish the n pieces of monitor control lines G2(1) to G2(n) from one another, the monitor control lines are simply denoted by reference symbol G2.

The control circuit 20 controls operations of the source driver 30 by giving a data signal DA, a source control signal SCTL, and a switching control signal SW to the source driver 30, and controls operations of the gate driver 40 by transmitting a gate control signal GCTL to the gate driver 40. The source control signal SCTL includes, for example, a source start pulse, a source clock, and a latch strobe signal. The gate control signal GCTL includes, for example, a gate start pulse and a gate clock. Moreover, the control circuit 20 receives monitor data MO given from the source driver 30, and updates the offset memory 51 and the gain memory 52. Note that the monitor data MO is data (including noise data to be described later), which is measured in order to obtain TFT characteristics and OLED characteristics.

The gate driver 40 is connected to the n pieces of scanning lines G1(1) to G1(n) and the n pieces of monitor control lines G2(1) to G2(n). The gate driver 40 is composed of a shift register, a logic circuit and the like. Incidentally, in the organic EL display device 1 according to this embodiment, a video signal (data serving as an origin of the above-described data signal DA), which is sent from an outside, is corrected based on the TFT characteristics and the OLED characteristics. With regard to this, in each of frames, detection of the TFT characteristics and the OLED characteristics is performed for one row. That is to say, when the detection of the TFT characteristics and the OLED characteristics for a first row is performed in a certain frame, detection of the TFT characteristics and the OLED characteristics for a second row is performed in a next frame, and detection of the TFT characteristics and the OLED characteristics for a third row is performed in a frame next to the next frame. In such a way, during n frame periods, detection of the TFT characteristics and the OLED characteristics for n rows is performed. However, in each of the frames, the detection of the TFT characteristics and the OLED characteristics is not performed in a column in which noise with a standard value or more is detected.

Figure 3:
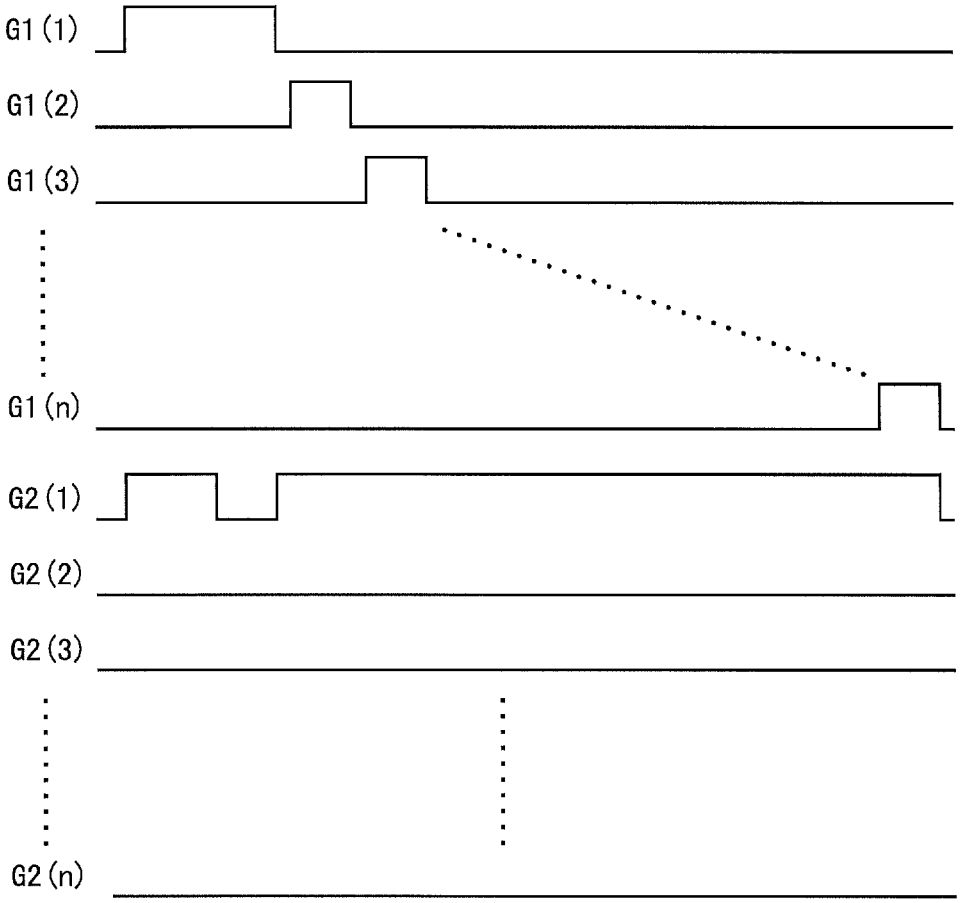
FIG. 3 is a timing chart for explaining operations of the gate driver in the first embodiment.
Figure 4:
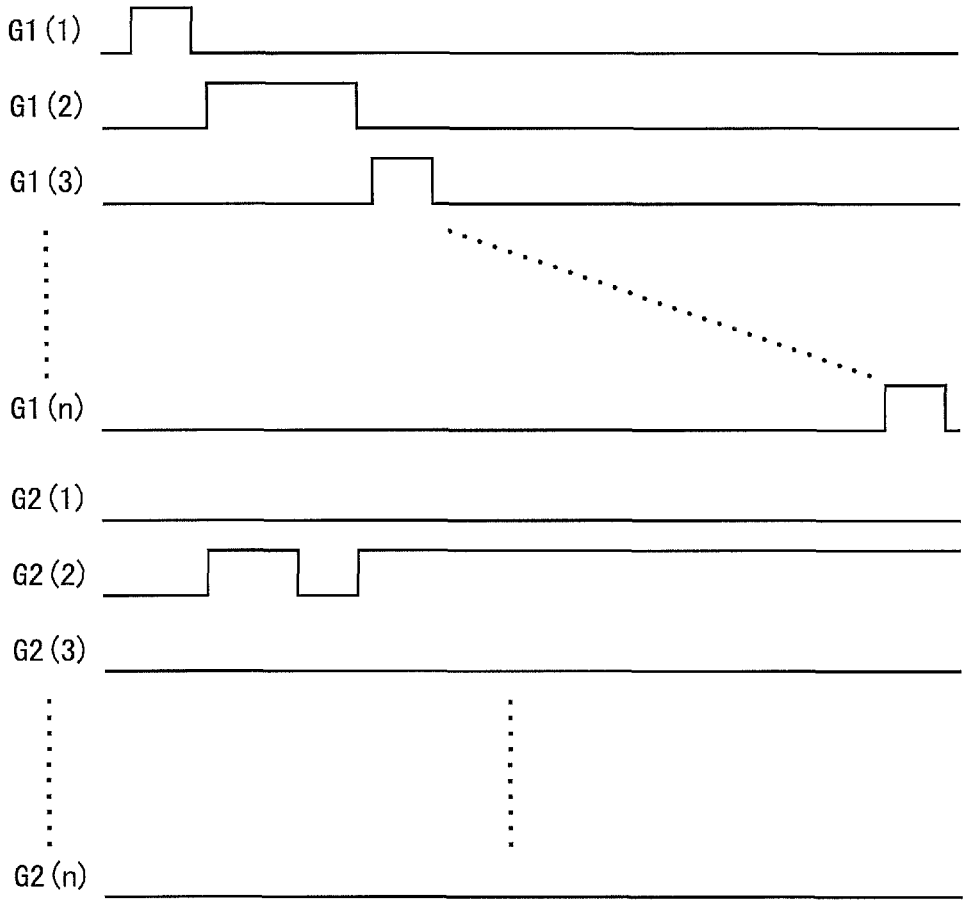
FIG. 4 is a timing chart for explaining the operations of the gate driver in the first embodiment.
Figure 5:
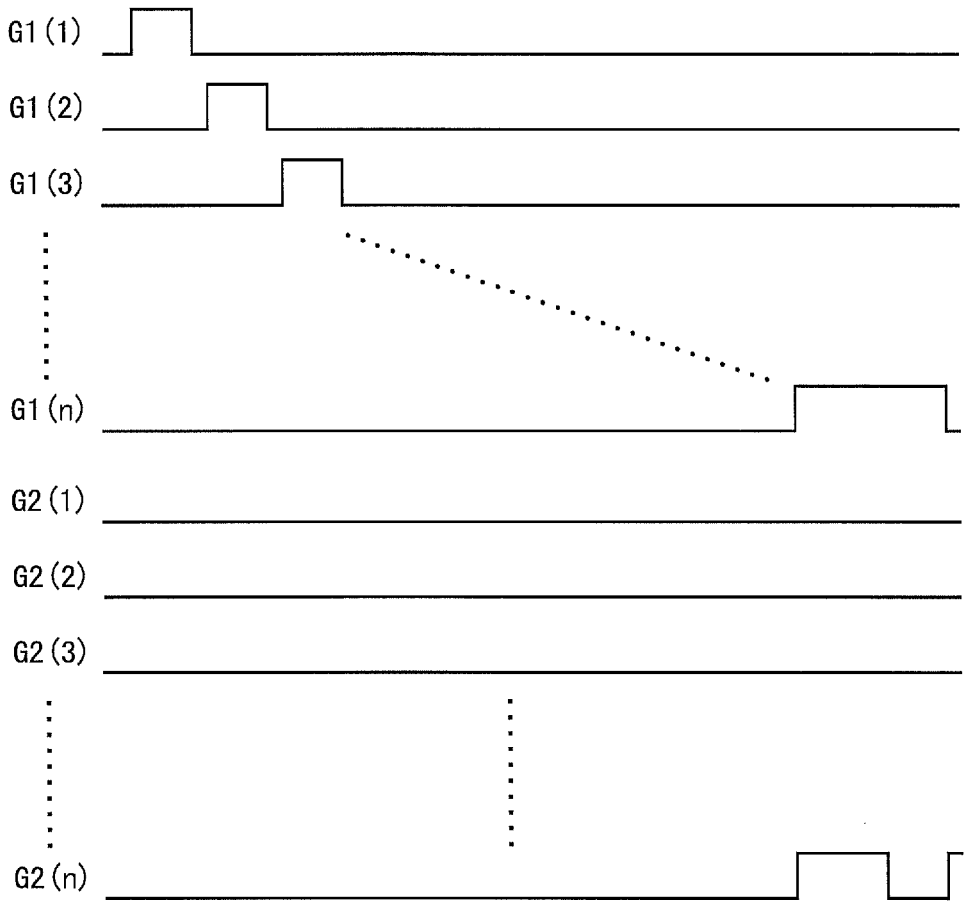
FIG. 5 is a timing chart for explaining the operations of the gate driver in the first embodiment.

Here, when the frame in which the detection of the TFT characteristics and the OLED characteristics for the first row is performed is defined as a (k+1)-th frame, then the n pieces of scanning lines G1(1) to G1(n) and the n pieces of monitor control lines G2(1) to G2(n) are driven as shown in FIG. 3 in the (k+1)-th frame, are driven as shown in FIG. 4 in a (k+2)-th frame, and are driven as shown in FIG. 5 in a (k+n)-th frame. Note that, with regard to FIG. 3 to FIG. 5, a high-level state is an active state. Moreover, a period in which the scanning lines G1 are in the active state is referred to as a "selection period". This selection period is a period for preparing to allow the organic EL elements, which are provided in the pixel circuits 11, to emit light. As grasped from FIG. 3 to FIG. 5, in each of the frames, only a scanning line, which corresponds to such a row for which the TFT characteristics and the OLED characteristics are detected, is set to the active state for a longer period than for other scanning lines. Hereinafter, such a row in which a selection period longer than usual is provided when focusing on any frame is referred to as a "monitor row", and rows other than the monitor row are referred to as "non-monitor rows". In this embodiment, in each of frames, the detection of the TFT characteristics and the OLED characteristics is performed in the monitor row. However, in a column in which the noise with the standard value or more is detected, the detection of the TFT characteristics and the OLED characteristics is not performed. In each of the frames, the monitor control lines G2 corresponding to the non-monitor rows are maintained in an inactive state. In contrast, the monitor control line G2 corresponding to the monitor row is set to the active state for a predetermined period from a beginning in the selection period, is set to the inactive state for a residual period of the selection period, and thereafter, is set to the active state again for a period until an end of substantially one frame period from a point of starting time of the selection period. In this embodiment, the gate driver 40 is configured so that the n pieces of scanning lines G1(1) to G1(n) and the n pieces of monitor control lines G2(1) to G2(n) are driven in such a manner as described above.

The source driver 30 is connected to the m pieces of data lines S(1) to S(m) and the m pieces of monitor lines M(1) to M(m). The source driver 30 is composed of: a drive signal generation circuit 31; a signal conversion circuit 32; and an output unit 33 including m pieces of output circuits 330. The m pieces of output circuits 330 in the output unit 33 are individually connected to the corresponding data lines S among the m pieces of data lines S(1) to S(m) and to the corresponding monitor lines M among the m pieces of monitor lines M(1) to M(m).

The drive signal generation circuit 31 includes a shift register, a sampling circuit and a latch circuit. In the drive signal generation circuit 31, the shift register sequentially transfers the source start pulse from an input end to an output end in synchronization with the source clock. In response to this transfer of the source start pulse, sampling pulses corresponding to the respective data lines S are outputted from the shift register. The sampling circuit sequentially stores such data signals DA, which are equivalent to one row, in accordance with timing of the sampling pulses. The latch circuit captures and holds the data signals DA for one row, which are stored in the sampling circuit, in response to the latch strobe signal.

Figure 6:
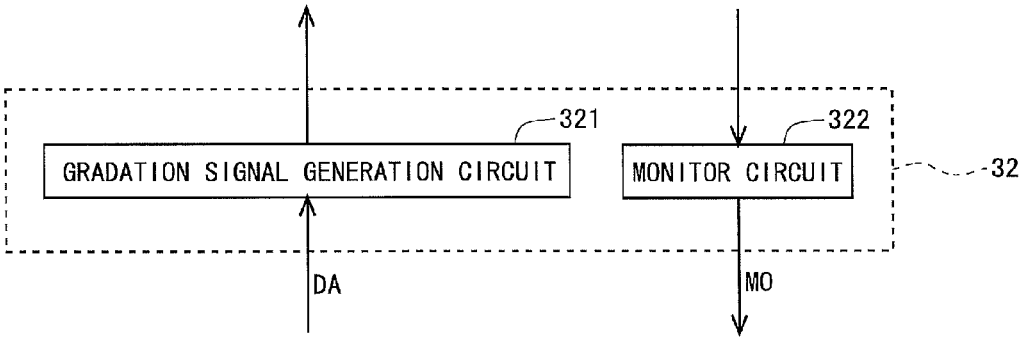
FIG. 6 is a block diagram showing a schematic configuration of a signal conversion circuit in the first embodiment.

FIG. 6 is a block diagram showing a schematic configuration of the signal conversion circuit 32. As shown in FIG. 6, the signal conversion circuit 32 is composed of a gradation signal generation circuit 321 and a monitor circuit 322. The gradation signal generation circuit 321 includes a D/A converter. The data signals DA for one row, which are held in the latch circuit in the drive signal generation circuit 31 as mentioned above, are converted into analog voltages by the D/A converter in the gradation signal generation circuit 321. The analog voltages thus converted are given to the output circuits 330 in the output unit 33. The monitor circuit 322 includes an A/D converter. In the A/D converter in the monitor circuit 322, analog voltages, which appear in the monitor lines M and represent the TFT characteristics and the OLED characteristics, and the analog voltages, which represent the magnitudes of the noise appeared in the monitor lines M, are converted into the monitor data MO as digital signals. The monitor data MO are given to the control circuit 20 via the drive signal generation circuit 31. Note that the monitor circuit 322 will be described later in detail.

The output circuits 330 in the output unit 33 apply the analog voltages, which are given from the gradation signal generation circuit 321 in the signal conversion circuit 32, as data voltages to the data lines S via buffers. Moreover, the output circuits 330 in the output unit 33 switch connection destinations of the monitor lines M based on the switching control signal SW. Note that this will be described later in detail.

The offset memory 51 and the gain memory 52 store correction data for use in correcting the video signal sent from the outside. Specifically, the offset memory 51 stores an offset value as the correction data, and the gain memory 52 stores a gain value as the correction data. Note that, typically, such offset values, the number of which is equal to the number of pixels in the display unit 10, and such gain values, the number of which is equal thereto, are stored in the offset memory 51 and the gain memory 52, respectively. Moreover, a buffer memory (hereinafter, referred to as an "offset value buffer") for temporarily holding the offset values and a buffer memory (hereinafter, referred to as a "gain value buffer memory") for temporarily holding the gain values are provided, for example, in the control circuit 20. Based on the monitor data MO given from the source driver 30, the control circuit 20 updates the offset values in the offset memory 51 and the gain values in the gain memory 52. Moreover, the control circuit 20 reads out the offset values stored in the offset memory 51 and the gain values stored in the gain memory 52, and thereby corrects the video signal. Data obtained by the correction is sent as the data signal DA to the source driver 30. Moreover, based on the monitor data MO as the noise data, the control circuit 20 controls operations of the gate driver 40 and the source driver 30, which are related to the detection of the TFT characteristics and the OLED characteristics.

<1.2 Configurations of Pixel Circuit and Monitor Circuit>

<1.2.1 Pixel Circuit>

Figure 7:
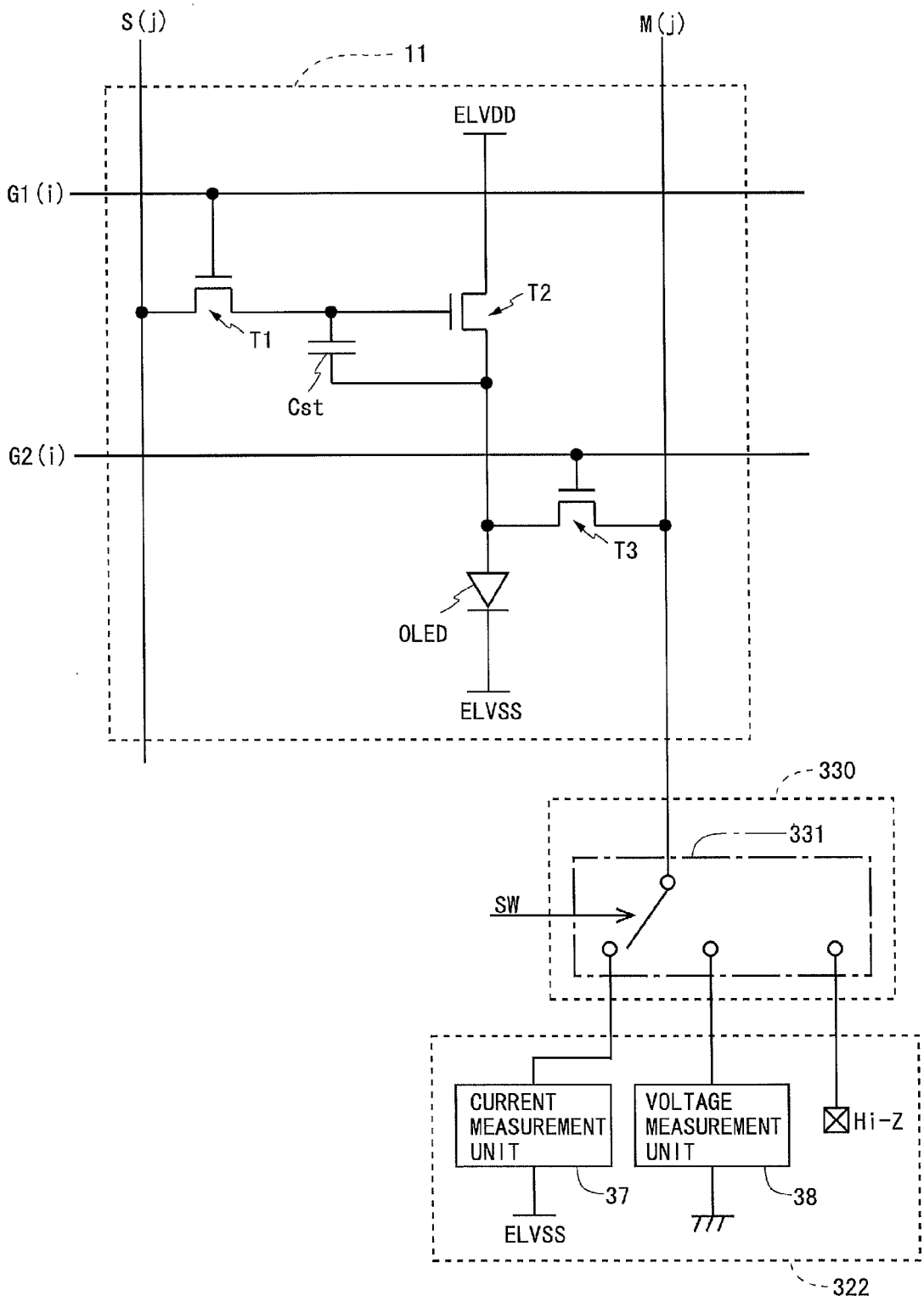
FIG. 7 is a diagram showing configurations of a pixel circuit and a monitor circuit in the first embodiment.

FIG. 7 is a diagram showing configurations of the pixel circuit 11 and the monitor circuit 322. Note that the pixel circuit 11 shown in FIG. 7 is the pixel circuit 11 on the i-th row and the j-th column. This pixel circuit 11 includes: one organic EL element OLED: three transistors T1 to T3; and one capacitor Cst. The transistor T1 functions as an input transistor that selects the pixel, the transistor T2 functions as a drive transistor that controls the supply of the current to the organic EL element OLED, and the transistor T3 functions as a monitor control transistor that controls whether or not to detect the TFT characteristics and the OLED characteristics.

The transistor T1 is provided between the data line S(j) and a gate terminal of the transistor T2. With regard to the transistor T1, a gate terminal thereof is connected to the scanning line G1(i), and a source terminal thereof is connected to the data line S(j). The transistor T2 is provided in series to the organic EL element OLED. With regard to the transistor T2, a gate terminal thereof is connected to a drain terminal of the transistor T1, a drain terminal thereof is connected to the high-level power supply line ELVDD, and a source terminal thereof is connected to the anode terminal of the organic EL element OLED. With regard to the transistor T3, agate terminal thereof is connected to the monitor control line G2(i), a drain terminal thereof is connected to the anode terminal of the organic EL element OLED, and a source terminal thereof is connected to the monitor line M(j). With regard to the capacitor Cst, one end thereof is connected to the gate terminal of the transistor T2, and other end thereof is connected to the source terminal of the transistor T2. A cathode terminal of the organic EL element OLED is connected to the low-level power supply line ELVSS.

<1.2.2. Regarding Transistors in Pixel Circuit>

In this embodiment, all of the transistors T1 to T3 in the pixel circuit 11 are of the n-channel type. Moreover, in this embodiment, for the transistors T1 to T3, oxide TFTs (thin film transistors using an oxide semiconductor for channel layers) are adopted.

A description is made below of an oxide semiconductor layer included in each of the oxide TFTs. The oxide semiconductor layer is, for example, an In—Ga—Zn—O-based semiconductor layer. The oxide semiconductor layer contains, for example, an In—Ga—Zn—O-based semiconductor. The In—Ga—Zn—O-based semiconductor is a ternary oxide of In (indium), Ga (gallium) and Zn (zinc). A ratio (composition ratio) of In, Ga and Zn is not particularly limited. For example, the composition ratio may be In:Ga:Zn=2:2:1, In:Ga:Zn=1:1:1, In:Ga:Zn=1:1:2, and the like.

Such a TFT including the In—Ga—Zn—O-based semiconductor layer has high mobility (mobility exceeding 20 times that of an amorphous silicon TFT) and a low leak current (leak current of less than 1/100 of that of the amorphous silicon TFT. Accordingly, this TFT is suitably used as a drive TFT (the above-described transistor T2) in the pixel circuit and a switching TFT (the above-described transistor T1) therein. When the TFT including the In—Ga—Zn—O-based semiconductor layer is used, electric power consumption of the display device can be reduced to a great extent.

The In—Ga—Zn—O-based semiconductor may be amorphous, or may include a crystalline portion and have crystallinity. As the crystalline In—Ga—Zn—O-based semiconductor, a crystalline In—Ga—Zn—O-based semiconductor, in which a c-axis is oriented substantially perpendicularly to a layer surface, is preferable. A crystal structure of the In—Ga—Zn—O-based semiconductor as described above is disclosed, for example, in Japanese Patent Application Laid-Open No. 2012-134475.

The oxide semiconductor layer may contain other oxide semiconductors in place of the In—Ga—Zn—O-based semiconductor. For example, the oxide semiconductor layer may contain a Zn—O-based semiconductor (ZnO), an In—Zn—O-based semiconductor (IZO (registered trademark)), a Zn—Ti—O-based oxide semiconductor (ZTO), a Cd—Ge—O-based semiconductor, a Cd—Pb—O-based semiconductor, a CdO (cadmium oxide), a Mg—Zn—O-based semiconductor, an In—Sn—O-based semiconductor (for example, $In_2O_3$—$SnO_2$—ZnO), an In—Ga—Sn—O-based semiconductor and the like.

<1.2.3 Monitor Circuit>

As shown in FIG. 7, the monitor circuit 322 includes a current measurement unit 37 and a voltage measurement unit 38. Note that, in this embodiment, a characteristic detection unit and a noise measurement unit are realized by this monitor circuit 322. In other words, the noise measurement unit shares the same circuit with the characteristic detection unit. A relationship of the current measurement unit 37 and the voltage measurement unit 38 with the monitor line M(j) is controlled based on the switching control signal SW given from the control circuit 20 to the output circuit 330. Based on the switching control signal SW, a switch (hereinafter, referred to as a "monitor line switch") 331 provided in the output circuit 330 turns the monitor line M(j) to a state of being connected to the current measurement unit 37, or to a state of being connected to the voltage measurement unit 38, or to a state of high impedance. Note that FIG. 7 shows only a partial configuration of the output circuit 330.

Figure 8:
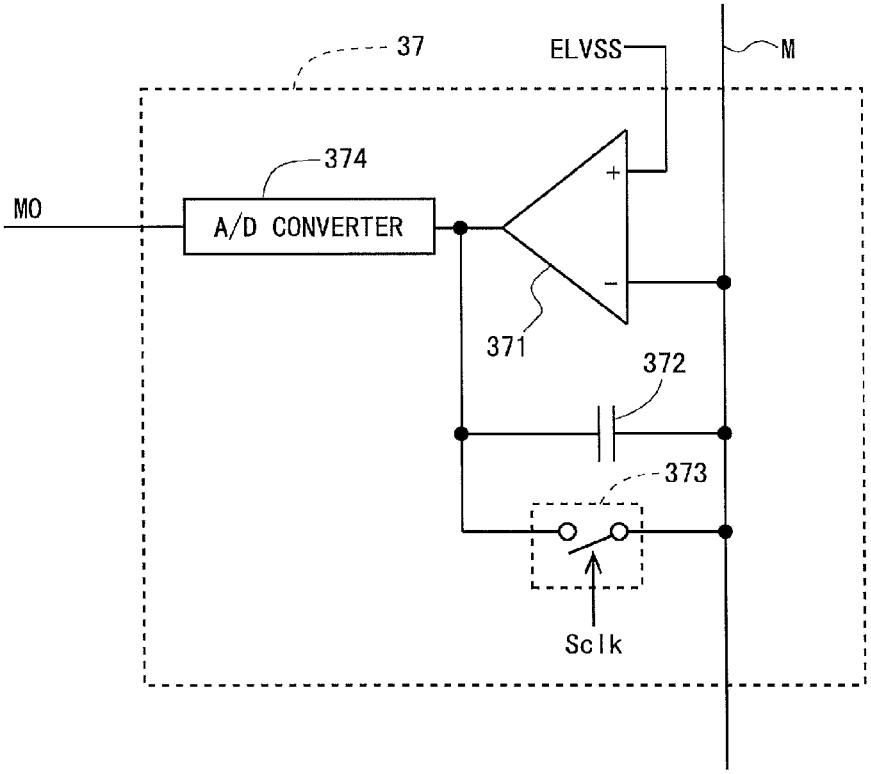
FIG. 8 is a diagram showing a configuration example of a current measurement unit in the first embodiment.

FIG. 8 is a diagram showing a configuration example of the current measurement unit 37. This current measurement unit 37 includes an operational amplifier 371, a capacitor 372, a switch 373 and an A/D converter 374. With regard to the operational amplifier 371, a non-inverting input terminal thereof is connected to the low-level power supply line ELVSS, and an inverting input terminal thereof is connected to the monitor line M. The capacitor 372 and the switch 373 are provided between an output terminal of the operational amplifier 371 and the monitor line M. As described above, this current measurement unit 37 is composed of an integrating circuit. In such a configuration, when the switch 373 is turned to an ON state by a control clock signal Sclk, an output terminal of the operational amplifier 371 and the inverting input terminal thereof turn to a short circuit state. In such a way, potentials of the output terminal of the operational amplifier 371 and of the monitor line M become equal to a potential of the low-level power supply line ELVSS. In an event where the current is detected, the switch 373 is switched from the ON state to the OFF state by the control clock signal Sclk. Thus, due to the presence of the capacitor 372, the potential of the output terminal of the operational amplifier 371 changes in response to a magnitude of the current flowing through the monitor line M. Such a change of the potential is reflected onto the digital signal outputted from the A/D converter 374. Then, the digital signal is outputted as the monitor data MO from the current measurement unit 37. In this embodiment, a current for obtaining the TFT characteristics and a noise current generated in the monitor line M in the noise measurement period to be described later are measured by this current measurement unit 37. Data indicating a magnitude of the noise current measured by the current measurement unit 37 is sent as noise data to the control circuit 20.

Figure 9:
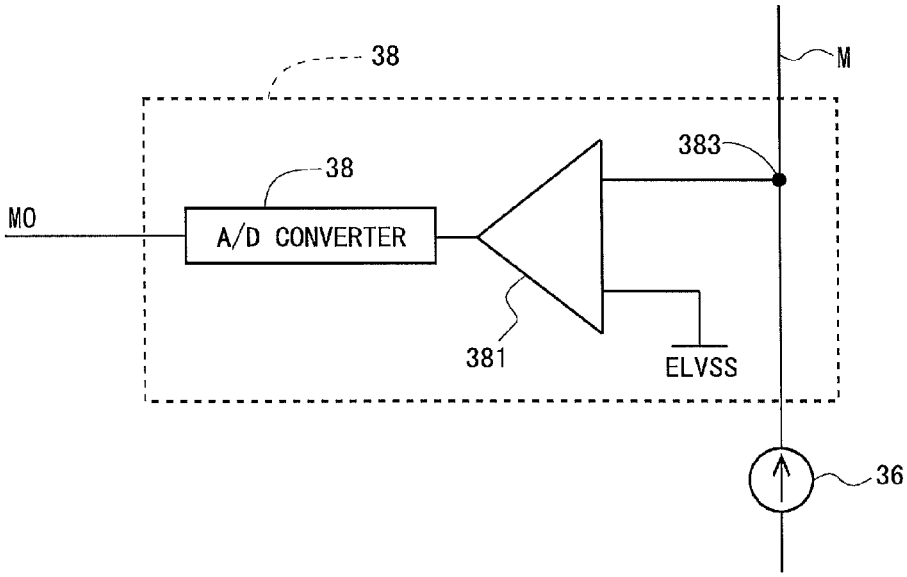
FIG. 9 is a diagram showing a configuration example of a voltage measurement unit in the first embodiment.

FIG. 9 is a diagram showing a configuration example of the voltage measurement unit 38. This voltage measurement unit 38 includes an amplifier 381 and an A/D converter 382. In such a configuration, in a state where a constant current is flown through the monitor line M by a constant current supply 36, a voltage between a node 383 and the low-level power supply line ELVSS is amplified by the amplifier 381. Then, the already amplified voltage is converted into a digital signal by the A/D converter 382. The digital signal is outputted as the monitor data MO from the voltage measurement unit 38. In this embodiment, a voltage for obtaining the OLED characteristics is measured by this voltage measurement unit 38.

<1.3 Drive Method>

<1.3.1 Outline>

Next, a description is made of a drive method in this embodiment. As mentioned above, in this description, the row in which the selection period longer than usual is provided when focusing on any frame is referred to as the "monitor row". Moreover, in this embodiment, Q pieces of columns (Q is an integer of 1 or more to m or less) in the monitor row become detection targets of the TFT characteristics and the OLED characteristics. In this description, the column as the detection target of the TFT characteristics and the OLED characteristics is referred to as a "monitor column", and columns other than the monitor columns are referred to as "non-monitor columns".

Figures 10, 11:
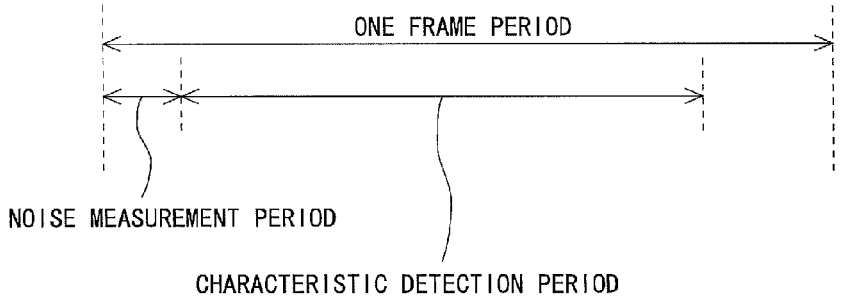
FIG. 10 is a table for explaining a transition of the operations in respective rows in the first embodiment.
FIG. 11 is a view for explaining a relationship between a noise measurement period and a characteristic detection period in the first embodiment.

As mentioned above, in this embodiment, the detection of the TFT characteristics and the OLED characteristics is performed for one row in each of frames. In each frame, an operation for performing the detection of the TFT characteristics and the OLED characteristics (hereinafter, referred to as a "characteristic detection operation") is performed for the monitor row, and a usual operation is performed for the non-monitor row. That is to say, when the frame in which the detection of the TFT characteristics and the OLED characteristics for the first row is performed is defined as the (k+1)-th frame, then the operations in the respective rows change as shown in FIG. 10. However, as mentioned above, the characteristic detection operation is not performed in the column in which the noise with the standard value or more is detected. Moreover, when the detection of the TFT characteristics and the OLED characteristics is performed, the update of the offset memory 51 and the gain memory 52 is performed by using a detection result thereof. Then, the correction of the video signal is performed by using the correction data stored in the offset memory 51 and the gain memory 52.

Figure 1:
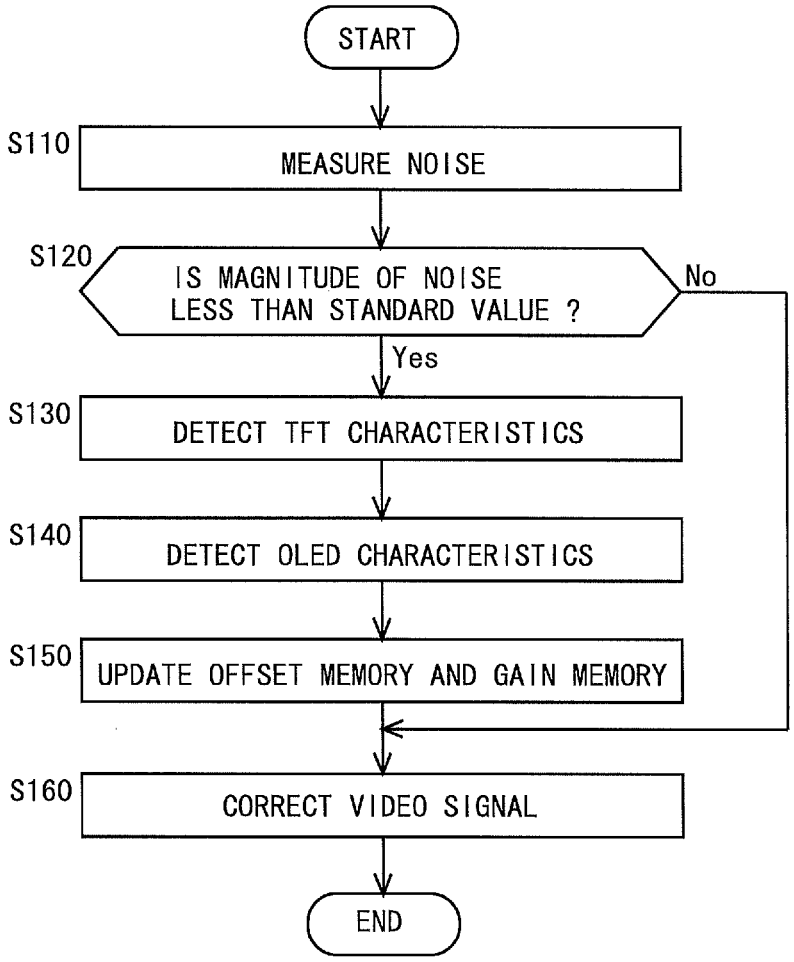
FIG. 1 is a flowchart for explaining an outline of a drive method when focusing on a monitor column in a monitor row in a first embodiment of the present invention.

FIG. 1 is a flowchart for explaining an outline of a drive method when focusing on the monitor column in the monitor row in this embodiment. At a beginning of the frame period, the noise generated in the monitor line M is measured (Step S110). Next, it is determined whether or not the magnitude of the noise measured in Step S110 is less than the standard value (Step S120). As a result, the processing proceeds to Step S130 when the magnitude of the noise is less than the standard value as a result, and the processing proceeds to Step S160 when the magnitude of the noise is the standard value or more. That is to say, if the magnitude of the noise is less than the standard value, then the processing of Step S160 is performed after the processing of Step S130, Step S140 and Step S150 is performed, and if the magnitude of the noise is the standard value or more, the processing of Step S160 is performed without performing the processing of Step S130, Step S140 and Step S150.

In Step S130, the TFT characteristics are detected. In Step S140, the OLED characteristics are detected. In Step S150, the offset memory 51 and the gain memory 52 are updated by using a detection result in Step S130 and a detection result in Step S140. In Step S160, the video signal sent from the outside is corrected by using the correction data stored in the offset memory 51 and the gain memory 52.

In this embodiment, a noise measurement step is realized by Step S110, a characteristic detection step is realized by Step S130 and Step S140, a correction data update step is realized by Step S150, and a video signal correction step is realized by Step S160. Moreover, a first characteristic detection step is realized by Step S130, and a second characteristic detection step is realized by Step S140.

Note that, in order to realize such drives as described above, the pixel circuit drive unit (source driver 30 and gate driver 40) drive the n×m pieces of pixel circuits 11 while performing the processing for detecting at least one of the characteristics of the transistor T2 and the characteristics of the organic EL element OLED. Moreover, the control unit (control circuit 20) controls the operations of the pixel circuit drive unit (source driver 30 and gate driver 40) while performing the processing for updating the correction data, which are stored in the offset memory 51 and the gain memory 52, based on the result of the characteristic detection, and performing the processing for correcting the video signal, which is to be supplied to the n×m pieces of pixel circuits 11, based on the correction data stored in the offset memory 51 and the gain memory 52.

<1.3.2 Relationships among Noise Measurement, Characteristic Detection, and Correction Data Update Processing>

Next, a description is made of a relationship among the noise measurement, the characteristic detection (detection of the TFT characteristics and the OLED characteristics), and correction data update processing (processing for updating the offset memory 51 and the gain memory 52 by using the result of the characteristic detection). In this embodiment, when the monitor row is focused on, then as shown in FIG. 11, the noise measurement period is provided at the beginning of one frame period, and a characteristic detection period is provided after the noise measurement period. In the noise measurement period, the noise generated in the monitor line M is measured. In the characteristic detection period, the above-mentioned characteristic detection operation is performed in the monitor row.

Figure 12:
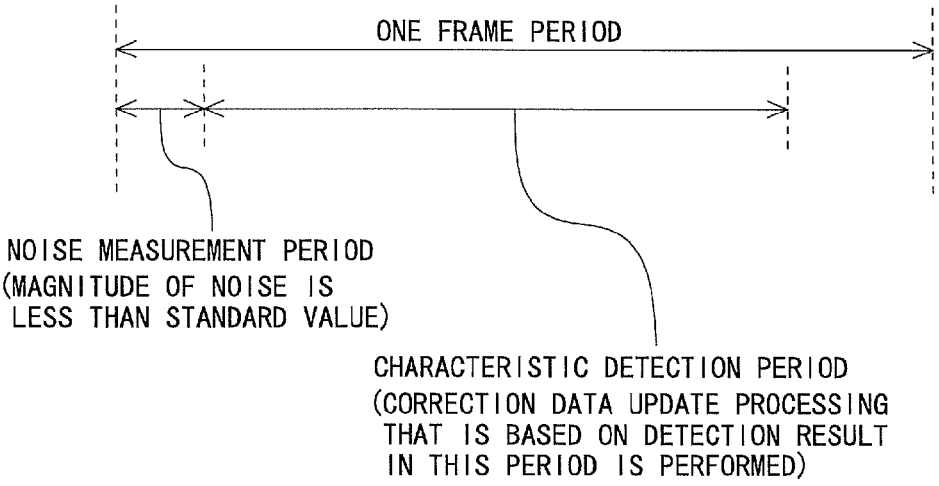
FIG. 12 is a view for explaining a condition where correction data update processing that is based on a result of characteristic detection in a certain frame is performed in the first embodiment.

FIG. 12 is a view for explaining a condition where the correction data update processing that is based on a result of the characteristic detection in a certain frame (here referred to as an "object frame") is performed. In this embodiment, as shown in FIG. 12, when the magnitude of the noise detected in the noise measurement period of the object frame is less than the standard value, the correction data update processing that is based on the result of the characteristic detection in the object frame is performed. That is to say, in this embodiment, results of the noise measurement in frames before and after the object frame do not affect the correction data update processing that is based on the result of the characteristic detection in the object frame.

Figure 13:
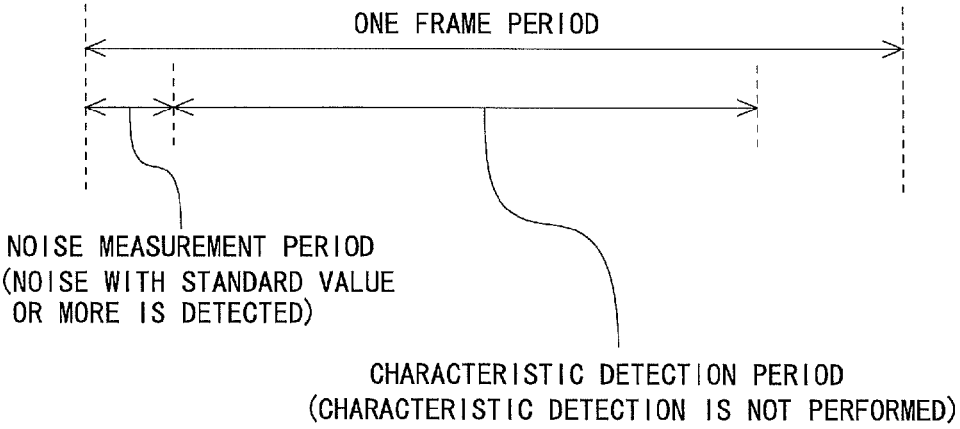
FIG. 13 is a view for explaining an operation when noise with a standard value or more is detected in the first embodiment.

FIG. 13 is a view for explaining an operation when the noise with the standard value or more is detected in this embodiment. In this embodiment, with regard to the monitor column, as shown in FIG. 13, when the noise with the standard value or more is detected in the noise measurement period of the object frame, the characteristic detection is not performed in the object frame (also refer to FIG. 1).

<1.3.3 Operations of Pixel Circuit and Monitor Circuit>

<1.3.3.1 Usual Operation>

Figure 14:
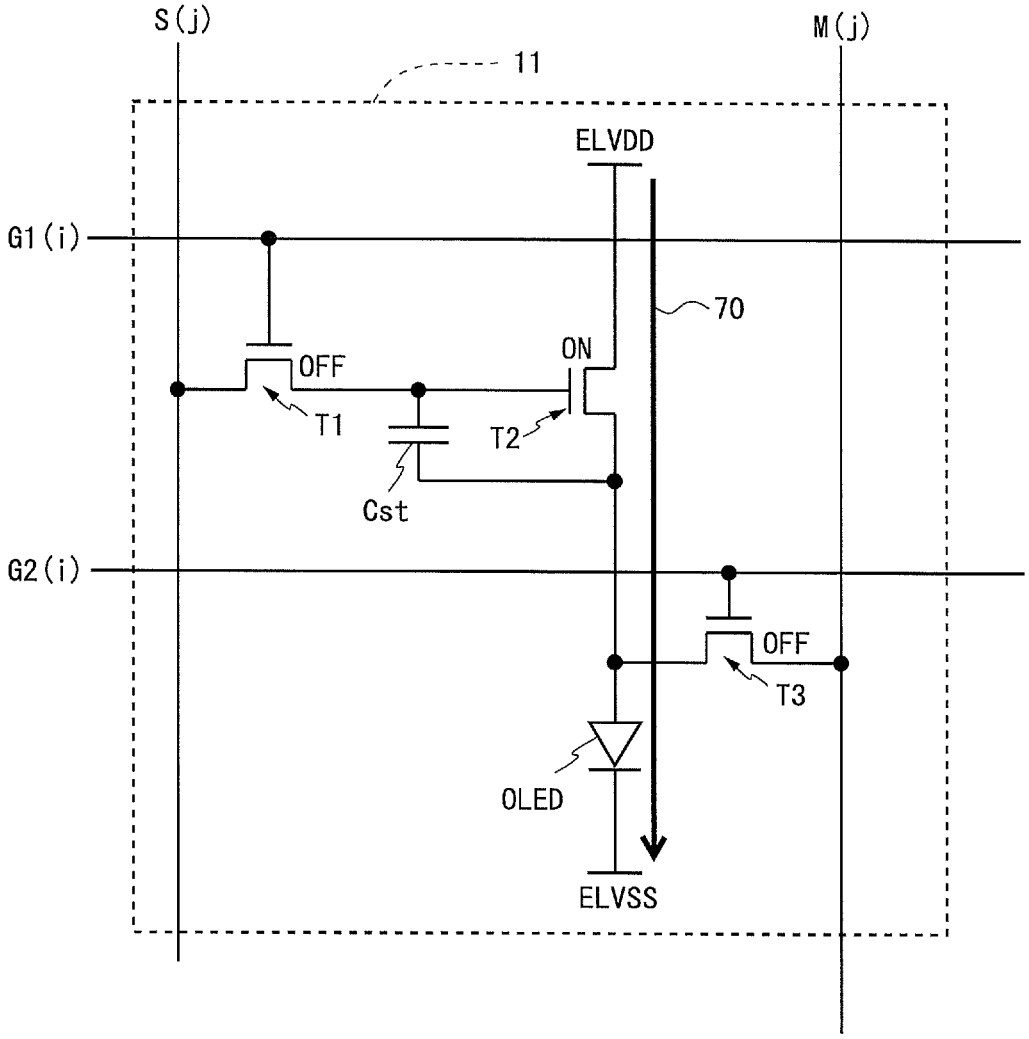
FIG. 14 is a diagram for explaining a flow of a current in an event where a usual operation is performed in the first embodiment.

In each frame, the usual operation is performed in the non-monitor row. In the pixel circuit 11 included in the non-monitor row, after writing that is based on the data voltage corresponding to the target brightness is performed in the selection period, the transistor T1 is maintained in the OFF state. The transistor T2 becomes the ON state by the writing that is based on the data voltage. The transistor T3 is maintained in the OFF state. Accordingly, as shown by an arrow denoted by reference numeral 70 in FIG. 14, a drive current is supplied to the organic EL element OLED via the transistor T2. In such a way, the organic EL element OLED emits light with brightness in accordance with the drive current.

<1.3.3.2 Measurement of Noise and Characteristic Detection Operation>

In each frame the noise generated in the monitor line M is measured immediately before the characteristic detection operation is performed in the monitor row. Then, in this embodiment, the characteristic detection operation is performed only in the monitor column in which the magnitude of the noise is less than the standard value.

Figure 15:
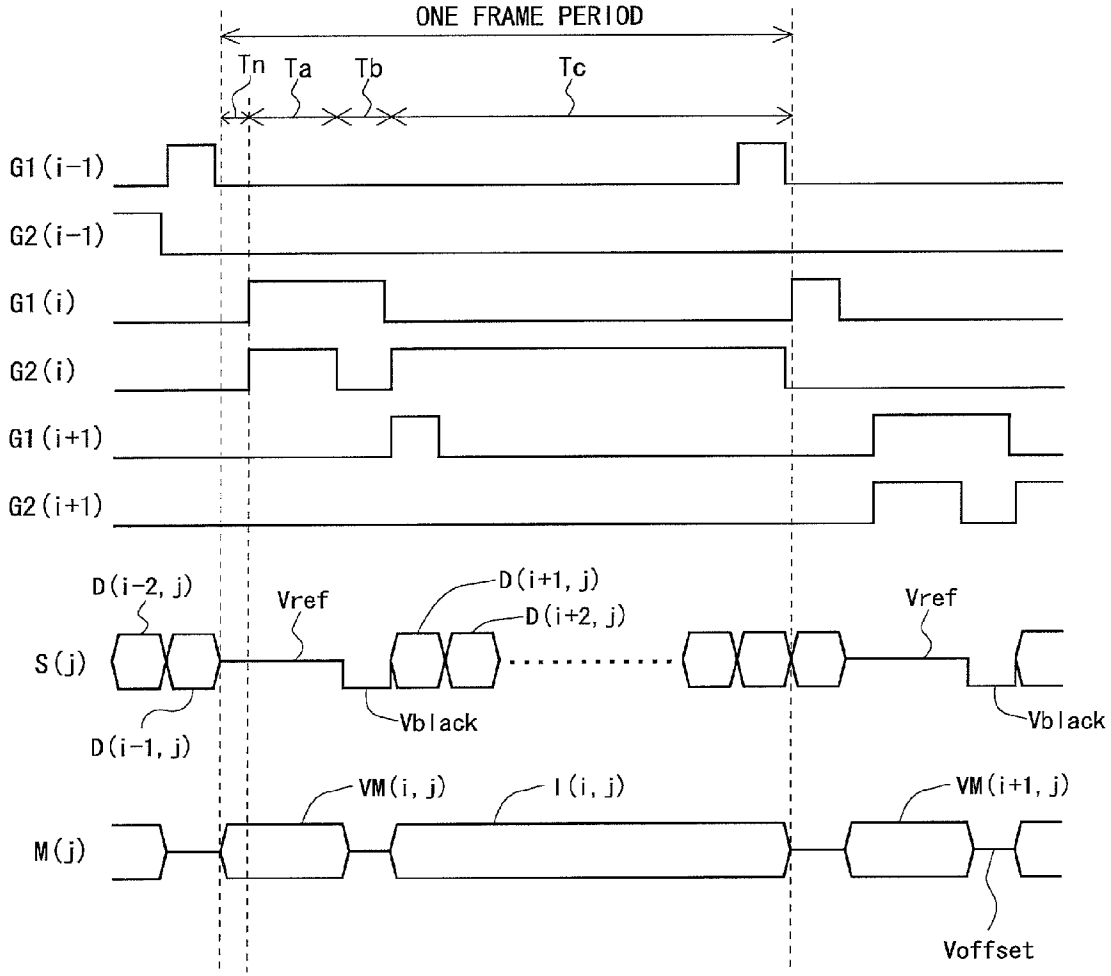
FIG. 15 is a timing chart for explaining operations of a pixel circuit (defined to be a pixel circuit on an i-th row and a j-th column) included in a monitor column in a monitor row (in a case where a magnitude of the noise detected in the noise measurement period is less than the standard value).
Figure 16:
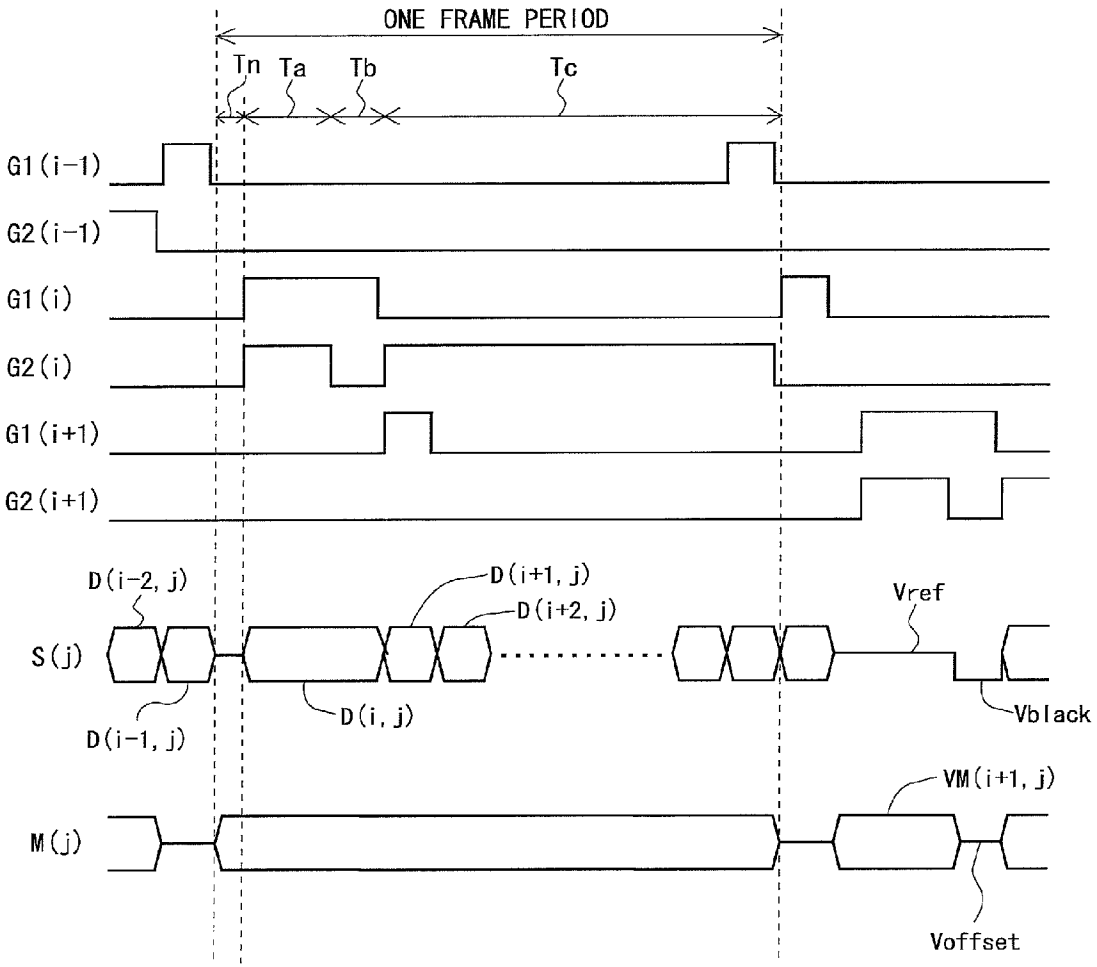
FIG. 16 is a timing chart for explaining operations of the pixel circuit (defined to be the pixel circuit on the i-th row and the j-th column) included in the monitor column in the monitor row (in a case where the magnitude of the noise detected in the noise measurement period is the standard value or more).

FIG. 15 and FIG. 16 are timing charts for explaining operations of the pixel circuit 11 (defined to be the pixel circuit 11 on the i-th row and the j-th column) included in the monitor column in the monitor row. In FIG. 15 and FIG. 16, the "one frame period" is shown while taking, as a reference, a starting point of time of the noise measurement period Tn in the frame in which the i-th row is defined as the monitor row. Note that FIG. 15 is a timing chart in a case where the magnitude of the noise detected in the noise measurement period Tn is less than the standard value, and FIG. 16 is a timing chart in a case where the magnitude of the noise detected in the noise measurement period Tn is the standard value or more.

With regard to the monitor row, as shown in FIG. 15 and FIG. 16, one frame period includes: the noise measurement period Tn; a period (hereinafter, referred to as a "TFT characteristic detection period") Ta for detecting the TFT characteristics; a period (hereinafter, referred to as a "black writing period") Tb for writing data equivalent to black display; and a period (hereinafter, referred to as a "light emission period") Tc for allowing the organic EL element OLED to emit light. A first predetermined period in the selection period is the TFT characteristic detection period Ta, and a period other than the TFT characteristic detection period Ta in the selection period is the black writing period Tb.

Figure 17:
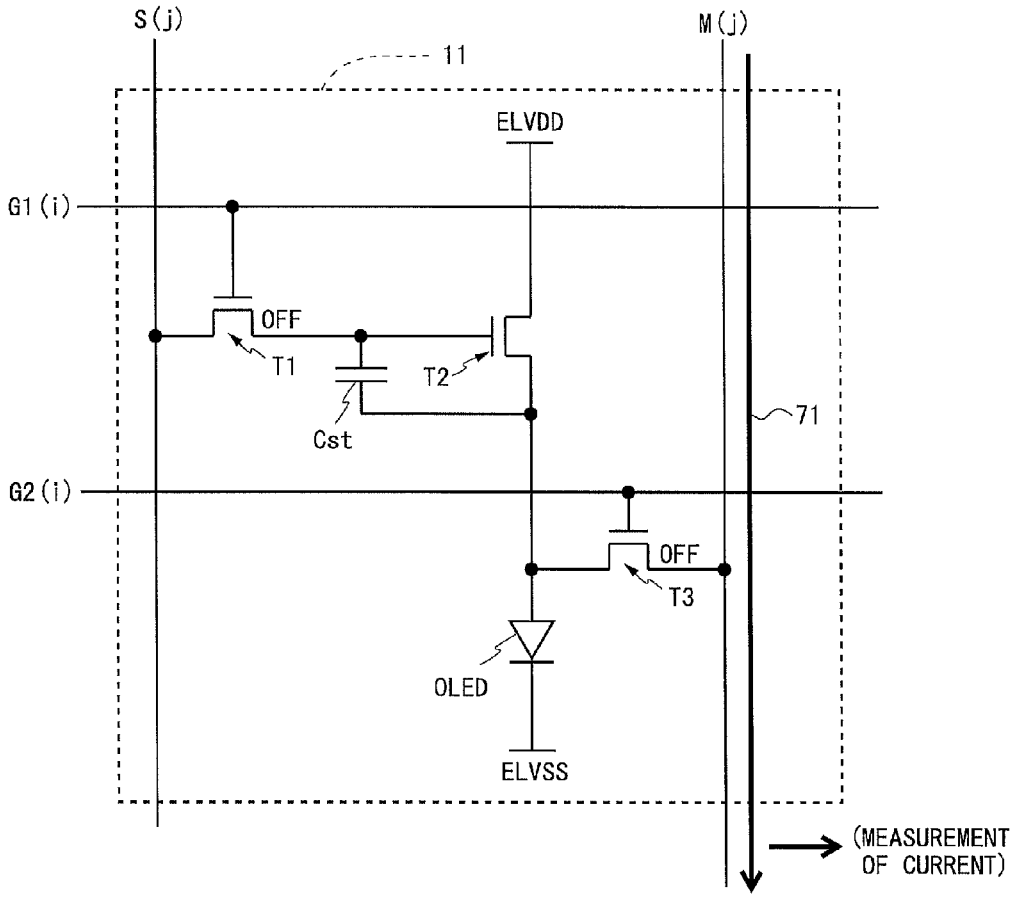
FIG. 17 is a diagram for explaining a flow of the current in the noise measurement period in the first embodiment.

In the noise measurement period Tn, all of the scanning lines G1(1) to G1(n) and all of the monitor control lines G2(1) to G2(n) are maintained in the inactive state. Therefore, in all of the rows, the transistors T1 and the transistors T3 are maintained in the OFF state. The transistors T3 become the OFF state in all of the rows as described above, and accordingly, the respective monitor lines M become a state of being electrically separated from the organic EL elements OLED and the transistors T2, and become a high-impedance state in the display unit 10. Hence, when there is a disturbance in the noise measurement period Tn, a noise component appears in the monitor line M(j) as shown by an arrow 71 in FIG. 17. In the embodiment, a magnitude of this noise component is measured by the monitor circuit 322. In order to realize this, in the noise measurement period Tn, the monitor line M(j) of the monitor column is connected to the current measurement unit 37 by the switching control signal SW. Moreover, in the noise measurement period Tn, in the current measurement unit 37, the switch 373 is switched from the ON state to the OFF state after the switch 373 becomes the ON state to discharge the electric charges accumulated in the capacitor 372. In such a way, in the noise measurement period Tn, the magnitude of the noise current generated in the monitor line M(j) is measured by the current measurement unit 37.

In the TFT characteristic detection period Ta, the scanning line G1(i) and the monitor control line G2(i) are set to the active state (refer to FIG. 15 and FIG. 16). Thus, the transistor T1 and the transistor T3 becomes the ON state.

Figure 18:
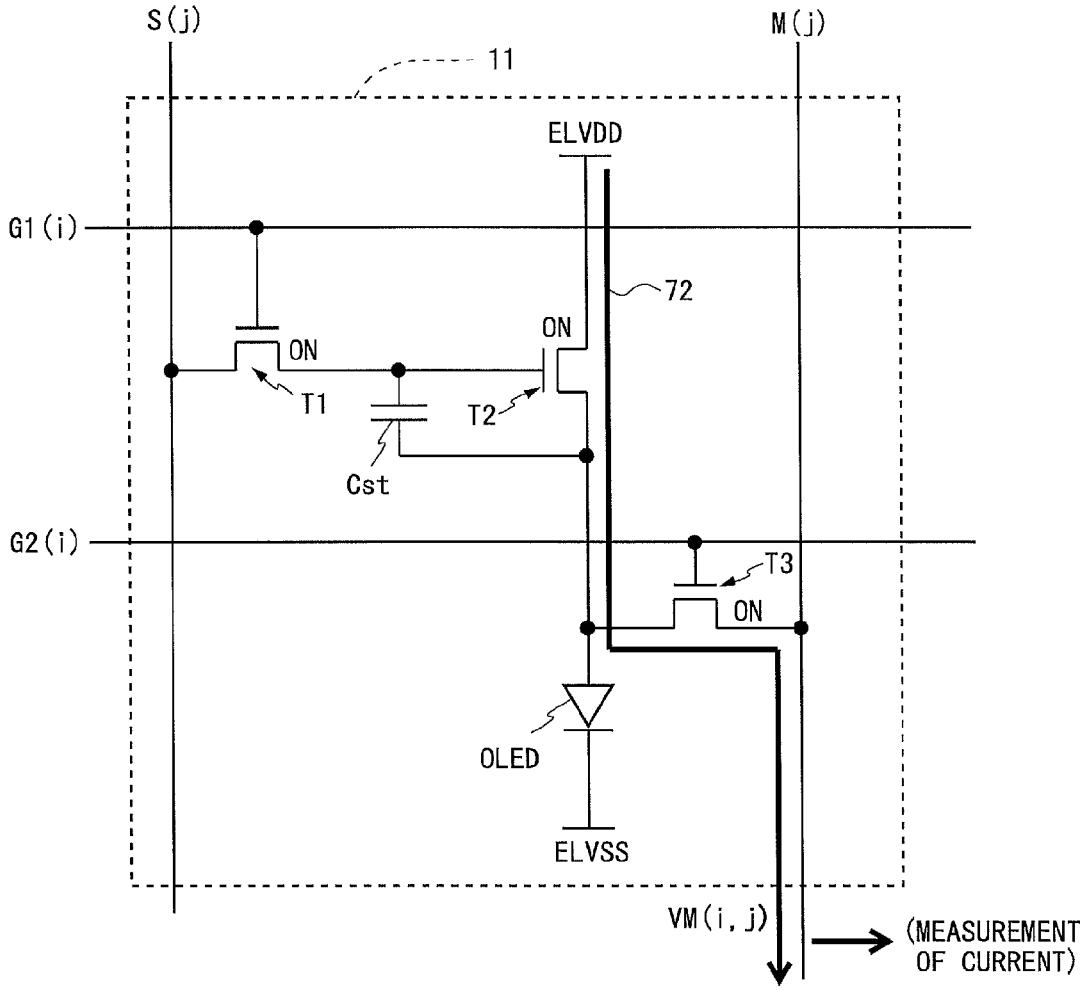
FIG. 18 is a diagram for explaining a flow of the current in a TFT characteristic detection period in the first embodiment.

Moreover, when the noise detected in the noise measurement period Tn is less than the standard value, a reference voltage Vref for detecting the TFT characteristics is applied to the data line S(j) in the TFT characteristic detection period Ta (refer to FIG. 15). Thus, the writing of the reference voltage Vref is performed, and the transistor T2 also becomes the ON state. As a result, as shown by an arrow denoted by reference numeral 72 in FIG. 18, the current flowing through the transistor T2 is outputted to the monitor line M(j) via the transistor T3. Moreover, in the TFT characteristic detection period Ta, the monitor line M(j) is connected to the current measurement unit 37 by the switching control signal SW. Accordingly, the current (sink current) outputted to the monitor line M(j) is measured by the current measurement unit 37. In such a manner as described above, a magnitude of the current flowing between the drain and source of the transistor T2 is measured in a state where the voltage between the gate and source of the transistor T2 is set to a predetermined magnitude (magnitude of the reference voltage Vref), and the TFT characteristics are detected.

Figure 19:
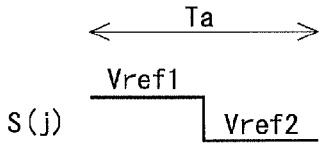
FIG. 19 is a view for explaining application of a reference voltage to a data line in the TFT characteristic detection period in the first embodiment.

Incidentally, in this embodiment, as shown in FIG. 19, two types of reference voltages (first reference voltage Vref1 and second reference voltage Vref2) are applied as the reference voltage Vref to the data line S(j) in the TFT characteristic detection period Ta. Accordingly, TFT characteristics which are based on the first reference voltage Vref1 and TFT characteristics which are based on the second reference voltage Vref2 are detected.

Incidentally, when the noise detected in the noise measurement period Tn has a magnitude of the standard value or more, a data voltage D(i,j) corresponding to the target brightness is applied to the data line S(j) in the TFT characteristic detection period Ta (refer to FIG. 16). In such a way, writing of the data voltage D(i,j) is performed, and the transistor T2 becomes the ON state. Note that, after the writing that is based on the data voltage D(i,j) is performed in the selection period (period including the TFT characteristic detection period Ta and the black writing period Tb), the scanning line G1(i) becomes the inactive state, and the transistor T1 is maintained in the OFF state. Thus, in a case where the noise detected in the noise measurement period Tn has the magnitude of the standard value or more, in a similar way to the usual operation, the drive current in accordance with the data voltage D(i,j) is supplied to the organic EL element OLED, and the organic EL element OLED emits light at brightness in accordance with the drive current.

In the black writing period Tb, the scanning line G1(i) is maintained in the active state, and the monitor control line G2(i) is set to the inactive state (refer to FIG. 15). Thus, the transistor T1 is maintained in the ON state, and the transistor T3 becomes the OFF state. Moreover, when the magnitude of the noise detected in the noise measurement period Tn is less than the standard value, in the black writing period Tb, a voltage Vblack equivalent to the black display is applied to the data line S(j) (refer to FIG. 15), and accordingly, the transistor T2 becomes the OFF state. Accordingly, the current does not flow through the transistor T2. Note that, preferably, the monitor line M(j) is applied with a voltage being the sum of "a difference between the offset value stored in the offset memory 51 and the offset value obtained in the TFT characteristic detection period Ta" and "a voltage corresponding to a light emission voltage calculated from the gain value stored in the gain memory 52 and the gain value obtained in the TFT characteristic detection period Ta" in the black writing period Tb. In such a way, a voltage in accordance with a degree of the deterioration of the organic EL element OLED is applied to the monitor line M(j) before the light emission period Tc, and a length of a charging time in the light emission period Tc is shortened.

Figure 20:
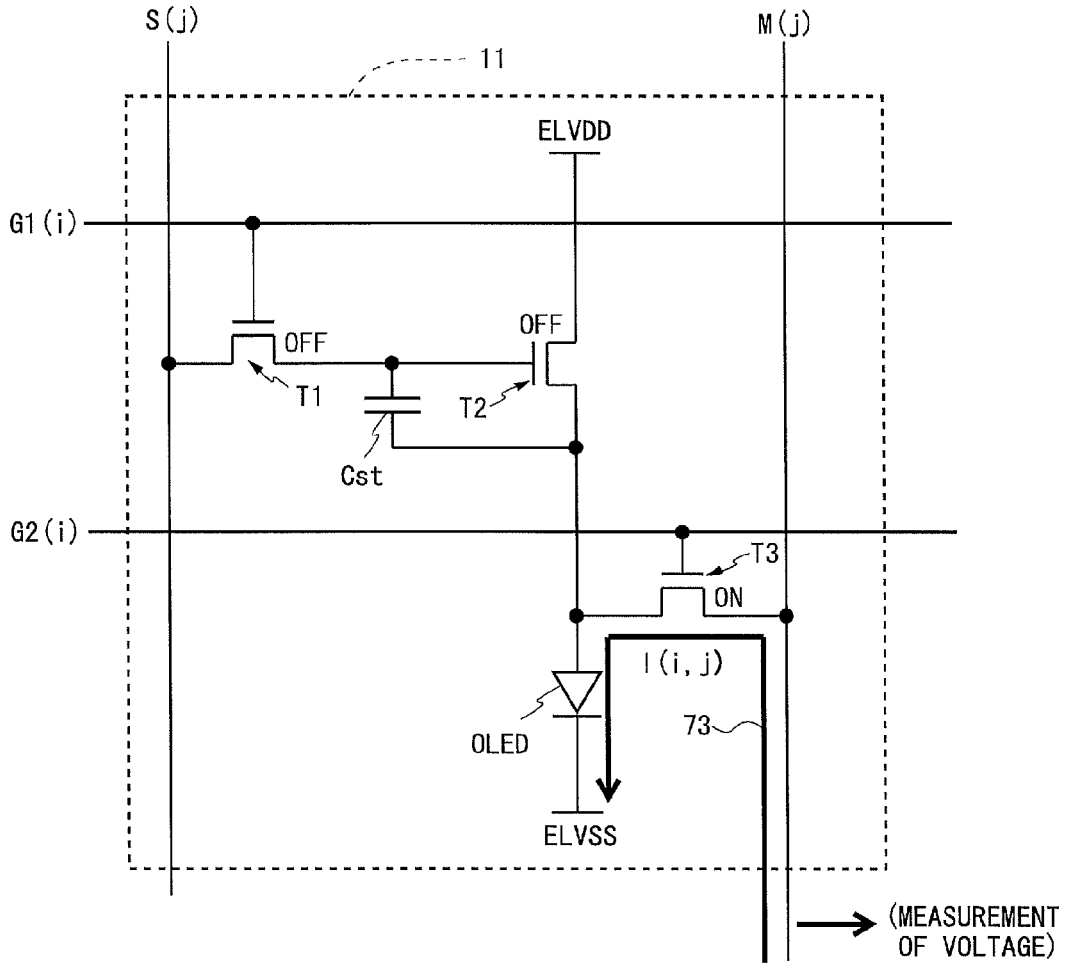
FIG. 20 is a diagram for explaining a flow of the current in a light emission period in the first embodiment.

In the light emission period Tc, the scanning line G1(i) is set to the inactive state, and the monitor control line G2(i) is set to the active state (refer to FIG. 15). Here, when the magnitude of the noise detected in the noise measurement period Tn is less than the standard value, the writing that is based on the voltage Vblack equivalent to the black display is performed in the black writing period Tb before the light emission period Tc, and accordingly, the transistor T2 is in the OFF state. Moreover, when the magnitude of the noise detected in the noise measurement period Tn is less than the standard value, in a period for detecting the OLED characteristics in the light emission period Tc, the monitor line M(j) is connected to the voltage measurement unit 38, and a constant current I(i,j) is supplied to the monitor line M(j). Accordingly, as shown by an arrow denoted by reference numeral 73 in FIG. 20, a data current that is a constant current is supplied from the monitor line M(j) to the organic EL element OLED. In this state, the light emission voltage of the organic EL element OLED is measured by the voltage measurement unit 38. As described above, the voltage of the anode of the organic EL element OLED is measured in a state where a constant current is given to the organic EL element OLED, whereby the OLED characteristics are detected.

Figure 21:
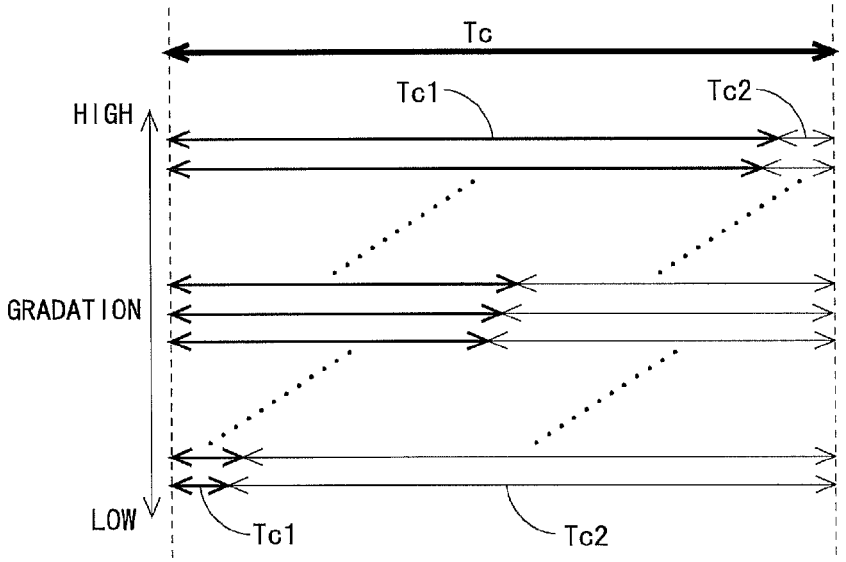
FIG. 21 is a view for explaining adjustment of a light emission time of an organic EL element in the first embodiment.

Incidentally, the data current supplied to the organic EL element OLED in the light emission period is a constant current. Therefore, in this embodiment, in order to perform desired gradation display, a length of a time in which the organic EL element OLED emits light is adjusted. For example, the above-described constant current is defined to be a current equivalent to white display, a light emission time is lengthened as the gradation is higher, and the light emission time is shortened as the gradation is lower. In order to realize this, for example, as shown in FIG. 21, a period Tc1 in which the monitor line M is connected to the voltage measurement unit 38 is lengthened as the gradation is higher, and a period Tc2 in which the monitor line M is connected to the current measurement unit 37 (alternatively, a period in which the monitor line M is set to the high-impedance state) is lengthened as the gradation is lower. In this regard, lengths of the above-described periods Tc1 and Tc2 are adjusted based on a deterioration correction coefficient obtained from a difference between the gain value stored in the gain memory 52 and the gain value obtained in the TFT characteristic detection period Ta. As described above, the length of the time in which the organic EL element OLED emits light is adjusted so that an integrated value of a light emission current in one frame period corresponds to a value equivalent a desired gradation. In other words, a length of the time in which a constant current is given to the organic EL element OLED is adjusted in response to the target brightness. Note that, as long as the integrated value of the light emission current in one frame period becomes the value equivalent to the desired gradation, then a current value may be changed in the light emission period Tc, and characteristics (current-voltage characteristics) at a plurality of operation points may be measured. Moreover, the configuration may be such that the length of the time in which the organic EL element OLED emits light is made constant, and that the current value is changed in response to the gradation. In this case, it is recommended that the magnitude of the current supplied to the monitor line M be obtained based on the deterioration correction coefficient obtained from the difference between the gain value stored in the gain memory 52 and the gain value obtained in the TFT characteristic detection period Ta. Note that, since the gain value, which is obtained by considering both of the TFT characteristics and the OLED characteristics, is stored in the gain memory 52, the difference between the gain value stored in the gain memory 52 and the gain value obtained in the TFT characteristic detection period Ta becomes a value representing the OLED characteristics.

Figure 22:
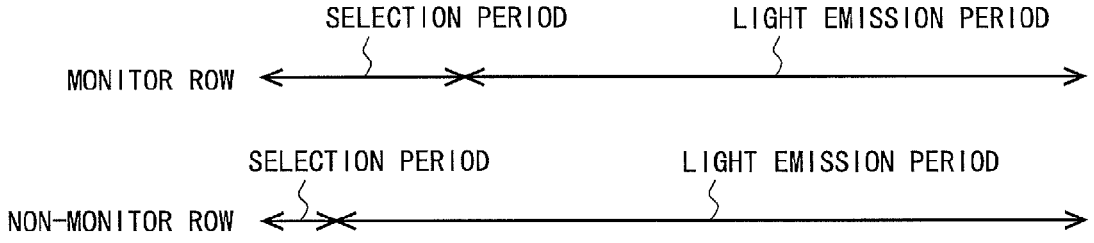
FIG. 22 is a view for explaining a length difference in light emission period between the monitor row and a non-monitor row in the first embodiment.

Moreover, in this embodiment, as shown in FIG. 22, a length of the selection period is longer in the monitor row than in the non-monitor row. Hence, the length of the light emission period differs between the monitor row and the non-monitor row. Therefore, the data current is adjusted so that the integrated value of the light emission current in one frame period corresponds to the value equivalent to the desired gradation.

Note that, when a gradation taken as a target is the gradation corresponding to the black display or a gradation close thereto, then preferably, the OLED characteristics are not detected. Hence, in this embodiment, regarding pixels on which the black display or substantially black display is performed (that is, pixels in which low-gradation display is performed) in the pixel matrix with n rows and m columns, the OLED characteristics are not detected. In such a way, unnecessary light emission can be prevented. The organic EL element is not deteriorated unless emitting light, and accordingly, it is not necessary to detect the characteristics thereof.

<1.3.4 Control Algorithm>

Figure 23:
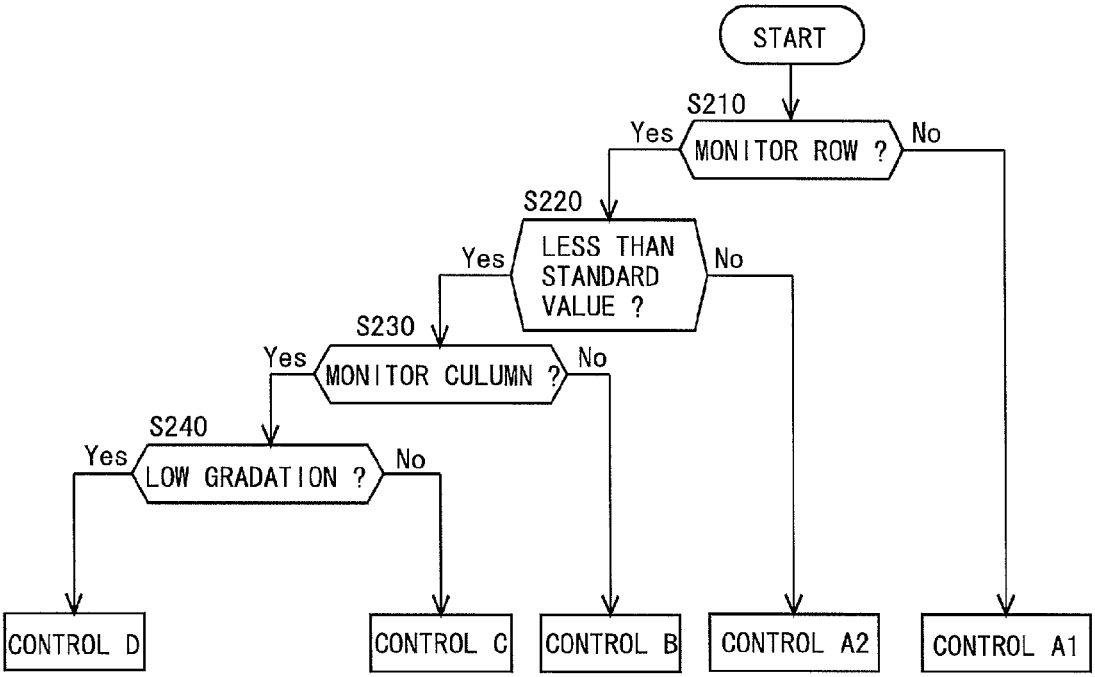
FIG. 23 is a flowchart for explaining a control algorithm in the first embodiment.

Next, a description is made of a control algorithm in this embodiment. FIG. 23 is a flowchart for explaining the control algorithm. FIG. 24 is a table for explaining the respective controls. Based on this control algorithm, the control circuit 20 controls the operations of the source driver 30 and the gate driver 40. First, while referring to FIG. 23, a description is made of a determination procedure of a control method for the data to be processed (data indicating the rows, the columns and the gradations) (hereinafter, referred to as "object data").

First, in Step S210, it is determined whether or not the object data is the data of the monitor row. Unless the object data is the data of the monitor row, then the control method for the object data becomes "Control A1". If the object data is the data of the monitor row, then a determination in Step S220 is further performed. In Step S220, it is determined whether or not the magnitude of the noise detected in the noise measurement period Tn is less than the standard value. If the magnitude of the noise is the standard value or more, then the control method for the object data becomes "Control A2". If the magnitude of the noise is less than the standard value, then a determination in Step S230 is further performed. In Step S230, it is determined whether or not the object data is the data of the monitor column. Unless the object data is the data of the monitor column, then the control method for the object data becomes "Control B". If the object data is the data of the monitor column, then a determination in Step S240 is further performed. In Step S240, it is determined whether or not the object data is the low-gradation data (gradation data in which black is displayed or gradation data in which substantially black display is performed). Unless the object data is the low-gradation data, then the control method for the object data becomes "Control C". If the object data is the low-gradation data, then the control method for the object data becomes "Control D". While referring to FIG. 24, a description is made below of "Control A1", "Control A2", "Control B", "Control C" and "Control D".

<1.3.4.1 "Control A1">

"Control A1" is a control method for the data of the non-monitor row. Since it is not necessary to perform the characteristic detection, the scanning line G1(i) is set to the active state (high-level state) for only a usual one horizontal scanning period, and the monitor control line G2(i) is maintained in a previous state. Moreover, since it is sufficient to perform the usual display, a data voltage corresponding to usual gradation data is applied to the data line S(j). With regard to a state of the monitor line switch 331 after the noise measurement, the previous state is maintained. Since the characteristic detection is not performed, the correction data is not updated.

<1.3.4.2 "Control A2">

"Control A2" is a control method for the data of the monitor column, in which the noise of the standard value or more is detected in the noise measurement period Tn, out of the data of the monitor row. The object data is the data of the monitor row, and accordingly, the scanning line G1(i) is set to the active state during a period as a sum of the usual one horizontal scanning period and the TFT characteristic detection period Ta. For the monitor control line G2(i), the previous state is maintained. Moreover, since it is sufficient to perform the usual display, the data voltage corresponding to the usual gradation data is applied to the data line S(j). With regard to the state of the monitor line switch 331 after the noise measurement, the previous state is maintained. Since the characteristic detection is not performed, the correction data is not updated.

<1.3.4.3 "Control B">

"Control B" is a control method for the data of the non-monitor column out of the data of the monitor row. The object data is the data of the monitor row, and accordingly, the scanning line G1(i) is set to the active state during a period as a sum of the usual one horizontal scanning period and the TFT characteristic detection period Ta. Moreover, the monitor control line G2(i) corresponding to the monitor row is set to the active state in the TFT characteristic detection period Ta and the light emission period Tc. However, the object data is the data of the non-monitor column, and it is not necessary to perform the characteristic detection therefor, and accordingly, the state of the monitor line switch 331 after the noise measurement is set to the OFF state (monitor line M(j) is set to a high-impedance state). To the data line S(j), there is applied a data voltage corresponding to data obtained by multiplying the usual gradation data by a correction coefficient k (k is a value approximate to 1). A reason why the correction coefficient k is provided is that, since the transistor T3 has turned to the ON state, it is necessary to increase the data voltage more than original depending on a wiring capacitance of the monitor line M(j). Since the characteristic detection is not performed, the correction data is not updated.

<1.3.4.4 "Control C">

"Control C" is a control method for the data other than the low-gradation data, out of the data to be subjected to the characteristic detection. The object data is the data to be subjected to the characteristic detection, and accordingly, the scanning line G1(i) is set to the active state during the period as the sum of the usual one horizontal scanning period and the TFT characteristic detection period Ta. Moreover, the monitor control line G2(i) corresponding to the monitor row is set to the active state in the TFT characteristic detection period Ta and the light emission period Tc. To the data line S(j), a voltage, which corresponds to the black display, is applied in the black writing period Tb in order to turn the transistor T2 to the OFF state. Since it is necessary to perform the characteristic detection, the state of the monitor line switch 331 after the noise measurement is set to the ON state (the monitor line M(j) is set to a state where it is connected to the current measurement unit 37 or the voltage measurement unit 38). The monitor line M(j) is supplied with the low-level power supply voltage ELVSS in order to detect the TFT characteristics, and thereafter, is supplied with a gradation signal in order to detect the OLED characteristics while allowing the organic EL element OLED to emit light. The TFT characteristics and the OLED characteristics are detected, and accordingly, the correction data is updated.

<1.3.4.5 "Control D">

"Control D" is a control method for the low-gradation data, out of the data to be subjected to the characteristic detection. The object data is the data to be subjected to the characteristic detection, and accordingly, the scanning line G1(i) is set to the active state during the period as the sum of the usual one horizontal scanning period and the TFT characteristic detection period Ta. Moreover, the monitor control line G2(i) corresponding to the monitor row is set to the active state in the TFT characteristic detection period Ta and the light emission period Tc. To the data line S(j), the voltage, which corresponds to the black display, is applied in the black writing period Tb in order to turn the transistor T2 to the OFF state. Since it is necessary to perform the characteristic detection, the state of the monitor line switch 331 after the noise measurement is set to the ON state (the monitor line M(j) is set to the state where it is connected to the current measurement unit 37 or the voltage measurement unit 38). The monitor line M(j) is supplied with the low-level power supply voltage ELVSS in order to detect the TFT characteristics. Note that, with regard to the low-gradation data, the supply of the gradation signal to the monitor line M(j), which is performed in order to allow the organic EL element OLED to emit light, is not performed in order to prevent the unnecessary light emission. The TFT characteristics are detected, and accordingly, the correction data is updated. However, the data to be updated is only the data regarding the TFT characteristics.

<1.3.5 Update of Offset Memory and Gain Memory>

Figure 25:
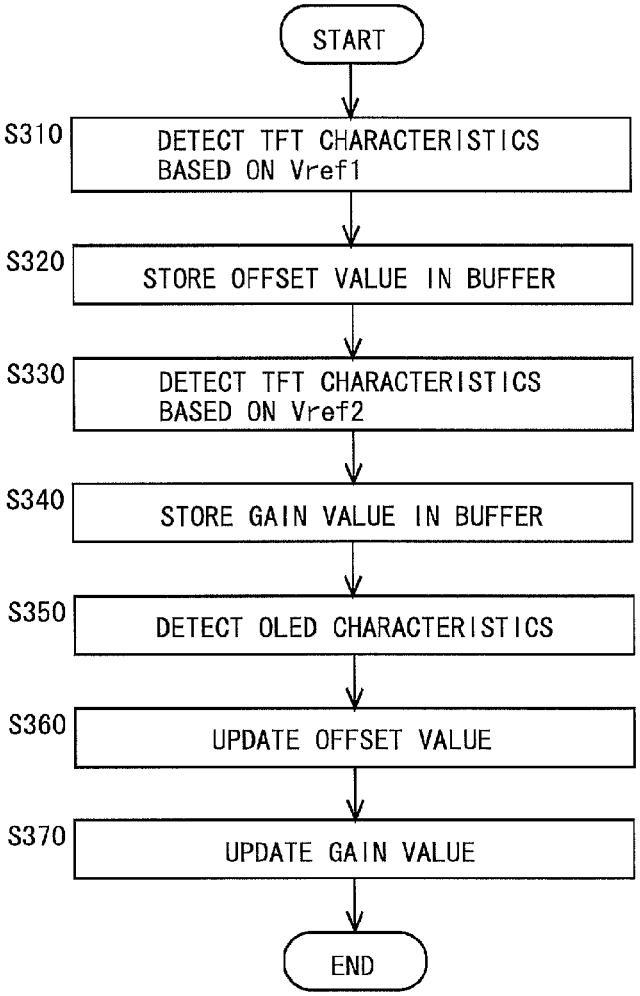
FIG. 25 is a flowchart for explaining a procedure of updating an offset memory and a gain memory in the first embodiment.

Next, a description is made of how to update the offset value stored in the offset memory 51 and the gain value stored in the gain memory 52. Note that the offset value and the gain value are updated only for pixel data in which the magnitude of the noise detected in the noise measurement period Tn is less than the reference value and for which the characteristic detection operation is performed. FIG. 25 is a flowchart for explaining a procedure of updating the offset memory 51 and the gain memory 52. Note that, here, the offset value and the gain value, which correspond to one pixel, are focused on.

First, in a first half of the TFT characteristic detection period Ta, the TFT characteristics are detected based on a first reference voltage Vref1 (Step S310). By this Step S310, the offset value for correcting the video signal is obtained. The offset value obtained in Step S310 is stored in the offset value buffer (Step S320). In a second half of the TFT characteristic detection period Ta, the TFT characteristics are detected based on a second reference voltage Vref2 (Step S330). By this Step S330, the gain value for correcting the video signal is obtained. The gain value obtained in Step S330 is stored in the gain value buffer (Step S340).

Thereafter, in the light emission period Tc, the OLED characteristics are detected (Step S350). By this Step S350, the offset value and the deterioration correction coefficient for correcting the video signal are obtained. Then, a sum of the offset value stored in the offset value buffer and the offset value obtained in Step S350 is stored as a new offset value in the offset memory 51 (Step S360). Moreover, a product of the gain value stored in the gain value buffer and the deterioration correction coefficient obtained in Step S350 is stored as a new gain value in the gain memory 52 (Step S370).

In such a manner as described above, the offset value and the gain value, which correspond to one pixel, are updated. In this embodiment, the TFT characteristics and the OLED characteristics are detected for one row in each frame. Accordingly, unless the noise with the standard value or more is detected in all of the columns, then m pieces of the offset values in the offset memory 51 and m pieces of the gain values in the gain memory 52 are updated per frame.

Incidentally, as mentioned above, the light emission voltage of the organic EL element OLED is measured in the light emission period Tc. As the detection voltage as the measurement result is being larger, the deterioration degree of the organic EL element OLED is larger. Hence, the offset memory 51 and the gain memory 52 are updated so that the offset value can be larger and the gain value can be larger as the detection voltage is being larger.

<1.3.6 Correction of Video Signal>

In this embodiment, in order to compensate for the deterioration of the drive transistor and the deterioration of the organic EL element OLED, the video signal sent from the outside is corrected by using the correction data stored in the offset memory 51 and the gain memory 52. A description is made below of this correction of the video signal.

Figure 26:
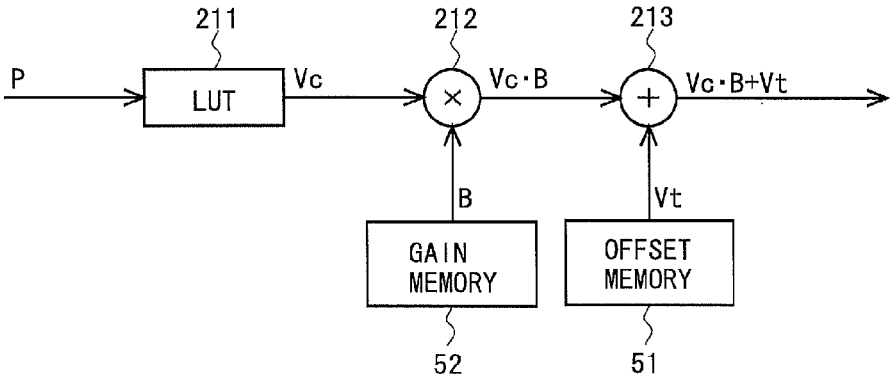
FIG. 26 is a diagram showing a configuration of a video signal correction unit in the first embodiment.

The correction of the video signal sent from the outside is performed in the video signal correction unit in the control circuit 20. FIG. 26 is a diagram showing a configuration of the video signal correction unit. The video signal correction unit includes an LUT 211, a multiplier unit 212, and an adder unit 213. In such a configuration, the value of the video signal corresponding to each pixel is corrected as follows.

First, by using the LUT 211, gamma correction is implemented for the video signal sent from the outside. That is to say, a gradation P indicated by the video signal is converted into a control voltage Vc by the gamma correction. The multiplier unit 212 receives the control voltage Vc and a gain value B read out of the gain memory 52, and outputs a value "Vc·B" obtained by multiplying them. The adder unit 213 receives the value "Vc·B", which is outputted from the multiplier unit 212, and an offset value Vt, which is read out of the offset memory 51, and outputs a value "Vc·B1+Vt", which is obtained by adding them. A value "Vc·B1+Vt" obtained in such a manner as described above is sent as the data signal DA from the control circuit 20 to the source driver 30.

<1.4 Effects>

Figure 27:
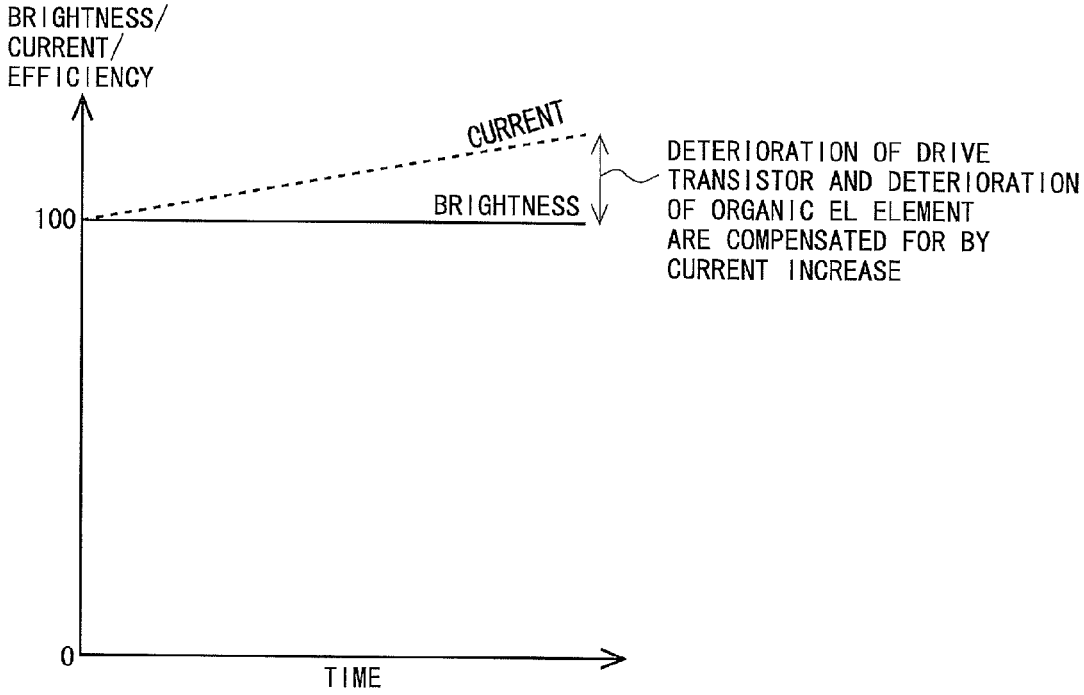
FIG. 27 is a graph for explaining an effect in the first embodiment.

In accordance with this embodiment, in each frame, the noise generated in the monitor line M is measured, and for each monitor column, the TFT characteristics and the OLED characteristics are detected when the magnitude of the noise is less than the standard value. Then, the video signal sent from the outside is corrected by using the correction data (offset value and gain value) obtained in consideration of both of the detection result of the TFT characteristics and the detection result of the OLED characteristics. The data voltage that is based on the video signal (above-described data signal DA) thus corrected is applied to the data line S, and accordingly, in the event of allowing the organic EL element OLED in each pixel circuit 11 to emit light, the drive current with such a magnitude that compensates for the deterioration of the drive transistor and the deterioration of the organic EL element OLED is supplied to the organic EL element OLED (refer to FIG. 27). Here, when the magnitude of the noise is the standard value or more, the TFT characteristics and the OLED characteristics are not detected, and the correction data is not updated. That is to say, the correction data is not updated at such a time when an error to an unignorable extent occurs between the original current value and the measurement value with regard to the detection current. Hence, the decrease in the compensation accuracy, which is caused by a fact that the value of the correction data becomes an inappropriate value, is prevented. As described above, according to this embodiment, it becomes possible to prevent the decrease in the compensation accuracy, which results from the noise, in the organic EL display device in which the external compensation technology is adopted in order to compensate for the deterioration of the circuit element.

Moreover, in this embodiment, the oxide TFTs (specifically, TFTs each having the In—Ga—Zn—O-based semiconductor layer) are adopted for the transistors T1 to T3 in the pixel circuit 11, and accordingly, an effect that a sufficient S/N ratio can be ensured is obtained. A description of this is made below. Note that, here, the TFT having the In—Ga—Zn—O-based semiconductor layer is referred to as an "In—Ga—Zn—O-TFT". When the In—Ga—Zn—O-TFT and an LIPS (Low Temperature Poly silicon)-TFT are compared with each other, an OFF current of the In—Ga—Zn—O-TFT is extremely smaller than that of the LTPS-TFT. For example, in a case where the LTPS-TFT is adopted for the transistor T3 in the pixel circuit 11, the OFF current becomes approximately 1 pA at most. In contrast, in a case where the In—Ga—Zn—O-TFT is adopted for the transistor T3 in the pixel circuit 11, the OFF current becomes approximately 10 fA at most. Hence, for example, an OFF current for 1000 rows becomes approximately 1 nA at most in the case where the LTPS-TFT is adopted, and becomes approximately 10 pA at most in the case where the In—Ga—Zn—O-TFT is adopted. The detection current becomes approximately 10 to 100 nA no matter which of the LTPS-TFT and the In—Ga—Zn—O-TFT may be adopted. Incidentally, the monitor line M is connected not only to the pixel circuit 11 of the monitor row but also to the pixel circuit 11 of the non-monitor rows. Accordingly, the S/N ratio of the monitor line M depends on a sum of leakage currents of the transistors T3 of the non-monitor rows. Specifically, the S/N ratio of the monitor line M is represented by "detection current/(leakage current×number of non-monitor rows)". Thus, for example, in an organic EL display device including a display unit 10 of "Landscape FHD", the S/N ratio becomes approximately 10 in the case where the LTPS-TFT is adopted, and in contrast, the S/N ratio becomes approximately 1000 in the case where the In—Ga—Zn—O-TFT is adopted. As described above, in this embodiment, a sufficient S/N ratio can be ensured in the event of detecting the current.

<1.5 Modification Examples>

A description is made below of modification examples of the above-described first embodiment. Note that, in the following, a description is made in detail only of different points from those of the first embodiment, and a description of similar points to those of the first embodiment is omitted.

<1.5.1 First Modification Example>

In the above-described first embodiment, with regard to the monitor column, in the case where the noise with the standard value or more is detected in the noise measurement period Tn, the TFT characteristics and the OLED characteristics are not detected. However, the present invention is not limited to this. The configuration may be such that the TFT characteristics and the OLED characteristics are detected irrespective of the magnitude of the noise detected in the noise measurement period Tn, and that the correction data is not updated in the case where the noise with the standard value or more is detected in the noise measurement period Tn (This is a configuration of this modification example).

Figure 28:
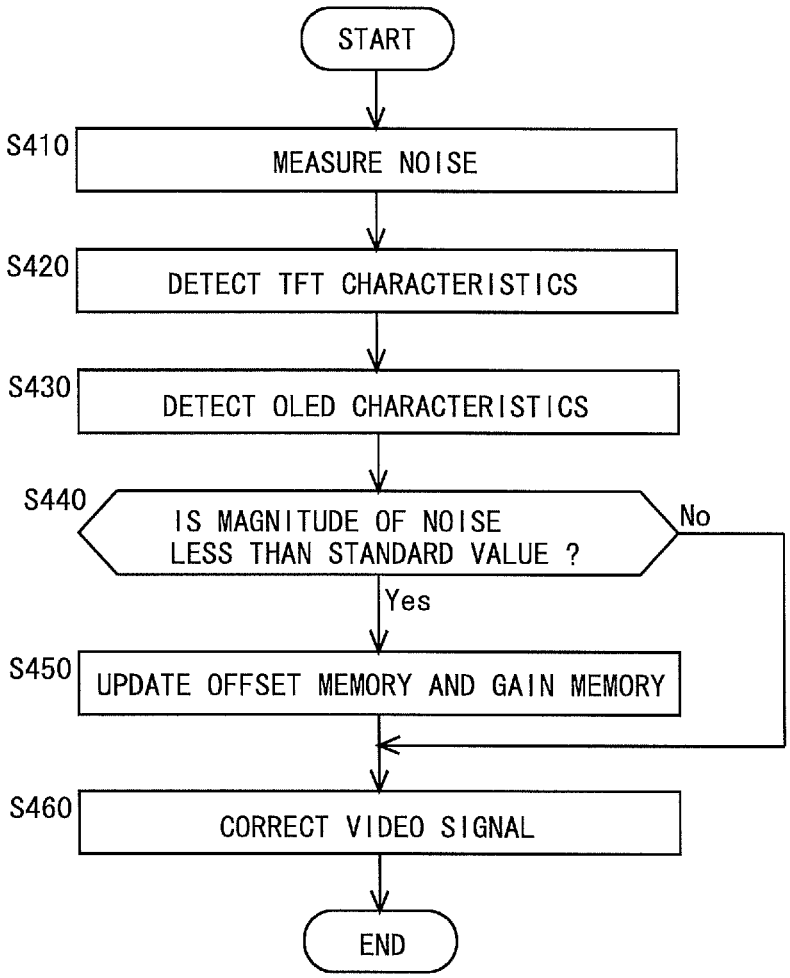
FIG. 28 is a flowchart for explaining an outline of a drive method when focusing on the monitor column in the monitor row in a first modification example of the first embodiment.

FIG. 28 is a flowchart for explaining an outline of a drive method when focusing on the monitor column in the monitor rows in this modification example. At a beginning of the frame period, the noise generated in the monitor line M is measured (Step S410). Next, the TFT characteristics are detected (Step S420). Next, the OLED characteristics are detected (Step S430). Thereafter, it is determined whether or not the magnitude of the noise measured in Step S410 is less than the standard value (Step S440). As a result, the processing proceeds to Step S450 when the magnitude of the noise is less than the standard value, and the processing proceeds to Step S460 when the magnitude of the noise is the standard value or more. That is to say, the processing of Step S460 is performed after the processing of Step S450 is performed when the magnitude of the noise is less than the standard value, and the processing of Step S460 is performed without performing the processing of Step S450 when the magnitude of the noise is the standard value or more. In Step S450, the offset memory 51 and the gain memory 52 are updated by using a detection result in Step S420 and a detection result in Step S430. In Step S460, the video signal sent from the outside is corrected by using the correction data stored in the offset memory 51 and the gain memory 52.

Note that, in this modification example, the noise measurement step is realized by Step S410, the characteristic detection step is realized by Step S420 and Step S430, the correction data update step is realized by Step S450, and the video signal correction step is realized by Step S460. Moreover, the first characteristic detection step is realized by Step S420, and the second characteristic detection step is realized by Step S430.

Figure 29:
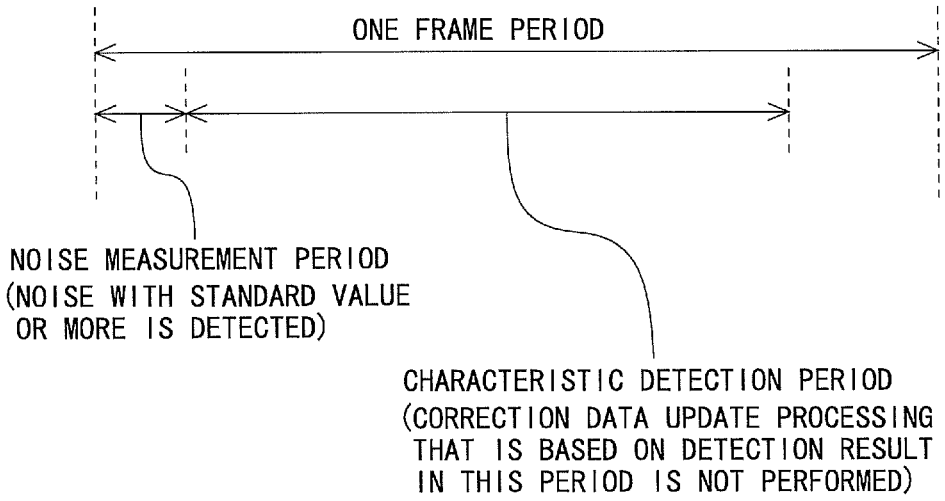
FIG. 29 is a view for explaining an operation when the noise with the standard value or more is detected in the noise measurement period in a certain frame in the first modification example of the first embodiment.

FIG. 29 is a view for explaining an operation when the noise with the standard value or more is detected in the noise measurement period Tn in a certain frame (here, referred to as an "object frame") in this modification example. In this modification example, with regard to the monitor column, as shown in FIG. 29, when the noise with the standard value or more is detected in the noise measurement period Tn in the object frame, the correction data update processing that is based on the result of the characteristic detection in the object frame is not performed.

According to this modification example, the TFT characteristics and the OLED characteristics need to be detected in all of the monitor columns irrespective of the magnitude of the noise generated in the respective monitor lines M in the noise measurement period Tn, and accordingly, it becomes easy to control the operations of the pixel circuits 11. Moreover, it is not necessary to provide such a period for determining the magnitude of the noise before the characteristic detection operation is performed, and accordingly, the period for the characteristic detection is prevented from being shortened.

Note that, in accordance with the above-described first embodiment and this modification example, it is grasped that the present invention has a following feature with regard to the control of the monitor column. When the noise with the standard value or more is detected in the noise measurement period Tn, the characteristic detection immediately after a point of time when this noise is detected is not performed, or alternatively, the correction data update processing that is based on the characteristic detection performed at a point of time, which is close to the point of time when this noise is detected, is not performed.

<1.5.2 Second Modification Example>

In a case of adopting a configuration in which the monitor row is also switched without fail every time when the frame is switched, a difference can occur in the number of detection times of the TFT characteristics and the OLED characteristics among the rows. Accordingly, in this modification example, in the case where the noise with the standard value or more is detected in the noise measurement period Tn in a certain frame (here, referred to as the "object frame"), a monitor row in a frame next to the object frame and the monitor row in the object frame are defined to be the same row. Moreover, in this modification example, in a case where the magnitude of the noise detected in the noise measurement period Tn in the object frame is less than the standard value, and where a magnitude of noise detected in the noise measurement period Tn in the frame next to the object frame is the standard value or more, the correction data update processing that is based on the result of the characteristic detection of the object frame is not performed, and a monitor row in a frame two frame after the object frame and the monitor row in the object frame are defined to be the same row. Note that such a control as described above cannot be performed for each of the columns, and accordingly, in this modification example, it is assumed that it is determined that "the magnitude of the noise is the standard value or more" when the magnitude of the noise is the standard value or more in at least one monitor line M.

Figure 30:
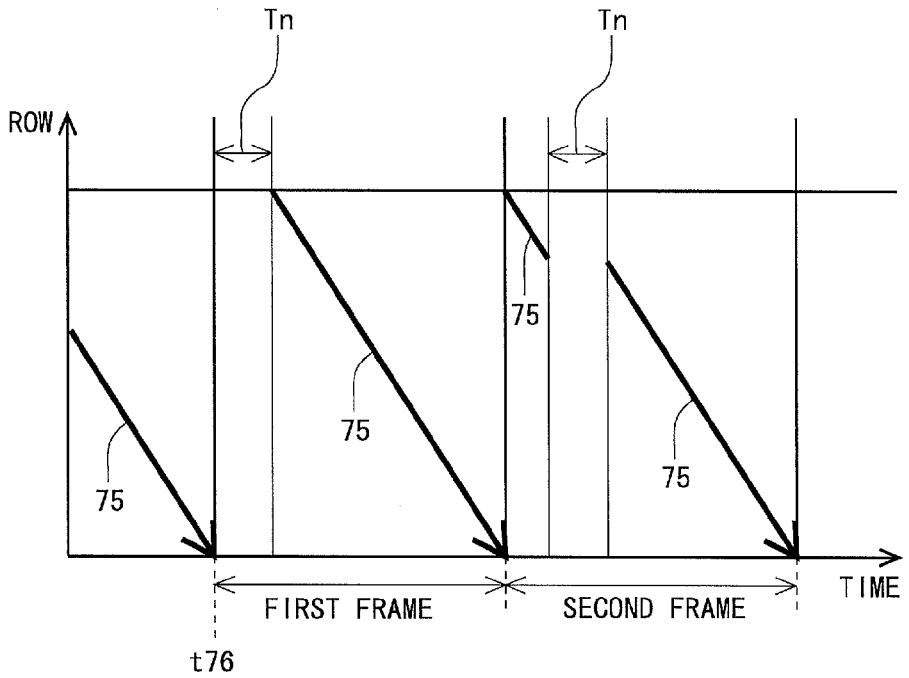
FIG. 30 is a chart for explaining a transition of the monitor row in a second modification example of the first embodiment.
Figure 31:
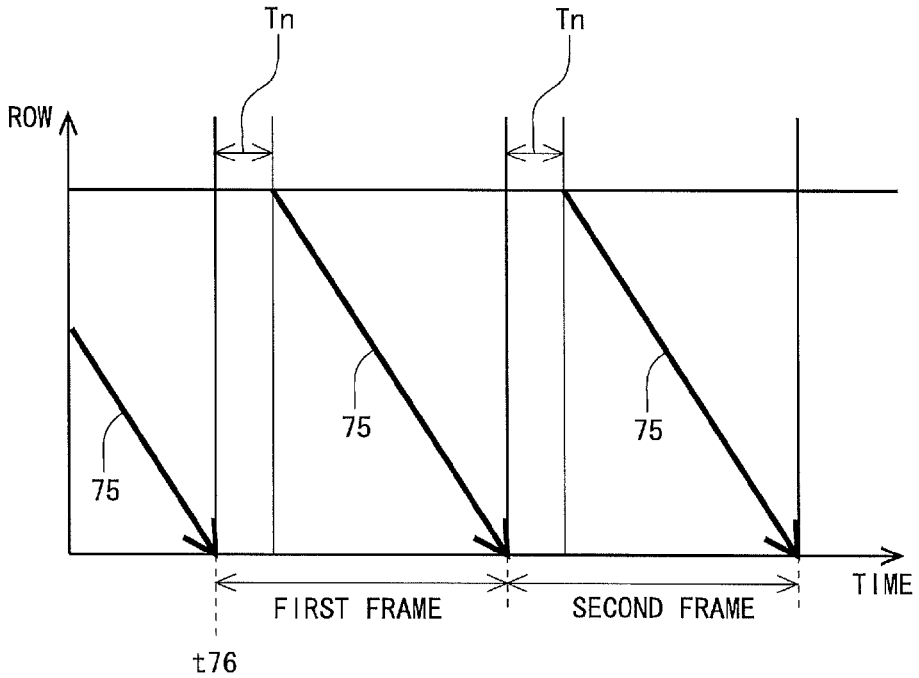
FIG. 31 is a chart for explaining the transition of the monitor row in the second modification example of the first embodiment.
Figure 32:
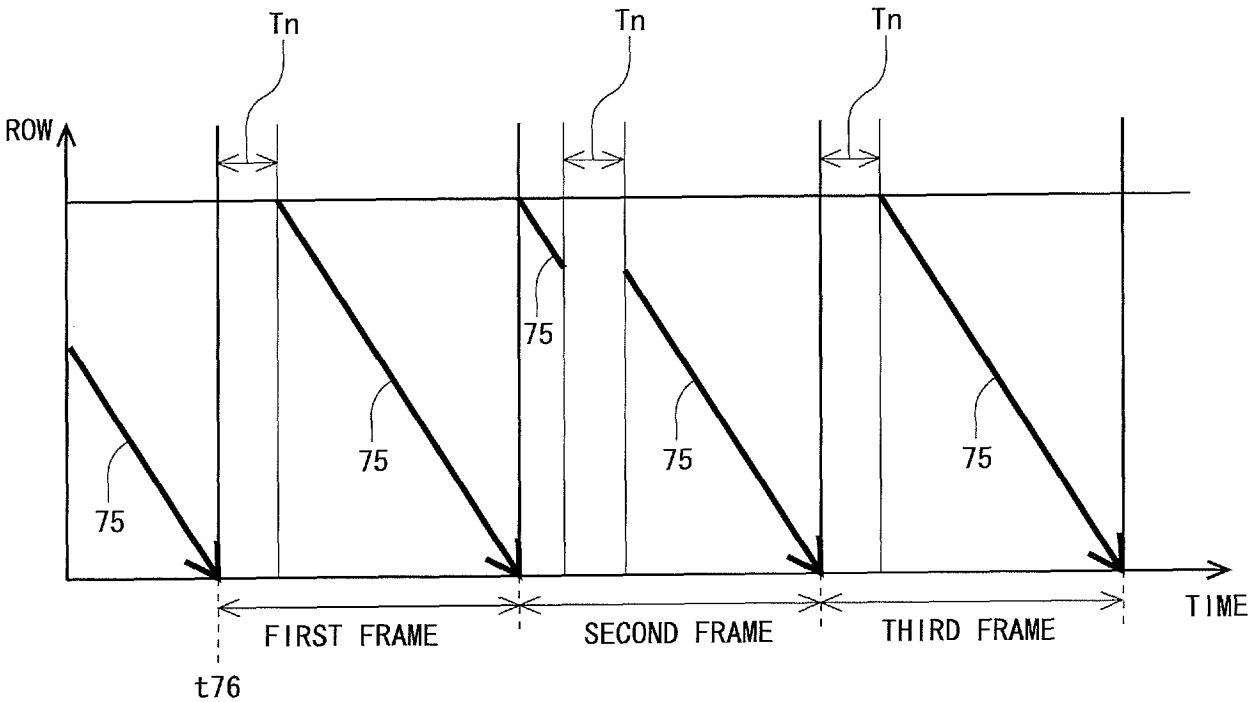
FIG. 32 is a chart for explaining the transition of the monitor row in the second modification example of the first embodiment.

FIG. 30 to FIG. 32 are charts for explaining transitions of the monitor row in this modification example. Note that, in FIG. 30 to FIG. 32, temporal transitions of the vertical scanning in the display unit 10 are shown by arrows of reference numeral 75. Moreover, it is assumed that a frame starting at a point of time t76 is a first frame, and that a monitor row in the first frame is a first row.

When the magnitude of the noise detected in the noise measurement period Tn in the first frame is less than the standard value, as shown in FIG. 30, the characteristic detection operation for the first row is performed in the first frame, and thereafter, the second row is set to be the monitor row in the second frame. When the magnitude of the noise detected in the noise measurement period Tn in the first frame is the standard value or more, as shown in FIG. 31, the first row is set to be the monitor row again in the second frame. When the magnitude of the noise detected in the noise measurement period Tn in the first frame is less than the standard value and the magnitude of the noise detected in the noise measurement period Tn in the second frame is the standard value or more, as shown in FIG. 32, the first row is set to be the monitor row again in a third frame. At this time, the correction data update processing that is based on the result of the characteristic detection in the first frame is not performed.

Thus, when the frame subjected to the characteristic detection for a Z-th row (Z is an integer of 1 or more to n or less) is defined as the object frame, operations as below are performed in this modification example. In the case where the noise with the standard value or more is detected in the noise measurement period Tn in the object frame, the correction data update processing that is based on the result of the characteristic detection in the object frame is not performed, and the characteristic detection for the Z-th row is also performed in the frame next to the object frame. Moreover, in the case where the noise with the standard value or more is not detected in the noise measurement period Tn in the object frame, and where the noise with the standard value or more is detected in the noise measurement period Tn in the frame next to the object frame, the correction data update processing that is based on the result of the characteristic detection in the object frame and the correction data update processing that is based on the result of the characteristic detection in the frame next to the object frame are not performed, and the characteristic detection for the Z-th row is performed also in the frame two frame after the object frame.

According to this modification example, the number of detection times of TFT characteristics and the OLED characteristics is prevented from differing among the rows. Therefore, it becomes possible to perform the compensation, which is made for the deterioration of the drive transistor and the deterioration of the organic EL element OLED, uniformly on the entire screen, and the occurrence of the brightness variations is prevented effectively.

<1.5.3 Third Modification Example>

In the above-described first embodiment, when the magnitude of the noise detected in the noise measurement period Tn in a certain frame (here, referred to as the "object frame") is less than the standard value, the correction data update processing that is based on the result of the characteristic detection in the object frame is performed irrespective of the magnitude of the noise detected in the noise measurement period Tn in the frame next to the object frame. However, the present invention is not limited to this. The configuration may be such that the correction data update processing that is based on the result of the characteristic detection in the object frame is performed only in a case where the magnitude of the noise detected in the noise measurement period Tn is less than the standard value in both of the object frame and the frame next to the object frame (This is a configuration of this modification example).

Figure 33:
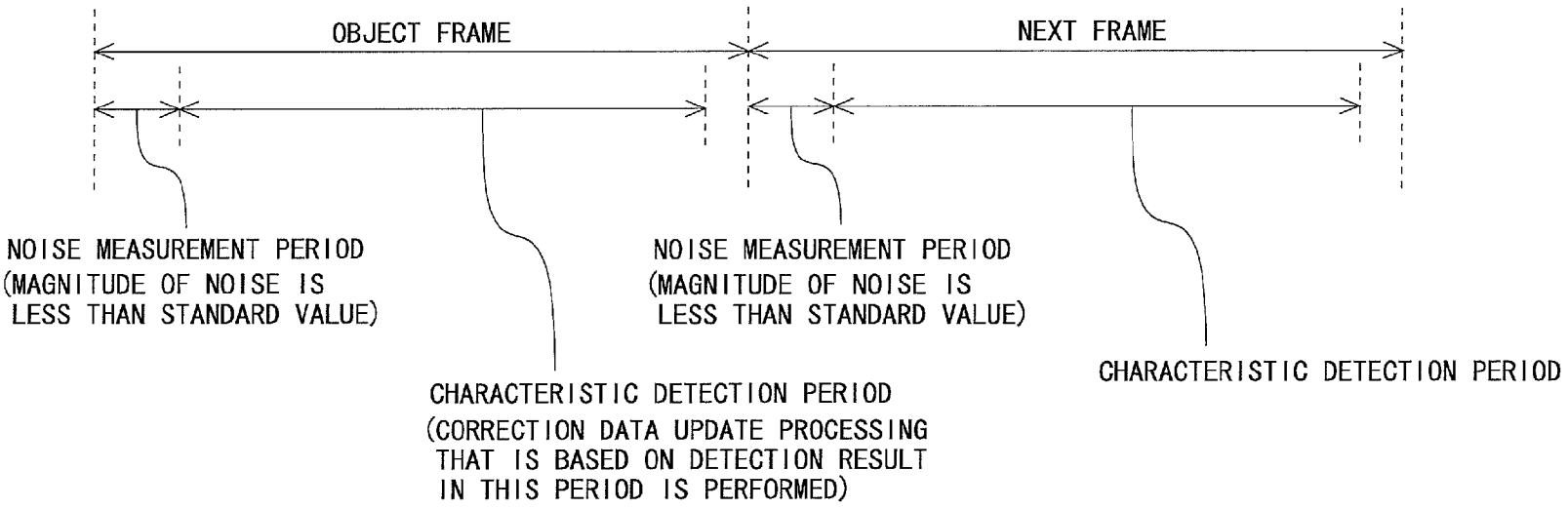
FIG. 33 is a view for explaining a condition where the correction data update processing that is based on the result of the characteristic detection in a certain frame is performed in a third modification example of the first embodiment.

FIG. 33 is a view for explaining a condition where the correction data update processing that is based on the result of the characteristic detection in a certain frame (here, referred to as an "object frame") is performed in this modification example. In this modification example, with regard to the monitor column, as shown in FIG. 33, when the magnitude of the noise detected in the noise measurement period Tn in the object frame is less than the standard value and the magnitude of the noise detected in the noise measurement period Tn in the frame next to the object frame is less than the standard value, the correction data update processing that is based on the result of the characteristic detection in the object frame is performed. In other words, the correction data update processing that is based on the result of the characteristic detection for the Z-th row (Z is an integer of 1 or more to n or less) is performed only when the noise with the standard value or more is not detected in both of the noise measurement period Tn immediately before the characteristic detection period for the Z-th row and the noise measurement period Tn immediately after the characteristic detection period for the Z-th row.

Figure 34:
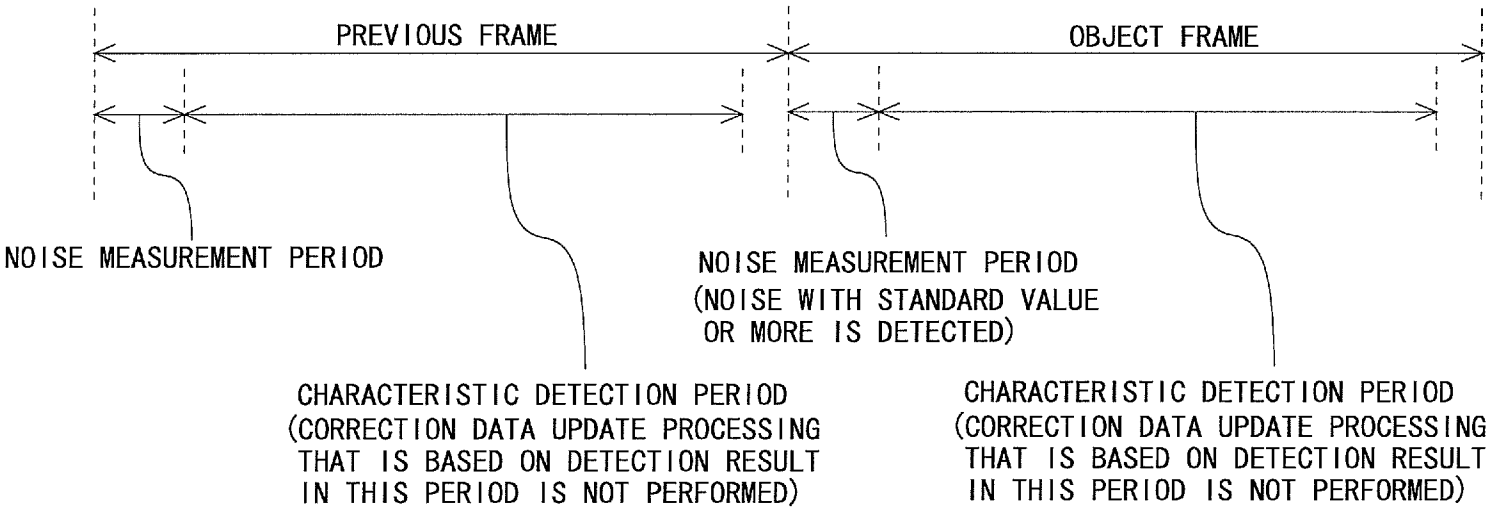
FIG. 34 is a view for explaining an operation when the noise with the standard value or more is detected in the third modification example of the first embodiment.

FIG. 34 is a view for explaining an operation when the noise with the standard value or more is detected in this modification example. In this modification example, with regard to the monitor column, as shown in FIG. 34, when the noise with the standard value or more is detected in the noise measurement period Tn in the object frame, not only the correction data update processing that is based on the result of the characteristic detection in the object frame is not performed, but also the correction data update processing that is based on the result of the characteristic detection in the frame immediately before the object frame is not performed.

Figure 35:
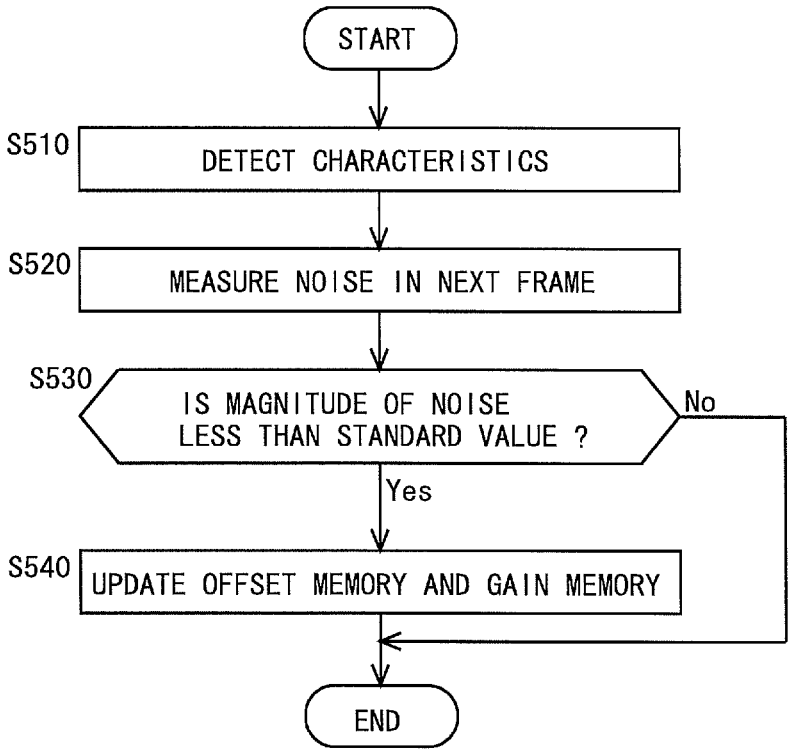
FIG. 35 is a flowchart for explaining an outline of operations in the third modification example of the first embodiment.

FIG. 35 is a flowchart for explaining an outline of operations in this modification example. After the characteristic detection in the object frame is performed (Step S510), the noise measurement is performed in the frame next to the object frame (Step S520). Note that, here, it is assumed that the magnitude of the noise detected in the noise measurement period Tn in the object frame is less than the standard value. Next, it is determined whether or not the magnitude of the noise measured in Step S520 is less than the standard value (Step S530). As a result, processing of Step S540 is performed when the magnitude of the noise is less than the standard value as a result, and the processing of Step S540 is not performed when the magnitude of the noise is the standard value or more. In Step S540, the offset memory 51 and the gain memory 52 are updated by using a result of the characteristic detection (characteristic detection in the object frame) in Step S510.

Incidentally, in this modification example, unless the magnitude of the noise is less than the standard value for continuous two frames, the correction data update processing is not performed. In order to realize this, a result of the characteristic detection in any frame is stored in the buffer in a period until the noise measurement is performed in the next frame and the correction data update processing is performed.

According to this modification example, the correction data update processing is performed only in a case where the magnitude of the noise is less than the standard value in both of the periods before and after the characteristic detection period. As described above, the correction data update processing that is based on the result of the characteristic detection is performed in consideration of states of the noise in the periods before and after the characteristic detection period, and accordingly, the decrease in the compensation accuracy, which is caused by a fact that the value of the correction data becomes an inappropriate value, is prevented effectively.

<1.5.4 Fourth Modification Example>

Figure 36:
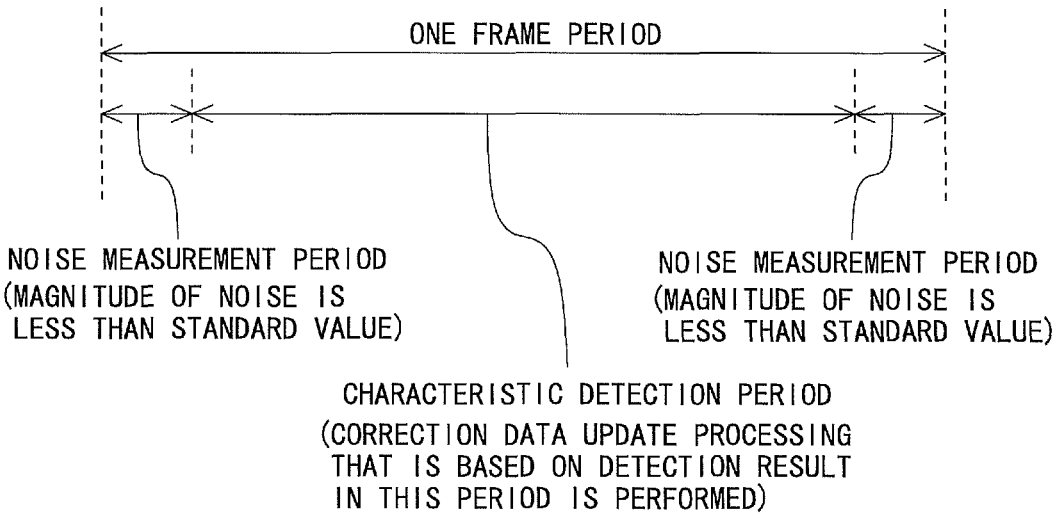
FIG. 36 is a view for explaining a relationship between the noise measurement period and the characteristic detection period in a fourth modification example of the first embodiment.

In the above-described first embodiment, the noise measurement period Tn is provided before the characteristic detection period in the frame period; however, the present invention is not limited to this. As shown in FIG. 36, the noise measurement periods Tn may be provided before and after the characteristic detection period in the frame period. In a case of this example, with regard to the monitor column, the configuration may be such that the correction data update processing that is based on the result of the characteristic detection in the corresponding frame is performed only in a case where the magnitude of the noise is less than the standard value in both of the noise measurement period Tn in a first half of the frame period and the noise measurement period Tn in a second half of the frame period.

<1.5.5 Fifth Modification Example>

Figure 37:
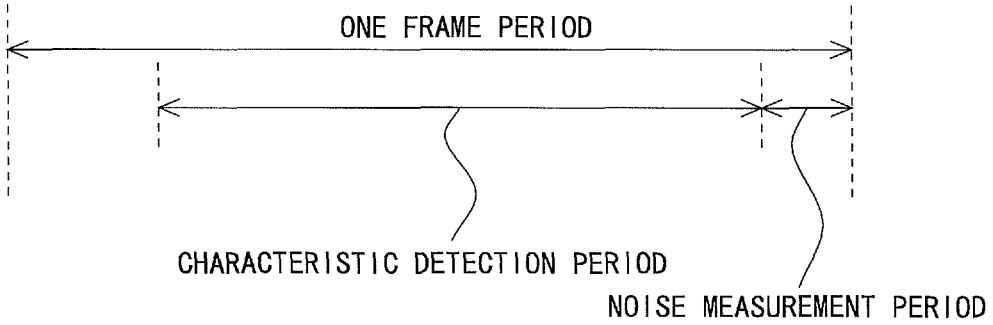
FIG. 37 is a view for explaining a relationship between the noise measurement period and the characteristic detection period in a fifth modification example of the first embodiment.
Figure 38:
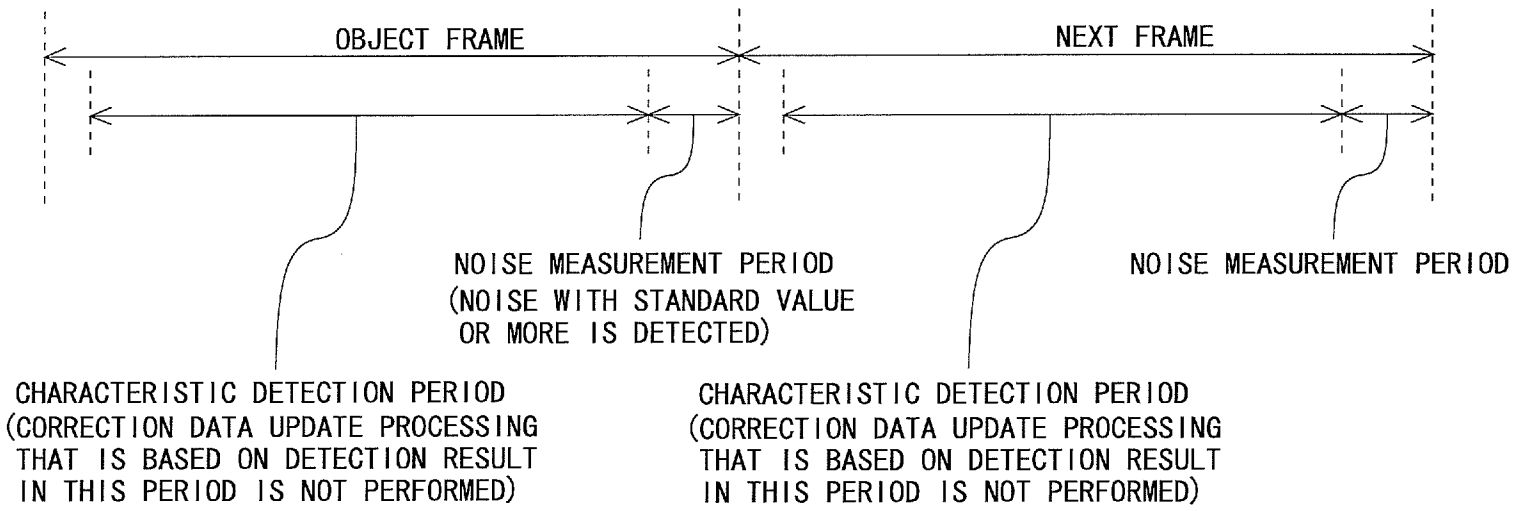
FIG. 38 is a view for explaining an operation when the noise with the standard value or more is detected in the fifth modification example of the first embodiment.
Figure 39:
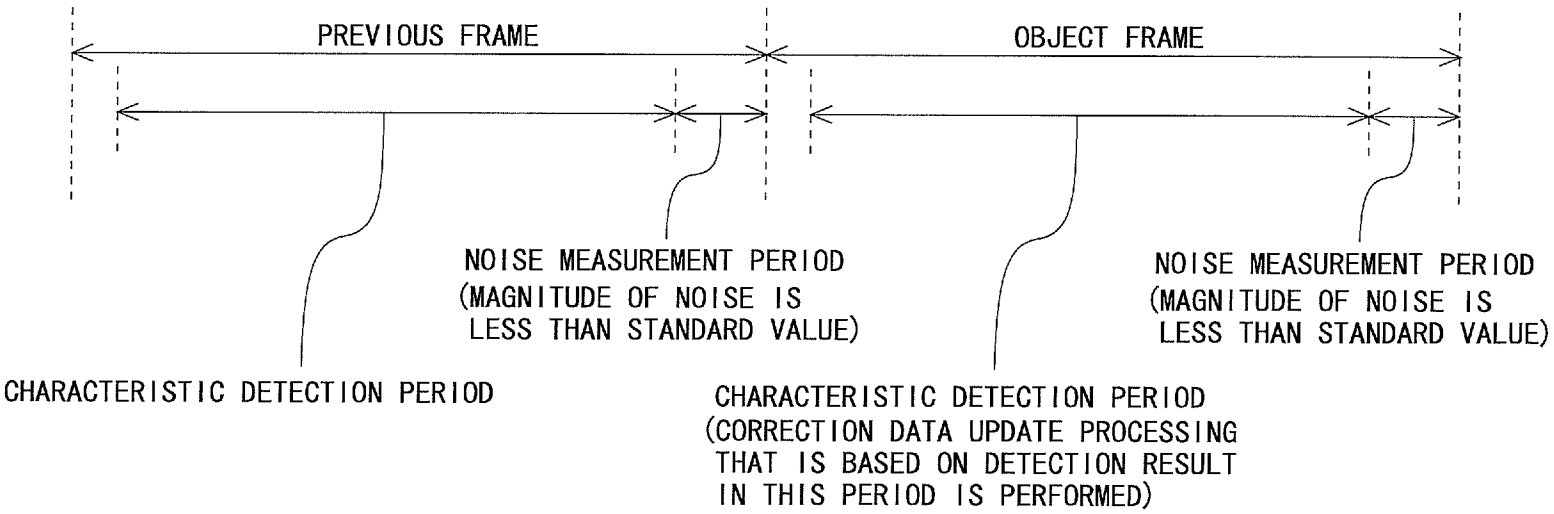
FIG. 39 is a view for explaining a condition where the correction data update processing that is based on the result of the characteristic detection in a certain frame is performed in a fifth modification example of the first embodiment.

In the above-described first embodiment, the noise measurement period Tn is provided before the characteristic detection period in the frame period; however, the present invention is not limited to this. As shown in FIG. 37, the noise measurement period Tn may be provided after the characteristic detection period in the frame period. In a case of this example, with regard to the monitor column, as shown in FIG. 38, the configuration may be such that, when the noise with the standard value or more is detected in the noise measurement period Tn in a certain frame (here, referred to as an "object frame"), the correction data update processing that is based on the result of the characteristic detection in the object frame and the correction data update processing that is based on the result of the characteristic detection in the frame next to the object frame are not performed. Moreover, with regard to the monitor column, as shown in FIG. 39, the configuration may be such that, the correction data update processing that is based on the result of the characteristic detection in the object frame is performed only in the case where the magnitude of the noise is less than the standard value in both of the noise measurement period Tn in the frame immediately before the object frame and the noise measurement period Tn in the object frame.

<1.5.6 Sixth Modification Example>

Figure 40:
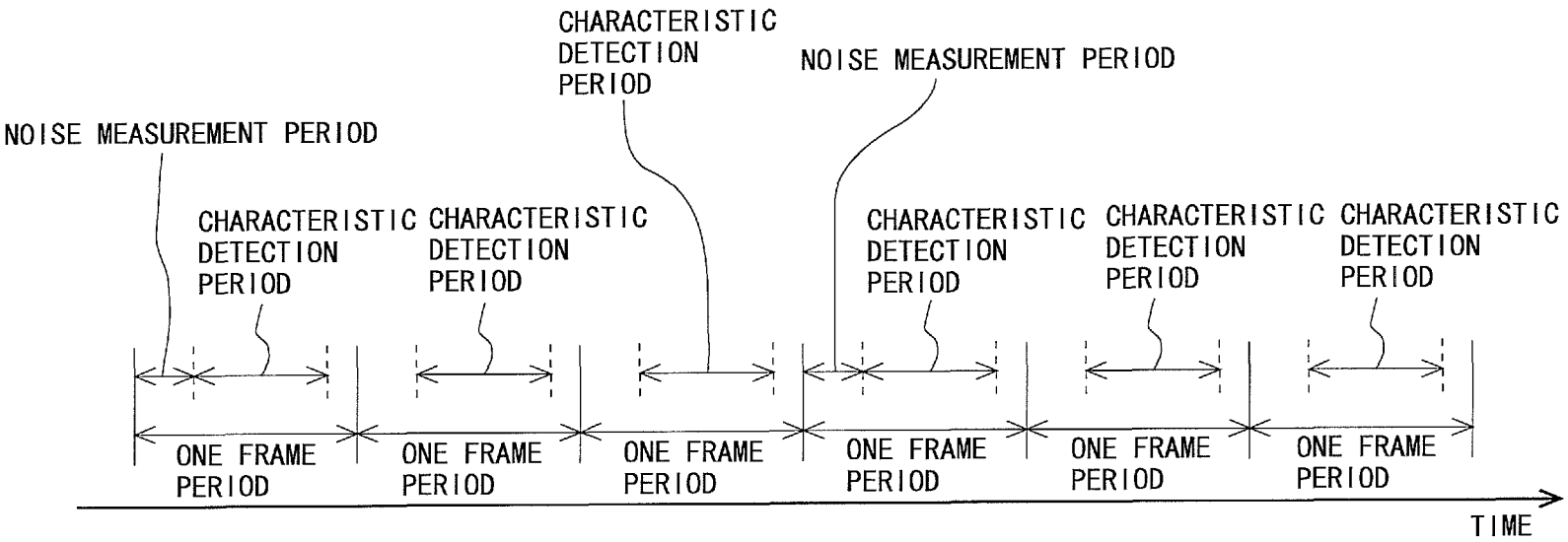
FIG. 40 is a view for explaining that a measurement of the noise is performed every a plurality of frames in a sixth modification example of the first embodiment.

In the above-described first embodiment, the noise is measured in all of the frames. However, the present invention is not limited to this. The configuration may be such that the noise is measured every a plurality of frames (This is a configuration of this modification example). For example, as shown in FIG. 40, the configuration may be such that the noise is measured only once every three frames.

In this modification example, the configuration may be such that, in the case where the noise with the standard value or more is detected in the noise measurement period Tn in a certain frame (here, referred to as an "object frame"), the correction data update processing that is based on the result of the characteristic detection performed for a period from when the noise is measured before the object frame until the noise is measured after the object frame is not performed.

According to this modification example, similar effects to those of the above-described first embodiment are obtained while reducing a frequency to measure the noise.

<1.5.7 Seventh Modification Example>

In the above-described first embodiment, the description is made on the premise that one monitor circuit 322 is provided for one column. However, the present invention is not limited to this. The configuration may be such that one monitor circuit 322 is shared by a plurality of the columns (This is a configuration in this modification example).

Figure 41:
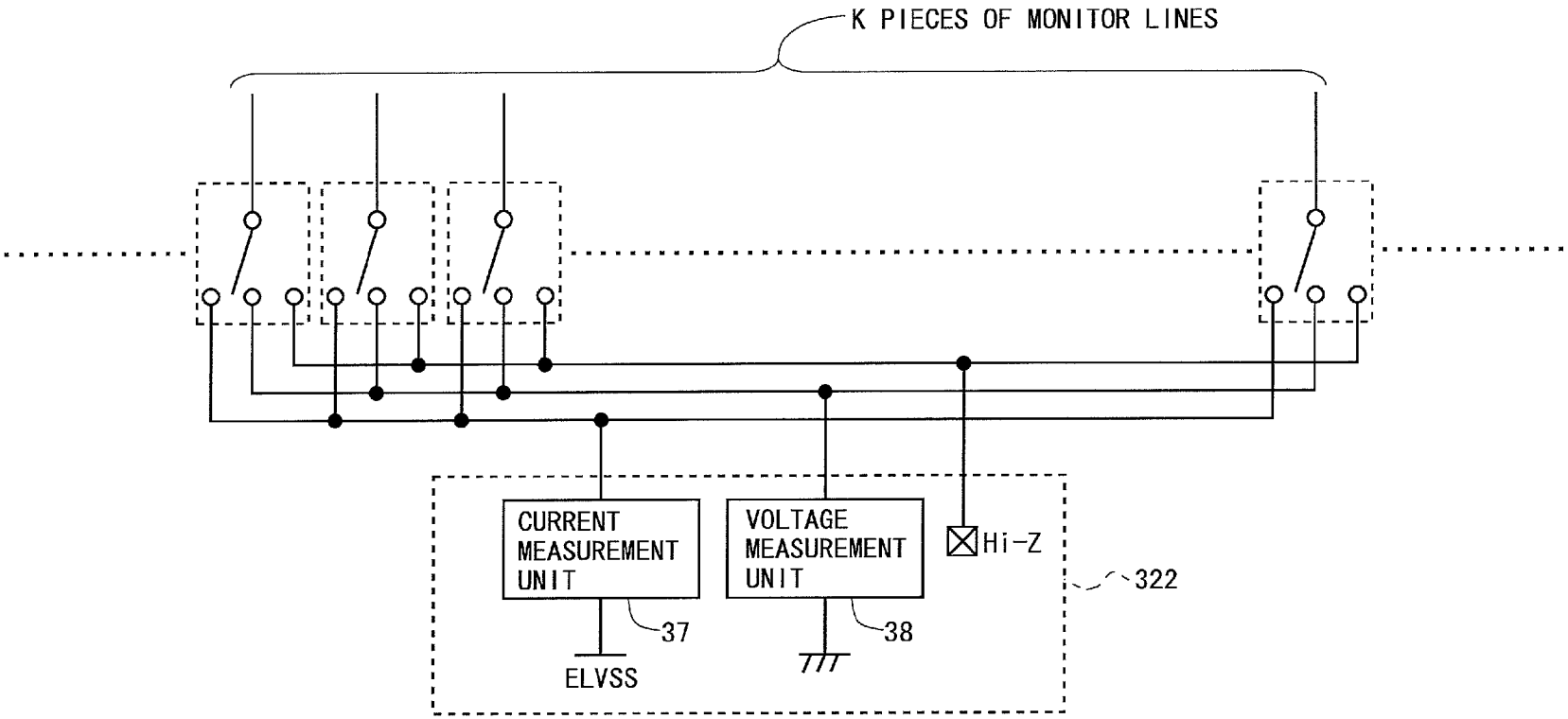
FIG. 41 is a diagram showing a configuration of a vicinity of one end portion of a monitor line in a seventh modification example of the first embodiment.

In this modification example, in a similar way to the above-described first embodiment, each of the monitor lines M is set to a state of being connected to the current measurement unit 37, or a state of being connected to the voltage measurement unit 38, or a state of being a high-impedance. Moreover, in this modification example, a vicinity of one end portion of each monitor line M has a configuration shown in FIG. 41. That is to say, one monitor circuit 322 is provided every K pieces of the monitor lines M.

In such a configuration as described above, in each frame, only one column among K pieces of the columns corresponding to the above-described K pieces of monitor lines M is set to be the above-mentioned monitor column. In an event where the characteristic detection operation is performed, only the monitor line M of the monitor column is set to the state of being connected to the current measurement unit 37 or to the state of being connected to the voltage measurement unit 38, and the monitor line M of the non-monitor column is set to the high-impedance state. Moreover, in the event where the characteristic detection operation is performed, in the non-monitor column, not the reference voltage Vref but the data voltage (a voltage corresponding to the target brightness) is applied to the data line S. In the light emission period Tc, the transistor T3 is in the ON state; however, the monitor line M in the non-monitor column is maintained in the high-impedance state.

Therefore, in the non-monitor column, the current does not flow through the monitor line M, but the current flows through the organic EL element OLED, and the organic EL element OLED emits light in a similar way to the usual operation. In the monitor column in the monitor row, the above-mentioned characteristic detection operation is performed as long as the noise with the standard value or more is not detected.

For example, in an organic EL display device, which includes a display unit 10 of "Landscape FHD", and has a drive frequency of 60 Hz, a time required for monitoring (detection of the TFT characteristics and the OLED characteristics) for one column is 18 seconds (=1080/60). Here, in order that the offset value and the gain value, which correspond to each pixel, are updated every 30 minutes (1800 seconds), one monitor circuit 322 should be provided every 100 pieces of the monitor lines M.

As described above, according to this modification example, it becomes possible to prevent the decrease in the compensation accuracy, which results from the noise, while suppressing the increase in the circuit area in the organic EL display device in which the external compensation technology is adopted in order to compensate for the deterioration of the circuit element.

<1.5.8 Eighth Modification Example>

In the above-described first embodiment, the OLED characteristics are detected by measuring the voltage of the anode of the organic EL element OLED in the state where a constant current is given to the organic EL element OLED. However, the present invention is not limited to this. The configuration may be such that the OLED characteristics are detected by measuring the current flowing through the organic EL element OLED in a state where a constant voltage is given to the organic EL element OLED (This is a configuration of this modification example).

Figure 42:
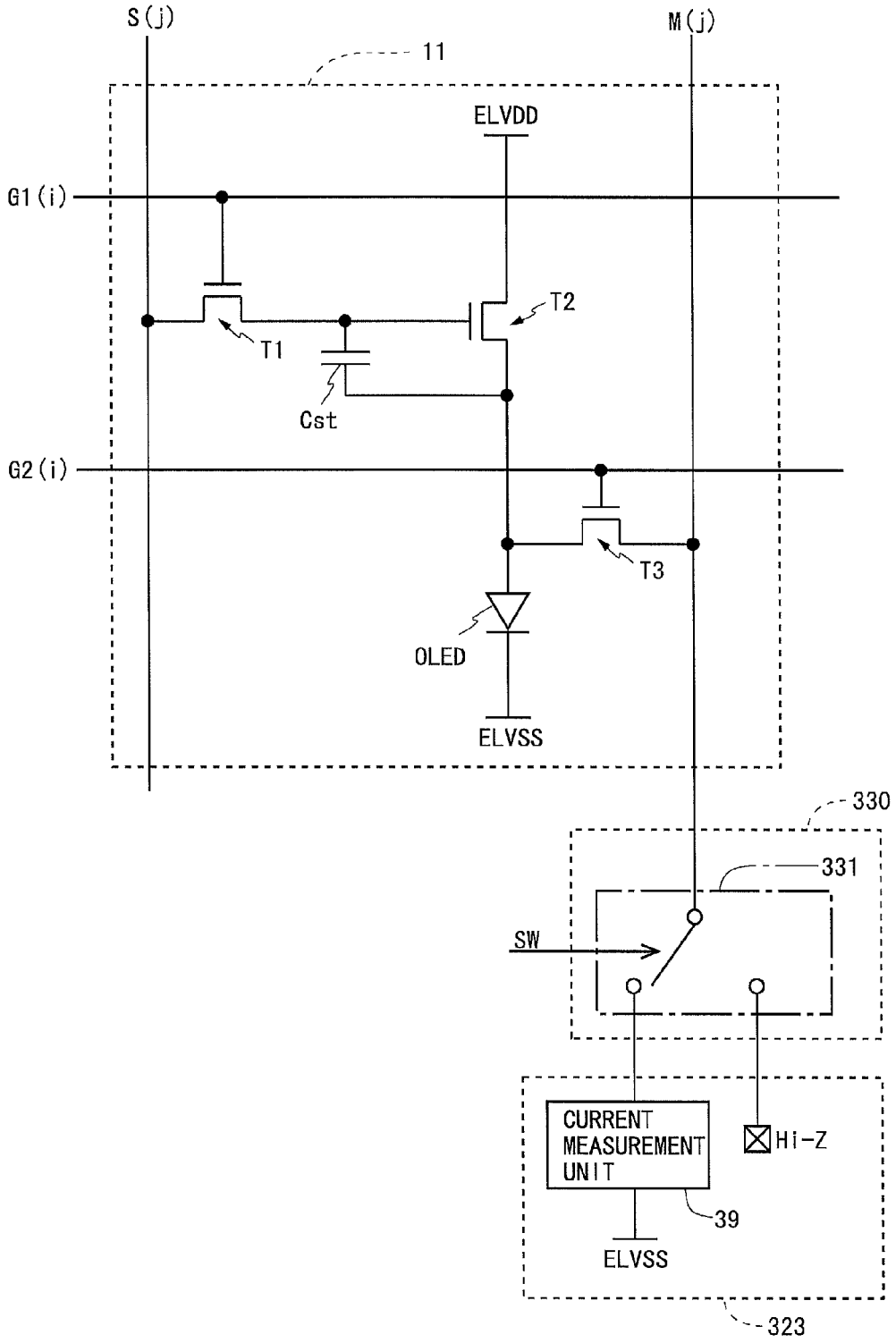
FIG. 42 is a diagram showing configurations of a pixel circuit and a monitor circuit in an eighth modification example of the first embodiment.

In this modification example, both of the detection of the TFT characteristics and the detection of the OLED characteristics are performed by measuring the current. Therefore, as shown in FIG. 42, a constituent for measuring the voltage is not provided in the monitor circuit 323. In this modification example, the monitor line M(j) is set to either one of the state of being connected to the current measurement unit 39 and the state of being a high-impedance, based on the switching control signal SW.

Figure 43:
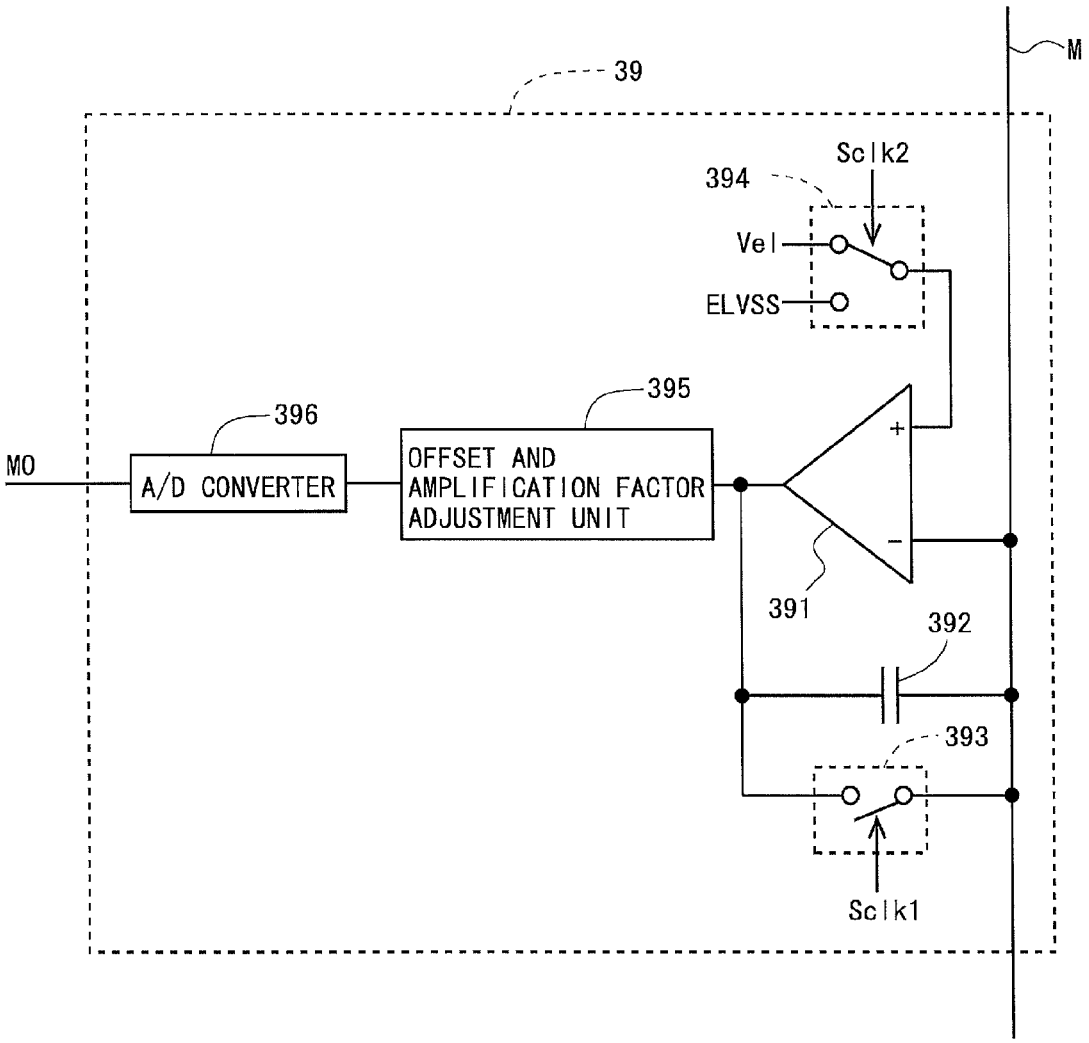
FIG. 43 is a diagram showing a detailed configuration of a current measurement unit in the eighth modification example of the first embodiment.

FIG. 43 is a diagram showing a detailed configuration of a current measurement unit 39 in this modification example. This current measurement unit 39 includes: an operational amplifier 391; a capacitor 392; a first switch 393; a second switch 394; an offset and amplification factor adjustment unit 395 and an A/D converter 396. With regard to the operational amplifier 391, a non-inverting input terminal thereof is connected to the second switch 394, and an inverting input terminal thereof is connected to the monitor line M. The capacitor 392 and the first switch 393 are provided between an output terminal of the operational amplifier 391 and the monitor line M. The offset and amplification factor adjustment unit 395 is provided between the output terminal of the operational amplifier 391 and the A/D converter 396. The second switch 394 functions as a switch for switching a potential of the non-inverting input terminal of the operational amplifier 391 between the potential of the low-level power supply line ELVSS and an OLED characteristic detection potential Ve1. As described above, this current measurement unit 39 is composed of an integrating circuit. Note that such an OLED characteristic detection voltage Ve1 is a potential corresponding to a sum of "a difference between the offset value stored in the offset memory 51 and the offset value obtained in the TFT characteristic detection period Ta" and "a voltage corresponding to a light emission voltage calculated from the gain value stored in the gain memory 52 and the gain value obtained in the TFT characteristic detection period Ta".

In such a configuration, in an event where the current is measured in order to detect the noise or to detect the TFT characteristics, similar operations to those of the above-described first embodiment are performed in a state where the potential of the non-inverting input terminal of the operational amplifier 391 is set to the potential of the low-level power supply line ELVSS by a second control clock signal Sclk2. In an event where the current is measured in order to detect the OLED characteristics, first, the potential of the non-inverting input terminal of the operational amplifier 391 is set to the OLED characteristic detection potential Ve1 by the second control clock signal Sclk2, and in addition, the first switch 393 is turned to the ON state by a first control clock signal Sclk1. Thus, the output terminal of the operational amplifier 391 and inverting input terminal thereof turn to a short circuit state, and the potential of the monitor line M becomes equal to the OLED characteristic detection potential Ve1. Then, the first switch 393 is turned to the OFF state by the first control clock signal Sclk1. Thus, due to the presence of the capacitor 392, the potential of the output terminal of the operational amplifier 391 changes in response to the magnitude of the current (source current supplied to the organic EL element OLED) flowing through the monitor line M. Such a change of the potential is reflected onto a digital signal outputted from the A/D converter 396. Then, the digital signal is outputted as the monitor data MO from the monitor circuit 323. Note that the offset and amplification factor adjustment unit 395 has a function to equalize input levels to the A/D converter 396 between in the event of the TFT characteristic detection and in the event of the OLED characteristic detection.

Figure 44:
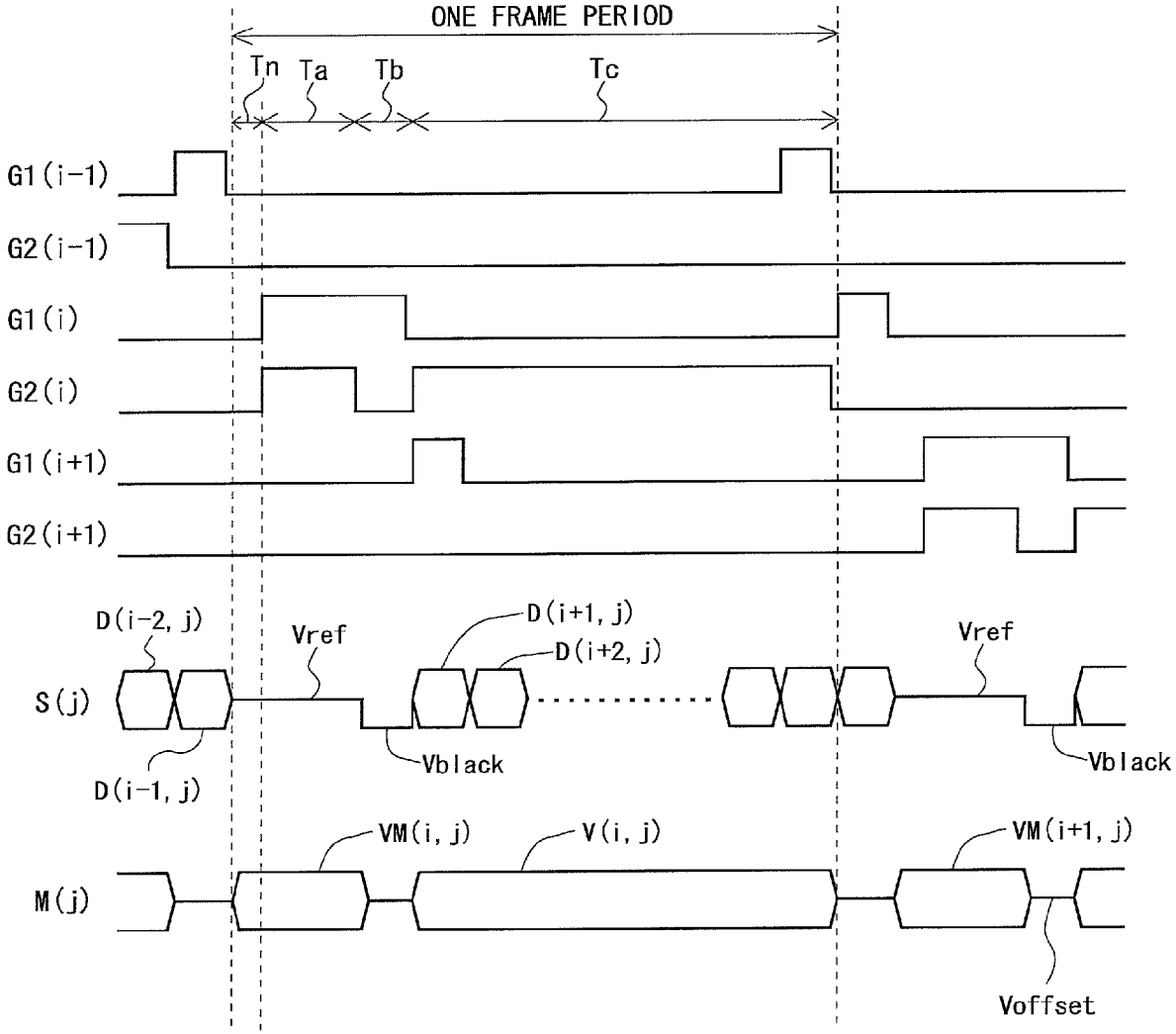
FIG. 44 is a timing chart for explaining operations of a pixel circuit (defined to be the pixel circuit on the i-th row and the j-th column) included in the monitor column in the monitor row in the eighth modification example of the first embodiment.

FIG. 44 is a timing chart for explaining operations of the pixel circuit 11 (defined to be the pixel circuit 11 on the i-th row and the j-th column) included in the monitor column in the monitor row in this modification example. However, it is assumed that the magnitude of the noise detected in the noise measurement period Tn is less than the standard value. In this modification example, unlike the above-described first embodiment (refer to FIG. 15), a constant voltage V(i,j) is given to the monitor line M(j) in the period for detecting the OLED characteristics in the light emission period Tc.

In this modification example, as described above, the OLED characteristics are detected by measuring the current flowing through the organic EL element OLED in the state where the constant voltage is given to the organic EL element OLED. In such a way, it becomes possible to shorten a measurement time.

Note that it is recommended that a magnitude of the constant voltage given to the organic EL element OLED be obtained based on the deterioration correction coefficient obtained from the difference between the gain value stored in the gain memory 52 and the gain value obtained in the TFT characteristic detection period Ta. Moreover, in the event of the detection of the OLED characteristics, preferably, the length of the time in which the constant voltage is given to the organic EL element OLED is adjusted in response to the target brightness. Moreover, as long as the integrated value of the light emission current in one frame becomes the value equivalent to the desired gradation, then characteristics (current-voltage characteristics) at a plurality of operation points may be measured by changing a voltage value in the light emission period Tc.

<2. Second Embodiment>

<2.1 Configuration>

Figure 45:
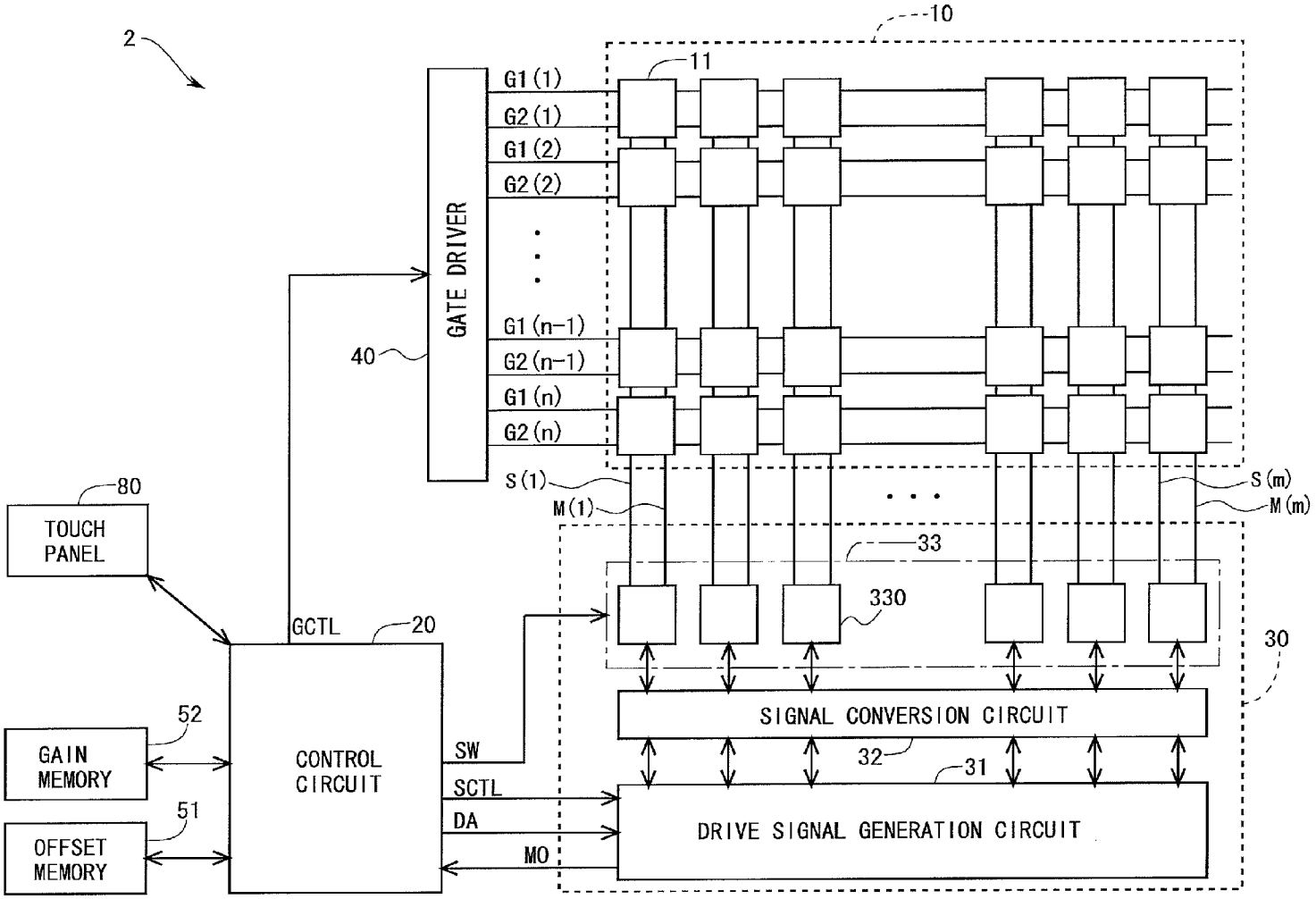
FIG. 45 is a block diagram showing an overall configuration of an active matrix-type organic EL display device according to a second embodiment of the present invention.

FIG. 45 is a block diagram showing an overall configuration of an active matrix-type organic EL display device 2 according to a second embodiment of the present invention. As shown in FIG. 45, in the organic EL display device 2 according to this embodiment, a touch panel 80 is provided in addition to the constituents in the above-described first embodiment.

Incidentally, the touch panel is relatively prone to generate noise. Therefore, in the organic EL display device that mounts the touch panel thereon, it is frequent that the touch panel is allowed to perform a clock operation in a vertical retrace line period. Accordingly, also in this embodiment, it is assumed that the touch panel 80 performs the clock operation in the vertical retrace line period.

<2.2 Drive Method>

In the organic EL display device that mounts the touch panel thereon, even when the noise with the standard value or more is not detected in the noise measurement periods Tn before and after the characteristic detection period, it is possible that, for example, the current for obtaining the TFT characteristics may not be detected correctly in the characteristic detection period due to the clock operation of the touch panel. Accordingly, in this embodiment, the control unit (control circuit 20) controls the operations of the pixel circuit drive unit (source driver 30 and gate driver 40) so that the characteristic detection operation is not performed throughout the vertical retrace line period (period in which the clock operation by the touch panel 80 is performed).

Figure 46:
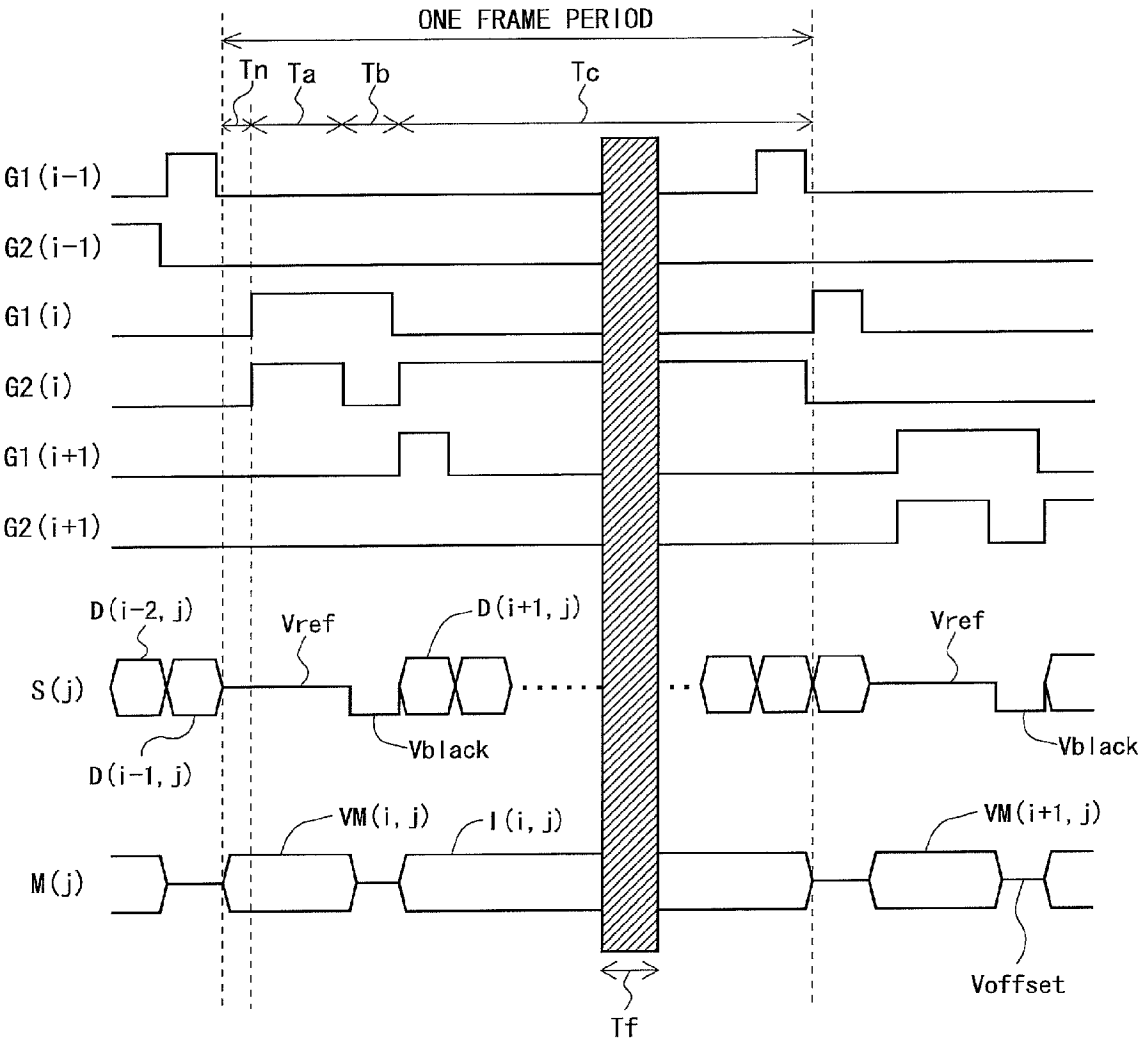
FIG. 46 is a timing chart for explaining operations of a pixel circuit (defined to be the pixel circuit on the i-th row and the j-th column) included in the monitor column in the monitor row in the second embodiment.

FIG. 46 is a timing chart for explaining operations of the pixel circuit 11 (defined to be the pixel circuit 11 on the i-th row and the j-th column) included in the monitor column in the monitor row in this embodiment. However, it is assumed that the magnitude of the noise detected in the noise measurement period Tn is less than the standard value. Note that, in FIG. 46, the vertical retrace line period is denoted by reference symbol Tf. In this embodiment, the characteristic detection operation is stopped in the vertical retrace line period Tf. That is to say, in the vertical retrace line period Tf, the processing for measuring the magnitude of the current flowing through the monitor line M is stopped. Note that it is recommended to obtain a desired magnitude of the current by repeating the measurement of the current before and after the vertical retrace line period Tf and by performing averaging processing for measurement results.

<2.3 Effects>

According to this embodiment, in the organic EL display device in which the external compensation technology is adopted in order to compensate for the deterioration of the circuit element, it becomes possible to prevent the decrease in the compensation accuracy, which results from the noise, even when the touch panel is mounted.

<3. Third Embodiment>

<3.1 Configuration>

Figure 47:
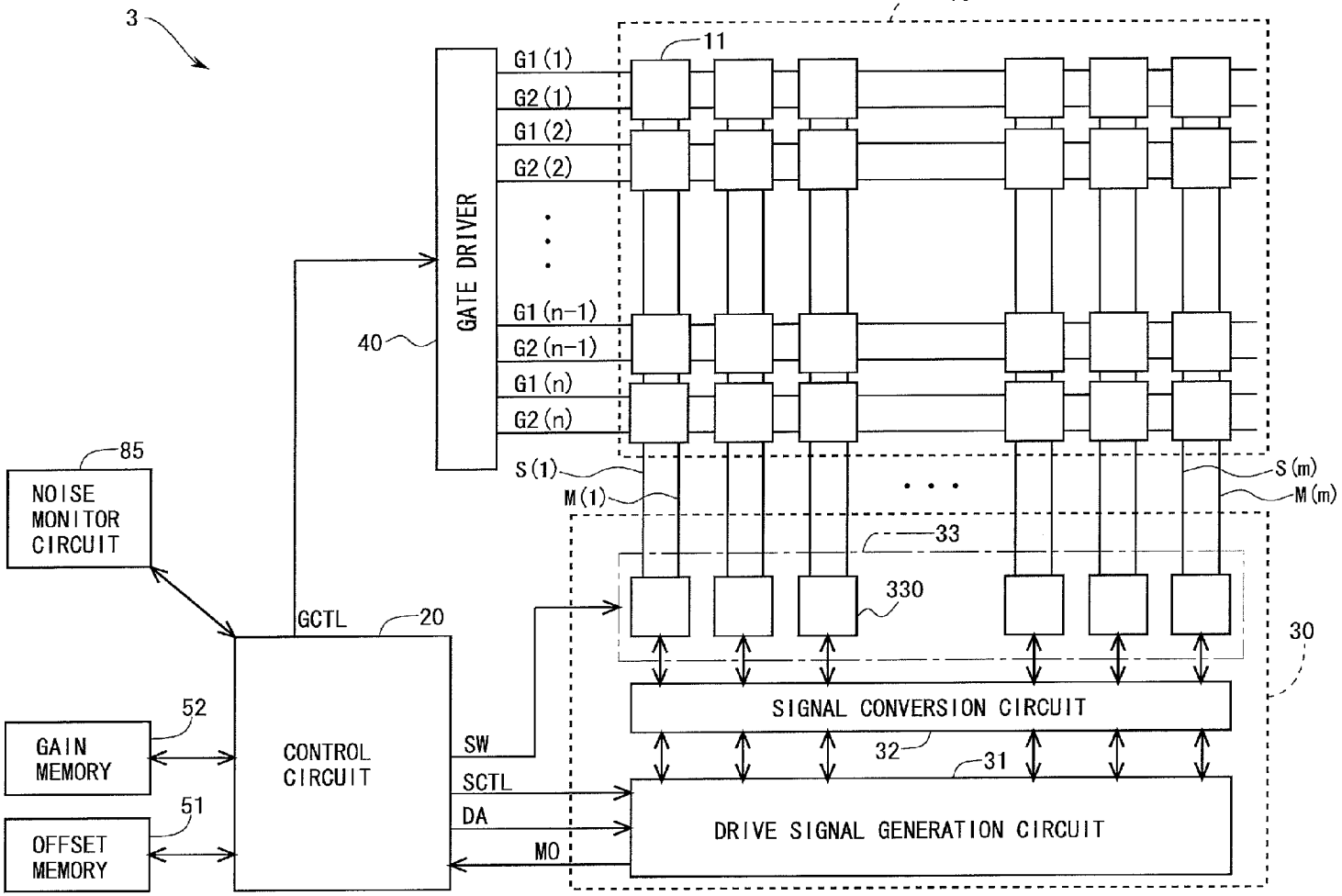
FIG. 47 is a block diagram showing an overall configuration of an active matrix-type organic EL display device according to a third embodiment of the present invention.

FIG. 47 is a block diagram showing an overall configuration of an active matrix-type organic EL display device 3 according to a third embodiment of the present invention. In this embodiment, a noise monitor circuit 85 for detecting the noise is provided on the outside of the organic EL panel. In such a configuration, the measurement of the current for obtaining the TFT characteristics and the measurement of the voltage for obtaining the OLED characteristics are performed in the monitor circuit 322, and the measurement of the noise is performed in the noise monitor circuit 85. The measurement of the noise is performed on the outside of the organic EL panel as described above, and accordingly, the magnitude of the noise is not determined for each column. Note that, in this embodiment, a noise measurement unit is realized by the noise monitor circuit 85. That is to say, the noise measurement unit is provided on the outside of the organic EL panel separately from the characteristic detection unit (monitor circuit 322).

<3.2 Control Algorithm>

Figure 48:
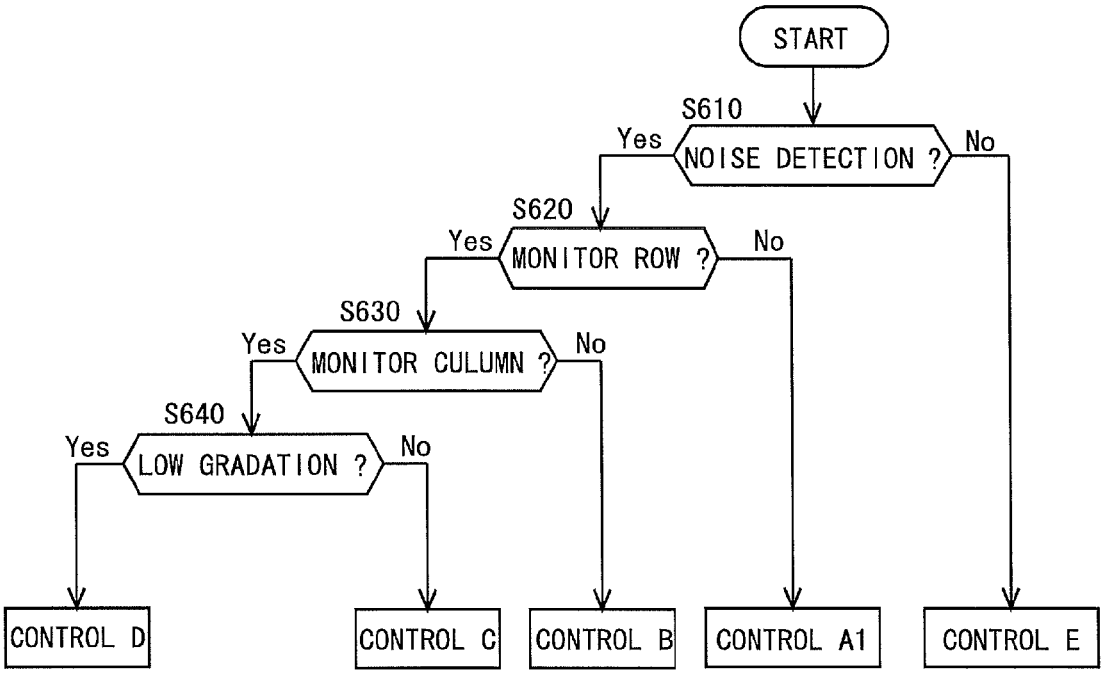
FIG. 48 is a flowchart for explaining a control algorithm in the third embodiment.

Next, a description is made of a control algorithm in this embodiment. Note that, here, it is assumed that the noise is measured in the noise monitor circuit 85 before the characteristic detection operation is performed. FIG. 48 is a flowchart for explaining the control algorithm. FIG. 49 is a table for explaining the respective controls. Based on this control algorithm, the control circuit 20 controls the operations of the source driver 30 and the gate driver 40. First, while referring to FIG. 48, a description is made of a determination procedure of a control method for the data to be processed (data indicating the rows, the columns and the gradations) (hereinafter, referred to as "object data").

First, in Step S610, it is determined whether or not the magnitude of the noise detected in the noise monitor circuit 85 is less than the standard value. If the magnitude of the noise is the standard value or more, then the control method for the object data becomes "Control E". If the magnitude of the noise is less than the standard value, then a determination in Step S620 is further performed. In Step S620, it is determined whether or not the object data is the data of the monitor row. Unless the object data is the data of the monitor row, then the control method for the object data becomes "Control A1". If the object data is the data of the monitor row, then a determination in Step S630 is further performed. In Step S630, it is determined whether or not the object data is the data of the monitor column. Unless the object data is the data of the monitor column, then the control method for the object data becomes "Control B". If the object data is the data of the monitor column, then a determination in Step S640 is further performed. In Step S640, it is determined whether or not the object data is the low-gradation data (gradation data in which black is displayed or gradation data in which substantially black display is performed). Unless the object data is the low-gradation data, then the control method for the object data becomes "Control C". If the object data is the low-gradation data, then the control method for the object data becomes "Control D".

"Control A1", "Control B", "Control C" and "Control D" are similar to those of the above-described first embodiment, and accordingly, a description thereof is omitted.

"Control E" is a control method for the respective data when the noise with the standard value or more is detected. Since the noise with the standard value or more is detected, and it is not necessary to perform the characteristic detection, the scanning lines G1(i) are set to the active state (high-level state) for the usual one horizontal scanning period. The monitor control lines G2(i) are set to the inactive state (low-level state) in all of the rows. Note that, in order that the characteristic detection operation can be performed from the corresponding row in the next frame and after, a row in the active state is stored immediately before setting the monitor control lines G2(i) of all of the rows to the inactive state. Moreover, since it is sufficient to perform the usual display, the data voltage corresponding to the usual gradation data is applied to the data line S(j). Since it is not necessary to perform the characteristic detection, the state of the monitor line switch 331 is set to the OFF state. Since the characteristic detection is not performed, the correction data is not updated.

<3.3 Effects>

Figure 50:
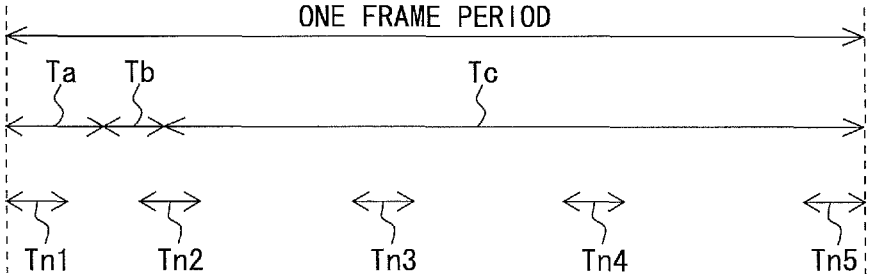
FIG. 50 is a graph for explaining an effect in the third embodiment.
Figure 51:
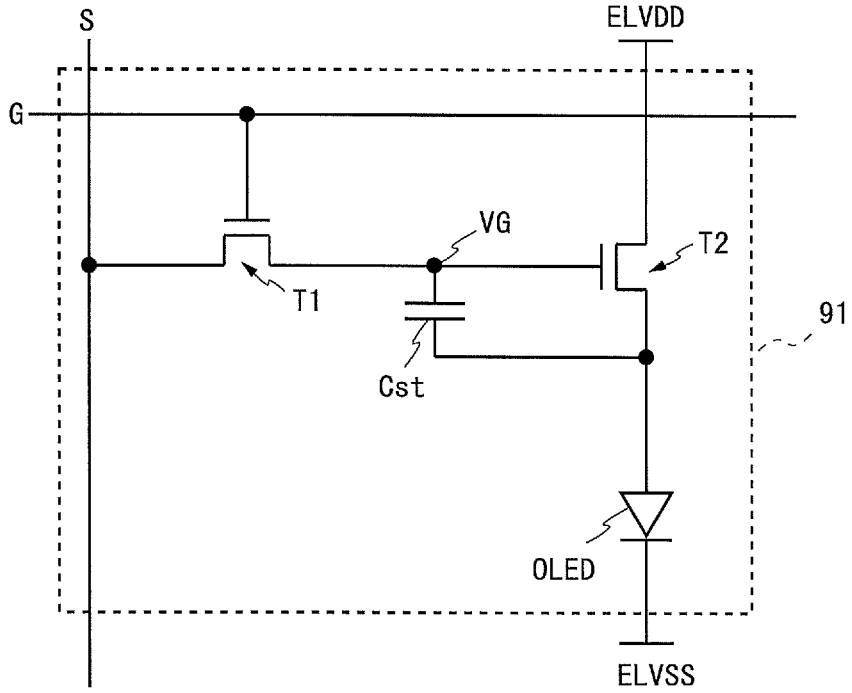
FIG. 51 is a circuit diagram showing a configuration of a conventional general pixel circuit.
Figure 52:
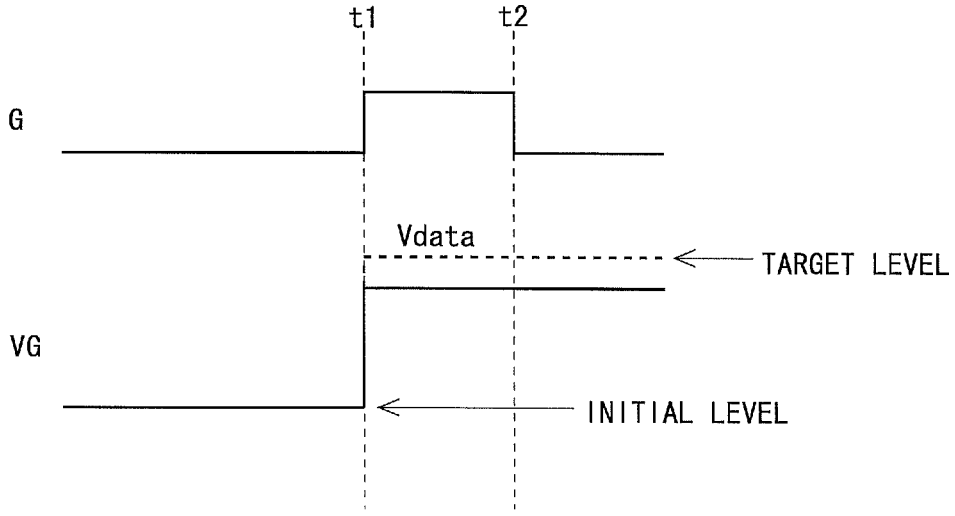
FIG. 52 is a timing chart for explaining operations of the pixel circuit shown in FIG. 51.
Figure 53:
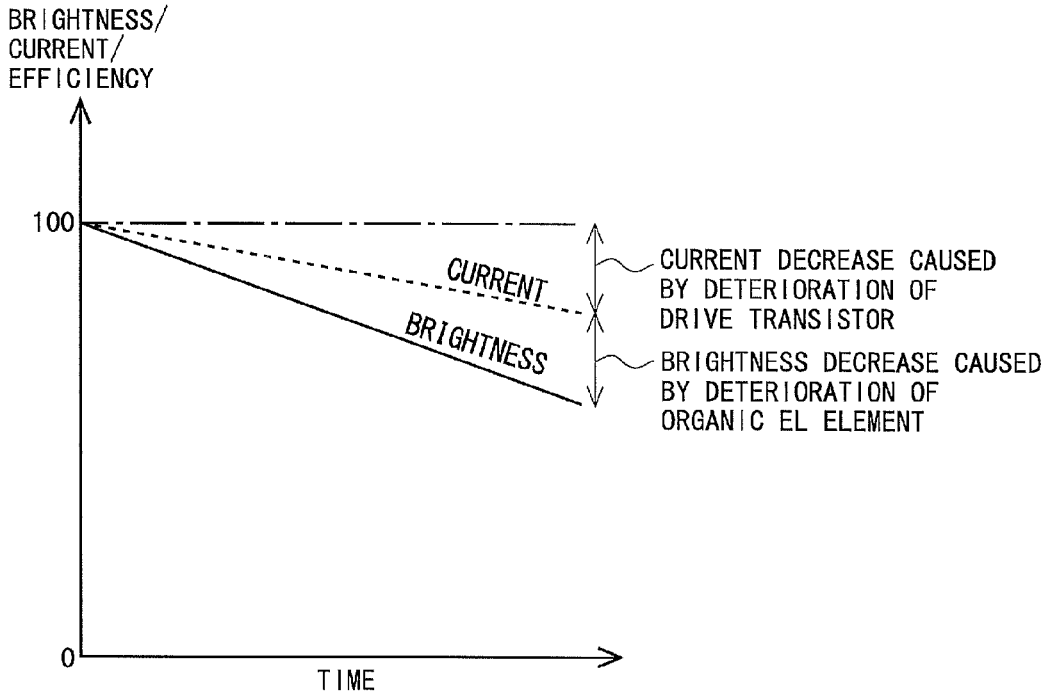
FIG. 53 is a graph for explaining a case where no compensation is made for the deterioration of the drive transistor and the deterioration of the organic EL element.
Figure 54:
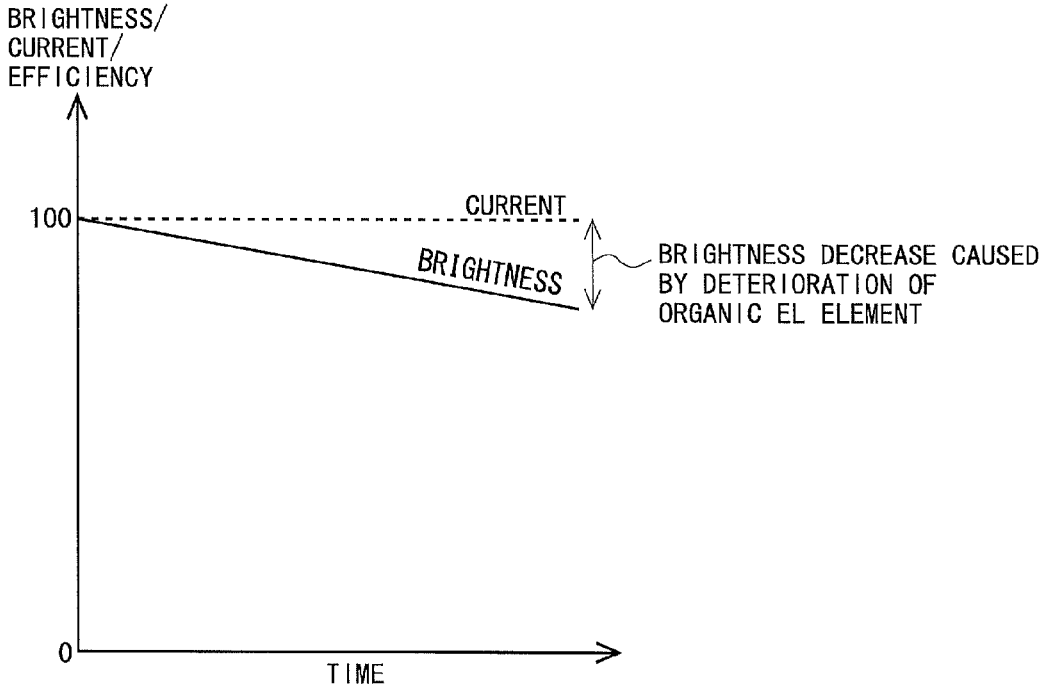
FIG. 54 is a graph for explaining a case where the compensation is made only for the deterioration of the drive transistor.
Figure 55:
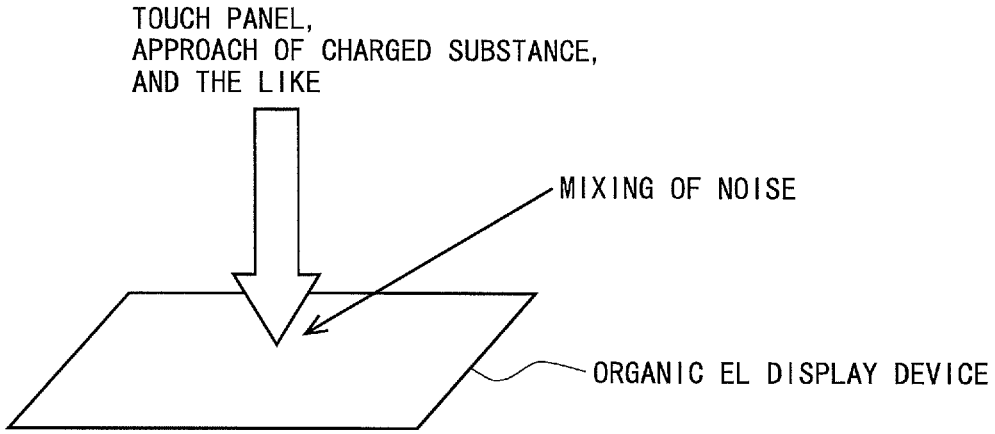
FIG. 55 is a view for explaining an influence of noise emitted from a touch panel.

According to this embodiment, the circuit for measuring the noise (noise monitor circuit 85) is provided separately from the monitor circuit 322 for detecting the TFT characteristics and detecting the OLED characteristics, and accordingly, it becomes possible to measure the noise at any timing in the frame period. That is to say, any period in the frame period can be set to be the noise measurement period Tn. For example, any period such as a period denoted by reference symbol Tn1 in FIG. 50, a period denoted by reference symbol Tn2 in FIG. 50, a period denoted by reference symbol Tn3 in FIG. 50, a period denoted by reference symbol Tn4 in FIG. 50, and a period denoted by reference symbol Tn5 in FIG. 50, may be set to be the noise measurement period.

<4. Others>

An organic EL display device to which the present invention is applicable should not be limited to the one including the pixel circuit 11 shown in FIG. 7. The pixel circuit may have a configuration other than the configuration shown in FIG. 7, as long as at least the electro-optical element (organic EL element OLED) which is controlled by the current, the transistors T1 to T3, and the capacitor Cst are provided.

With regard to the first embodiment, the first to eighth modification examples are shown. These first to eighth modification examples can also be applied to the second embodiment and the third embodiment. Moreover, the first to eighth modification examples can also be adopted in appropriate combination. For example, the first modification example and the seventh modification example may be applied to the first embodiment.

In each of the embodiments and in each of the modification examples, both of the TFT characteristics and the OLED characteristics are detected in each frame; however, the present invention is not limited to this. As long as at least either of the TFT characteristics and the OLED characteristics are detected in the characteristic detection period in each frame, the present invention can be applied.

DESCRIPTION OF REFERENCE CHARACTERS

1~3: ORGANIC EL DISPLAY DEVICE
10: DISPLAY UNIT
11: PIXEL CIRCUIT
20: CONTROL CIRCUIT
30: SOURCE DRIVER
31: DRIVE SIGNAL GENERATION CIRCUIT
32: SIGNAL CONVERSION CIRCUIT
33: OUTPUT UNIT
37,39: CURRENT MEASUREMENT UNIT
38: VOLTAGE MEASUREMENT UNIT
40: GATE DRIVER
51: OFFSET MEMORY
52: GAIN MEMORY
80: TOUCH PANEL
85: NOISE MONITOR CIRCUIT
321: GRADATION SIGNAL GENERATION CIRCUIT
322,323: MONITOR CIRCUIT
330: OUTPUT CIRCUIT
T1~T3: TRANSISTOR
Cst: CAPACITOR
G1(1)~G1(n): SCANNING LINE
G2(1)~G2(n): MONITOR CONTROL LINE
S(1)~S(m): DATA LINE
M(1)~M(m): MONITOR LINE
Ta: TFT CHARACTERISTIC DETECTION PERIOD
Tb: BLACK WRITING PERIOD
Tc: LIGHT EMISSION PERIOD
Tn: NOISE MEASUREMENT PERIOD

The invention claimed is:

1. A display device having a pixel matrix of n rows and m columns (n and m are integers of 2 or more), which is composed of n×m pieces of pixel circuits each including an electro-optical element in which brightness is controlled by a current and including a drive transistor for controlling a current to be supplied to the electro-optical element, the display device comprising:

a pixel circuit drive unit configured to drive the n×m pieces of pixel circuits while performing characteristic detection processing for detecting at least either one of characteristics of the drive transistor and characteristics of the electro-optical element;

a correction data storage unit configured to store correction data for correcting a video signal;

a control unit configured to control operations of the pixel circuit drive unit while performing correction data update processing for updating the correction data, which is stored in the correction data storage unit, based on a detection result in the characteristic detection processing, and video signal correction processing for correcting the video signal, which is to be supplied to the n×m pieces of pixel circuits, based on the correction data stored in the correction data storage unit; and a noise measurement unit configured to measure noise, wherein, when noise with a standard value or more is detected by the noise measurement unit, the control unit controls operations of the pixel circuit drive unit so that the characteristic detection processing immediately after a point of time when the noise is detected is not performed, or the control unit does not perform the correction data update processing that is based on a detection result in the characteristic detection processing performed at a point of time close to the point of time when the noise is detected.

2. The display device according to claim 1, wherein, when the noise with the standard value or more is detected by the noise measurement unit, the control unit does not perform at least either one of the correction data update processing that is based on a detection result in the characteristic detection processing performed immediately before the point of time when the noise is detected and the correction data update processing that is based on a detection result in the characteristic detection processing performed immediately after the point of time when the noise is detected.

3. The display device according to claim 1, further comprising:

monitor lines provided to correspond to respective columns of the pixel matrix, wherein the pixel circuit drive unit includes a characteristic detection unit configured to perform the characteristic detection processing by measuring a current flowing through each of the monitor lines or a voltage at a predetermined position on each of the monitor lines.

4. The display device according to claim 3, wherein the noise measurement unit shares a same circuit with the characteristic detection unit, and when the measurement of the noise by the noise measurement unit is performed, each of the monitor lines is set to a state of being electrically separated from the electro-optical element and the drive transistor.

5. The display device according to claim 3, wherein the noise measurement unit is provided on an outside of an organic EL panel separately from the characteristic detection unit, the organic EL panel including the pixel matrix.

6. The display device according to claim 3, wherein the characteristic detection unit is provided only one for K pieces of the monitor lines (K is an integer of 2 or more to m or less), and in a frame period, one of the K pieces of monitor lines is electrically connected to the characteristic detection unit, and a monitor line that is not electrically connected to the characteristic detection unit is set to a high-impedance state.

7. The display device according to claim 1, further comprising:

a touch panel, wherein the control unit controls operations of the pixel circuit drive unit so that the characteristic detection processing is stopped throughout a period in which a clock operation by the touch panel is performed.

8. The display device according to claim 7, wherein the touch panel performs the clock operation in a vertical retrace line period, and the control unit controls the operations of the pixel circuit drive unit so that the characteristic detection processing is stopped throughout the vertical retrace line period.

9. A drive method for a display device having a pixel matrix of n rows and m columns (n and m are integers of 2 or more), which is composed of n×m pieces of pixel circuits each including an electro-optical element in which brightness is controlled by a current and including a drive transistor for controlling a current to be supplied to the electro-optical element, the drive method comprising:

a noise measurement step of measuring noise;

a characteristic detection step of detecting at least either one of characteristics of the drive transistor and characteristics of the electro-optical element;

a correction data update step of updating correction data, which is stored in a correction data storage unit provided in the display device, based on a detection result in the characteristic detection step; and a video signal correction step of correcting a video signal, which is to be supplied to the n×m pieces of pixel circuits, based on the correction data stored in the correction data storage unit, wherein, when noise with a standard value or more is detected in the noise measurement step, processing of the characteristic detection step immediately after a point of time when the noise is detected is not performed, or processing of the correction data update step, that is based on a detection result in the characteristic detection step performed at a point of time close to the point of time when the noise is detected, is not performed.

10. The drive method according to claim 9, wherein, when the noise with the standard value or more is detected in the noise measurement step, at least either one of processing of the correction data update step, that is based on a detection result in the characteristic detection step performed immediately before the point of time when the noise is detected, and processing of the correction data update step, that is based on a detection result in the characteristic detection step performed immediately after the point of time when the noise is detected, is not performed.

11. The drive method according to claim 9, wherein, at least either one of the characteristics of the drive transistor and the characteristics of the electro-optical element is detected for only one row of the pixel matrix in the characteristic detection step in a frame period;

when a frame period in which the processing of the characteristic detection step is performed for a Z-th row (Z is an integer of 1 or more to n or less) is defined as an object frame period, in a case where the noise with the standard value or more is detected in the noise measurement step in the object frame period, the processing of the correction data update step, that is based on the detection result in the characteristic detection step performed in the object frame period, is not performed, and the processing of the characteristic detection step for the Z-th row is performed also in a frame period next to the object frame period; and in a case where the noise with the standard value or more is not detected in the noise measurement step in the object frame period, and where the noise with the standard value or more is detected in the noise measurement step in the frame period next to the object frame period, then the processing of the correction data update step, that is based on the detection result in the characteristic detection step performed in the object frame period, and the processing of the correction data update step, that is based on the detection result in the characteristic detection step performed in the frame period next to the object frame period, are not performed, and the processing of the characteristic detection step for the Z-th row is performed also in a frame period two frames after the object frame period.

12. The drive method according to claim 9, wherein, at least either one of the characteristics of the drive transistor and the characteristics of the electro-optical element is detected only for one row of the pixel matrix in the characteristic detection step in a frame period, and the processing of the correction data update step, that is based on a detection result in the characteristic detection step for a Z-th row (Z is an integer of 1 or more to n or less), is performed only when the noise with the standard value or more is not detected in both of the noise measurement step performed immediately before the characteristic detection step for the Z-th row and the noise measurement step performed immediately after the characteristic detection step for the Z-th row.

13. The drive method according to claim 12, wherein, the processing of the noise measurement step is performed before and after the characteristic detection step in a frame period.

14. The drive method according to claim 9, wherein the processing of the noise measurement step is performed every a plurality of frame periods.

15. The drive method according to claim 9, wherein the characteristic detection step includes:

a first characteristic detection step of detecting the characteristics of the drive transistor; and a second characteristic detection step of detecting the characteristics of the electro-optical element, one frame period includes a noise measurement period in which the processing of the noise measurement step is performed, a selection period in which a preparation to allow the electro-optical element to emit light is performed, and a light emission period in which light emission of the electro-optical element is performed, processing of the first characteristic detection step is performed in the selection period, and processing of the second characteristic detection step is performed in the light emission period.

16. The drive method according to claim 15, wherein, in the second characteristic detection step, the characteristics of the electro-optical element are detected by measuring a voltage of an anode of the electro-optical element in a state where a constant current is given to the electro-optical element.

17. The drive method according to claim 15, wherein, in the second characteristic detection step, the characteristics of the electro-optical element are detected by measuring a current, which flows through the electro-optical element, in a state where a constant voltage is given to the electro-optical element.

18. The drive method according to claim 15, wherein, in the first characteristic detection step, the characteristics of the drive transistor are detected by measuring a current, which flows between a drain and a source of the drive transistor in a state where a voltage between a gate and a source of the drive transistor is set at a predetermined magnitude.

19. The drive method according to claim 9, wherein the display device further includes a touch panel, and the processing of the characteristic detection step is not performed throughout a period in which a clock operation by the touch panel is performed.

20. The drive method according to claim 19, wherein the touch panel performs the clock operation in a vertical retrace line period, and the processing of the characteristic detection step is not performed throughout the vertical retrace line period.

* * * * *